US006746833B2

(12) United States Patent
Ii et al.

(10) Patent No.: US 6,746,833 B2
(45) Date of Patent: Jun. 8, 2004

(54) COLOR IMAGE FORMING METHOD AND DIGITAL IMAGE FORMING METHOD

(75) Inventors: Hiromoto Ii, Tokyo (JP); Hiroyuki Hoshino, Tokyo (JP); Noriyuki Kokeguchi, Tokyo (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/439,076

(22) Filed: May 15, 2003

(65) Prior Publication Data

US 2004/0002022 A1 Jan. 1, 2004

(30) Foreign Application Priority Data

May 23, 2002 (JP) ..... 2002-149095
Jul. 23, 2002 (JP) ..... 2002-213866

(51) Int. Cl.[7] ..... G03C 7/407
(52) U.S. Cl. ..... 430/394; 430/351; 430/377
(58) Field of Search ..... 430/394, 351, 430/377

(56) References Cited

U.S. PATENT DOCUMENTS 5,976,771 A * 11/1999 Kosugi et al. ..... 430/351
6,001,543 A * 12/1999 Asami et al. ..... 430/351
6,218,095 B1 * 4/2001 Ohzeki et al. ..... 430/505
6,303,261 B1 * 10/2001 Arakawa et al. ..... 430/203
6,528,241 B1 * 3/2003 Szajewski ..... 430/376

* cited by examiner

*Primary Examiner*—Hoa Van Le
(74) *Attorney, Agent, or Firm*—Muserlian, Lucas and Mercanti

(57) ABSTRACT

A color image forming method is disclosed, comprising exposing a silver halide color photographic material and developing the exposed photographic material at 43 to 180° C. to form a color image, wherein at least one light-sensitive layer comprising a silver halide emulsion comprising tabular silver halide grains having an average aspect ratio of at least 8. There is also disclosed a digital image forming process, wherein image recording information of the photographic material which was formed by use of the color image forming method is coverted to digital image information through an image sensor.

18 Claims, No Drawings

COLOR IMAGE FORMING METHOD AND DIGITAL IMAGE FORMING METHOD

FIELD OF THE INVENTION

The present invention relates to a color image forming method using silver halide color photographic materials and a digital image forming method by the use thereof.

BACKGROUND OF THE INVENTION

Silver halide photographic light-sensitive materials (hereinafter, also denoted simply as photographic materials) are used as a recording material which is simple and low in cost but nonetheless capable of providing high quality images. These materials have greatly contributed to the advancement of industry and culture, and have become indispensable material.

Silver halide color photographic material such as color negative film, after exposure, is subjected to color development to form yellow (Y), magenta (M) and cyan (C) dye images along with formation of silver images, which is subsequently subjected to bleaching to bleach the silver images to silver halide. The thus formed silver halide becomes a soluble silver complex and is removed from the photographic material. The photographic material is further subjected to a stabilization treatment to wash out any residual fixing agent and to clean the photographic material.

In the universally employed processing for color negative film (e.g., Process C-41 or CNK-4), as described above, the photographic material is subjected to many processing steps, often resulting in problems such that the processing time becomes relatively lengthy and the processing apparatus becomes larger. There also arise problems such that water is needed to make processing solutions and its dissolution work is cumbersome, handling the relatively high pH solution is hazardous, it is troublesome to control exhausted processing solutions after processing, and disposal of processing effluents is not preferable for environmental protection.

The foregoing problems have are less of problem in large volume labs. Recently, on-site processing, so-called minilab has increased to enhance convenience of color film processing, for which a compact and rapidly accessible photographic processing system is desired, which can be handled even by a non-specialist or part-time workers and is simple, safe and friendly to the environment. Further thereto, to achieve further enhancement of convenience of color films, it is also desired to introduce a photographic processing system into a place such as convenience stores, where a photographic processing apparatus has not been provided and therefore, development of a compact and rapidly-accessible photographic processing system which functions in a simple and safe manner without discharging effluent but still is friendly to the environment is desired to replace conventional processing systems. Various attempts have been made in response to such a desire. For example, JP-A Nos. 9-325463 and 10-62938 (hereinafter, the term, JP-A refers to unexamined and published Japanese Patent Application) disclose a technique, in which a photographic material is superposed onto a processing element in the presence of water and the material is then heated to form images. Such a technique enables easy processing of a photographic material, but the photographic material used therein is a specific one which occludes a color developing agent and conventional color films are not applicable thereto.

Nowadays, in this so-called digitization age, it is common that image information is optically read out from photographed and processed film to form images, using an image sensor such as film scanner, the images are converted to electric signals and digitized, thereby, the image information can be stored as signals and subjected to computer processing to obtain dye images using a photo-copy or a hard copy. In such an imaging process is generally performed an image input by using a digital camera provided with a solid-state image sensor as well as conventional silver salt photographic films (such as color negative film). However, high quality images cannot be obtained by low-priced digital cameras which are relatively low in pixel density and narrow in dynamic range and which are rather expensive relative to a conventional lens-fitted film. The integrated usability of silver halide photographic material system is still high.

Various attempts have been made in response to such demand. For example, JP-A Nos. 9-325463 and 10-62938 (hereinafter, the term, JP-A refers to unexamined Japanese Patent Application Publication) disclose a technique, in which a photographic material is superposed onto a processing element in the presence of water and the material is then heated to form images. JP-A Nos. 11-184055 and 11-65054 disclose a technique, in which a developer solution containing a color developing agent is coated or sprayed onto a photographic material to form dye images. JP-A No. 2001-166449 discloses a method of processing photographic film packed in a thrust film cartridge using a developing apparatus having a washing mechanism and a donor web placed along the processing route to conduct coating of the processing solution. JP-A No. 1-161236 discloses an increase of the swelling speed of image receiving material of a diffusion transfer photographic material by a factor of 0.2 to 1.5 of photographic material photographic material; and JP-A 9-325463 discloses processing a developer incorporated photographic material by a processing member exhibiting a higher swelling degree for water than the photographic material. JP-A No. 2001-350240 discloses a photographic material comprising a silver halide emulsion layer having a pAg of 4.0 to 8.5, and containing tabular silver halide grains having an aspect ratio of 5 or more and accounting for at least 60% of the grain projected area; JP-A No. 2001-350236 discloses a processing method to achieve a high developed silver density; and JP-A 2002-31867 discloses a processing method, in which the number of development initiating points per silver halide grain is 3.0 or more at the time of completion of color development. As a result of detailed study of the foregoing disclosures by the inventors of this application, it was proved that although enhanced sensitivity was achieved, formed dye clouds were non-uniform in the course of rapid processing by the foregoing disclosed techniques, and sufficient performance was not achieved in graininess.

Further, in processed silver halide color photographic materials as described above, valuable resources such as silver are disposed or a part thereof is recovered after processing so that the reuse ratio thereof is still low. Considering further exhaustion of finite resources such as silver in future, there is desired a new method for reuse of resources.

SUMMARY OF THE INVENTION

In view of the foregoing problems, the present invention was achieved. Thus, it is an object of the invention to provide a method for forming a color image with silver halide color photographic material exhibiting enhanced sensitivity, superior graininess and suitability for rapid access, an inexpensive digital image forming method by use thereof and a method for utilizing resources.

The foregoing object was accomplished by the following constitution:

A method of forming a color image comprising:

imagewise exposing a silver halide color photographic material comprising a support having thereon at least one silver halide light-sensitive layer containing a silver halide emulsion comprising silver halide grains and subjecting the exposed photographic material to color development at a developing temperature of 43 to 180° C. to form a color image, wherein the silver halide emulsion comprises tabular silver halide grains having an average aspect ratio of at least 8.

DETAILED DESCRIPTION OF THE INVENTION

Photographic Material

Silver Halide

Silver halides used in this invention may be any halide composition, including silver bromide, silver iodobromide, silver chloride, silver chlorobromide silver iodochlorobromide, and silver iodochloride. In general, silver iodobromide, silver bromide and silver iodochlorobromide are preferably used to achieve high speed and silver chloride and silver chlorobromide are preferably used to perform rapid processing. Silver halide emulsions containing such silver halide grains can be prepared in accordance with methods described in P. Glafkides, Chimie Physique Photographique (published by Paul Montel Corp., 1967); G. F. Duffin, Photographic Emulsion Chemistry (published by Focal Press, 1966); V. L. Zelikman et al., Making and Coating of Photographic Emulsion (published by Focal Press, 1964); JP-A Nos. 51-39027, 55-142329, 58-113928, 54-48521, 58-4938 and 60-138538; and Abstracts of Annual Meeting of Society of Scientific Photography of Japan. Any one of acidic precipitation, neutral precipitation and ammoniacal precipitation is applicable and the reaction mode of aqueous soluble silver salt and halide salt includes single jet addition, double jet addition, a combination thereof, grain formation in the presence of excessive silver ions (reverse precipitation) and supplying a water soluble silver salt and a water soluble halide to fine seed crystals to grow grains.

Grain size distribution of a silver halide emulsion may be narrow or broad, and the emulsion is preferably comprised of monodisperse grains. The monodisperse grains as described herein refer to grains having a width of grain size distribution, i.e., a coefficient of variation of grain size obtained by the formula described below of not more than 25%, and more preferably not more than 20%:

$$(\text{Standard deviation of grain size}/\text{average grain size})\times 100=\text{Width of grain size distribution (\%)}$$

The average grain size of silver halide grains used in this invention is not specifically limited and when the grain volume is represented by equivalent converted to a cube, the edge length is preferably 0.01 to 50 $\mu$m, and more preferably 0.01 to 30 $\mu$m.

The grain form can be of almost any one, including regular form of cubic, octahedral or tetradecahedral grains, and irregular form of twin crystals, such as tabular grains, and the combination thereof. Of these, tabular grains are specifically preferred in this invention. Thus, in the silver halide grain emulsion comprising tabular silver halide grains, tabular grains having an aspect ratio of at least 3 preferably accounts for at least 50%, more preferably at least 80%, and still more preferably at least 90% of a total grain projected area of the emulsion.

The tabular silver halide grains used in this invention are those which have an average aspect ratio of at least 9, preferably 8 to 30, and more preferably 12 to 20. The aspect ratio refers to a ratio of grain diameter to grain thickness (grain diameter/thickness). Outer faces of the tabular grains may substantially be comprised of [111] or [100] face. There may be combined [111] and [100] faces. In this invention, the mean aspect ratio is preferably 8 or more. The higher the aspect ratio, silver halide grains are closely packed into the layer, thereby efficiently supplying a color developing agent to the field of reducing reaction. Silver halide grains having a mean aspect ratio of more than 20 have a defect of insufficient stability in the manufacture thereof.

The [111] face preferably accounts for at least 50% (more preferably 60 to 90%, and still more preferably 70 to 95%) of the grain surface of tabular silver iodobromide or silver bromide grains. The ratio accounted for by the Miller index [100] face can be obtained based on T. Tani, J. Imaging Sci., 29, 165 (1985) in which adsorption dependency of a [111] face or a [100] face is utilized.

In one preferred embodiment of this invention, a silver halide emulsion comprises silver halide grains, in which at least 50% of a total grain projected area is accounted for tabular grains having an aspect ratio of at least 8 and (111) major faces, and silver halide grains having no twin plane or single twin plane or at least two unparallel twin planes account for less than 3% by number of the total grains.

Further, these tabular grains having the (111) major faces, at least two parallel twin planes and an aspect ratio of at least 8 preferably accounts for at least 80%, more preferably at least 90%, still more preferably at least 97%, and optimally 99 to 100% of the total grain projected area.

In a tabular grain emulsion relating to this invention, heteromorphic silver halide grains preferably accounts for less than 3% by number (more preferably less than 1% by number) of total silver halide grains contained in the emulsion. The heteromorphic grains refer to silver halide grains having no twin plane or a single twin plane, or having at least two non-parallel twin planes. Such grains having no twin plane or a single twin plane, or having at least two non-parallel twin planes are in the form of a regular hexahedron, regular octahedron, triangular pyramid or rod, or in a irregular form, as described in E. Klein & E. Moisar, Phot. Korr., 99, 99 (1963)and ibid 100, 57 (1964). These heteromorphic grains often adversely affect photographic performance, causing fogging in the process of chemical sensitization.

In this invention, the average of spacing between at least two twin planes parallel to the major faces (hereinafter, also denoted simply as average twin plane spacing) preferably is 1 to 100 nm, and more preferably 1 to 80 nm. A coefficient of variation of twin plane spacing preferably is not more than 35%, and more preferably 0 to 30%.

Tabular silver (iodo)bromide grains used in this invention are preferably hexagonal. The hexagonal tabular grains are referred to as those having hexagonal(111) major faces, of which the maximum adjacent edge ratio is 1.0 to 2.0. The maximum adjacent edge ratio is referred to as a ratio of the maximum edge length of the hexagonal form to the minimum edge length. Corners of the hexagonal tabular grains having a maximum adjacent edge ratio of 1.0 to 2.0 may be rounded, and circular tabular grains are also usable. The edge length of rounded tabular grains is represented by a distance between intersections when a linear edge portion is linearly extended and intersects with extended straight lines of linear portions of adjacent edges. At least ½ of each edge of the hexagonal tabular grains is preferably comprised of a straight line and the maximum adjacent edge length is more preferably 1.0 to 1.5.

The tabular silver (iodo)bromide grains preferably contain dislocation lines. The dislocation lines in silver halide grains can be directly observed by means of transmission electron microscopy at a low temperature, for example, in accordance with methods described in J. F. Hamilton, Phot. Sci. Eng. 11 57 (1967) and T. Shiozawa, Journal of the Society of Photographic Science and Technology of Japan, 35 213 (1972). The dislocation lines of silver halide grains preferably locate within the region of 0.58L to 1.0L, and more preferably 0.80L to 0.98L in the direction of from the center of the grain to the outer grain surface. The dislocation lines are directed from the center to the outer surface and often wind. It is preferred that at least 50% by number of silver halide grains contain at least one dislocation line. The higher proportion (by number) of dislocation line-containing tabular grains is also preferred. The tabular grains preferably contain dislocation line(s) in the fringe portion of the grain and more preferably in the fringe portion and within the major faces. The tabular grains preferably contain at least 10 and more preferably at least 20 dislocation lines in the fringe portion. In the invention, the expression "containing dislocation lines in the fringe portion" means that the dislocation lines exist in the vicinity of the circumferential portion, in the vicinity of the edge or in the vicinity of the corner of the tabular grain. Concretely, when the tabular grain is observed vertical to the major face of the grain and a length of a line connecting the center of the major face (i.e., a center of gravity of the major face, which is regarded as a two-dimensional figure) and a corner is represented by "L", the fringe portion refers to the region outside the figure connecting points at a distance of 0.50L from the center with respect to the respective corners of the grain.

The dislocation lines can be introduced by forming dislocations, as an origin of dislocation lines, at the intended position by commonly known methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, only an iodide solution is added, iodide-containing fine grains are added or an iodide ion releasing agent is employed, as disclosed in JP-A No. 6-11781. Of these are preferred the double jet addition of an aqueous iodide solution and aqueous silver salt solution, addition of fine iodide-containing grains and the use of an iodide ion releasing agent.

The iodide ion releasing agent is a compound capable of releasing iodide ions upon reaction with a base or a nucleophilic agent and represented by the following formula (A):

R—I formula (A)

where R is a univalent organic group. R is preferably an alkyl group, alkenyl group, alkynyl group, aryl group, aralkyl group, heterocyclic group, acyl group, carbamoyl group, alkyloxycarbonyl group, aryloxycarbonyl group, alkylsulfonyl group, arylsulfonyl group, or sulfamoyl group. R is also preferably an organic group having 30 or less carbon atoms, more preferably 20 or less carbon atoms, and still more preferably 10 or less carbon atoms. R may be substituted by at least one substituent. The substituent may be further substituted. Preferred examples of the substituent include a halogen atom, alkyl group, aryl group, aralkyl group, heterocyclic group, acyl group, acyloxy group, carbamoyl group, alkyloxycarbonyl group, aryloxycarbonyl group, alkylsulfonyl group, arylsulfonyl group, or sulfamoyl group, alkoxy group, aryloxy group, amino group, acylamino group, ureido group, urethane group, sulfonylamino group, sulfinyl group, phosphoric acid amido group, alkylthio group, arylthio group, cyano, sulfo group, hydroxy, and nitro.

The iodide ion releasing agents represented by the formula (A) are preferably iodo-alkanes, an iodo-alcohol, iodo-carboxylic acid, iodo-amid, and their derivatives, more preferably iodo-amide, iodo-alcohol and their derivatives, still more preferably iodo-amide substituted by a heterocyclic group, and specifically preferable examples include (iodoacetoamido)-benzenesulfonate.

There can be also employed silver chloride, silver chlorobromide, silver iodochloride and silver iodochlorobromide other than silver bromide and silver iodobromide, in which tabular grains having [100] major faces and tabular grains having [111] major faces are employed. Tabular silver chloride grains having a [100] face are described in U.S. Pat. No. 5,314,798, European Patent Nos. 534,318A and 617,325A, WO94/22051, European Patent No. 616,255A, U.S. Pat. Nos. 5,356,764, 5,320,938 and 5,275,930, JP-A Nos. 5-204073, 5-281640, 7-225441 and 6-30116. Tabular grains mainly comprised of [111] face are detailed in U.S. Pat. No. 4,439,520. U.S. Pat. No. 5,250,403 discloses so-called ultra-thin tabular grains having an equivalent circle diameter of 0.7 μm or more and a thickness of 0.07 μm or less; U.S. Pat. No. 4,435,501 discloses a technique of allowing silver salt to epitaxially deposit on the surface of tabular grains.

In tabular grains, the grain size is represented by diameter of a circle having the same area as a projected area of the grain, so-called equivalent circle diameter. The grain projected area can be calculated from the sum of grain areas through electron microscopic observation of silver halide crystal grains placed on a sample board so as not to be overlapped. The average grain diameter of tabular grains, which is represented by a mean value of equivalent circle diameters of the grains is preferably not less than 0.30 μm, more preferably 0.30 to 5 μm, and still more preferably 0.40 to 2 μm. Thus, tabular grains are magnified to 10,000 to 70,000 times by an electron microscope and the printed grain projected area is measured. The average grain diameter (ϕ) is determined by the following equation:

$$\text{Average grain diameter } (\phi)=(\Sigma n_i \phi_i)/n$$

where n is the number of measured grains and $n_i$ is a frequency of grains having a diameter of $\phi_i$. In the measurement, at least 1,000 grains are randomly selected.

The thickness of a silver halide grain can be determined by electron microscopic observation of the grain from the oblique direction. The thickness of tabular grains relating to this invention is preferably 0.01 to 1.0 μm, more preferably 0.01 to 0.1 μm, and optimally 0.01 to 0.07 μm. Further, the tabular silver halide grains relating to this invention preferably have a narrow thickness distribution. Thus, the width of grain thickness distribution, as defined below is preferably not more than 25%, and more preferably not more than 20%:

(standard deviation of thickness/average thickness)×100=width of grain thickness distribution (%).

Taking an aspect ratio and grain thickness into account, the tabularity (A), as defined below is preferably not less than 20:

$$A=ECD/b^2$$

where ECD is an average projected diameter (μm) and b is an average grain thickness. The average projected diameter is a number-averaged value of diameters of circles having an area equivalent to the grain projected area.

The tabular silver halide grains relating to this invention preferably have a narrow iodide content distribution. Thus, the halide content distribution among grains, as defined below is preferably not more than 25% and more preferably not more than 20%:

Width of halide content distribution=(standard deviation of halide content/average halide content)×100(%)

Silver halide grains used in this invention may be a core/shell type structure having at least two layer structures substantially differing in halide composition within the grain or have a homogeneous composition with the grain. The average iodide content of the silver halide emulsion relating to this invention is preferably not more than 20 mol % and more preferably 0.1 to 10 mol %.

In this invention, there may also be used so-called halide conversion type grains. The halide conversion amount is preferably 0.2 to 2.0 mol %, based on silver. The time for conversion may be during or after physical ripening. Halide conversion is performed by addition of an aqueous halide having a solubility product with silver or fine silver halide grains, which is less than that of halide composition on the grain surface prior to conversion. The size of the fine grains is preferably not more than 0.2 μm, and more preferably 0.02 to 0.1 μm.

Silver halide grains may be added with at least one metal ion selected from a cadmium salt, zinc salt, lead salt, thallium salt, iridium salt (including complex salts), rhodium salt (including complex salts) and iron salt (including complex salts) at the stage of nucleation or growth to allow these metal ions to be included in the interior or the surface of the grain.

Methionine Content of Gelatin

In the process of preparing silver halide emulsions relating to this invention, it is preferred to perform nucleation in the presence of gelatin having a methionine content of less than 30 μmol per g of the gelatin. Thus the preparation process of a silver halide emulsion comprising silver halide grains comprises the steps of nucleation of forming nucleus grains and grain growth of growing the nucleus grains to form final silver halide grains, wherein the nucleation is preferably performed in the presence of gelatin having a methionine content of less than 30 μmol/g. The methionine content is more preferably less than 20 μmol/g, and still more preferably 0.1 to 10 μmol/g. A low molecular weight gelatin is preferred, having a mean molecular weight of 5,000 to 70,000, more preferably 6,000 to 50,000, and still more preferably 7,000 to 30,000. To reduce the methionine content to less than 30 μmol/g, it is effective to subject alkali-processed gelatin to an oxidation treatment using oxidizing agents. Examples of oxidizing agents usable in the oxidation treatment of gelatin include hydrogen peroxide, ozone, peroxy-acid, halogen, thiosulfonic acid compounds, quinines and organic peracids. Of these is preferred hydrogen peroxide.

Silver halide emulsions relating to this invention may be subjected to desalting to remove soluble salts at the time of completion of grain growth, or may not be desalted. Desalting can be carried out in the manner, as described in Research Disclosure (hereinafter, also denoted simply as RD) No. 17643.

In this invention, at least two emulsion which were separately prepared may be blended at any proportion. Further, there may be used silver halide described in JP-A No. 2002-55410, paragraph No. 0054-0065 and JP-A No. 6-118593, paragraph No. 0060-0078.

Sensitization

Light sensitive silver halide emulsions are those which have been chemically sensitized. Chemical sensitization methods applicable to silver halide emulsions used in this invention include commonly known chalcogen sensitization such as sulfur sensitization, selenium sensitization and tellurium sensitization, novel metal sensitization using gold, platinum or palladium, reduction sensitization or the combination thereof, for example, as described in JP-A Nos. 3-110555 and 5-241267.

There are preferably used sulfur sensitizer and selenium sensitizer as a chalcogen sensitizer applicable to silver halide emulsions relating to this invention. Examples of the sulfur sensitizer include a thiosulfate, allylthiocarbamidothiourea, allylthioisocyanate, cystine, p-toluenethiosulfonate, rhodanine, and inorganic sulfur (simple substance of sulfur). The amount of the added sulfur sensitizer, depending on the kind of an emulsion or expected effects is preferably $5\times10^{-10}$ to $5\times10^{-5}$, and more preferably $5\times10^{-8}$ to $3\times10^{-5}$ mol per mol of silver halide.

There are used, as a gold sensitizer, various gold complexes as well as chloroauric acid and gold sulfide. Ligand compounds include dimethylrhodanine, thiocyanic acid, mercaptotetrazole and mercaptotriazole. The amount of an added gold sensitizer, depending on the kind of an emulsion, the kind of the compound and ripening conditions, is preferably $1\times10^{-8}$ to $1\times10^{-4}$, and more preferably $1\times10^{-8}$ to $1\times10^{-5}$ mol per mol of silver halide.

Chemical sensitization may be carried out in the presence of nitrogen containing heterocyclic compounds, for example, in accordance with the method described in JP-A No. 62-253159. Antifoggants described later may be added when completing chemical sensitization. Specifically, methods described in JP-A Nos. 5-45833 and 62-40446 are applicable thereto. The pH at the stage of chemical sensitization is preferably 5.3 to 10.5, and more preferably 5.5 to 8.5; the pAg is preferably 6.0 to 10.5, and more preferably 6.8 to 9.0.

The coating amount of silver halide used in this invention is within the range of 1 to 10 g/m$^2$ (stated as the equivalent quantity converted to silver).

In the preparation of silver halide relating to this invention, reduction sensitization may be applied in combination with foregoing chemical sensitization. Maintaining a silver halide emulsion in an optimal reducing atmosphere provides reduction sensitization nucleuses in the interior or on the surface of silver halide grains. Reduction sensitization is preferably conducted during the course of growing silver halide grains. A method for conducting the sensitization during the course of grain growth is not only applying reduction with growing grains but also interrupting grain growth and applying reduction sensitization, followed by growing the reduction-sensitized grains. Specifically, a reducing agent and/or water soluble silver salt are added to the silver halide emulsion.

Preferred examples of reducing agents include thiourea dioxide, ascorbic acid and their derivatives. Further thereto, preferred reducing agents include polyamines such as hydrazine and diethylenetriamine, dimethylamine borane, and sulfites. The amount of a reducing agent to be added is variable, depending on the kind of a reducing agent, grain size, composition and crystal habit of silver halide grains and environmental conditions such as temperature, pH and pAg of a reaction system. For example, thiourea dioxide of 0.01 to 2 mg per mol of silver halide is preferred; and ascorbic acid of 0.2 to 50 g per mol of silver halide is preferred. The reduction sensitization is carried out preferably at a temperature of 40 to 80° C., a pH of 5 to 11 and a pAg of 1 to 10 over a period of 10 to 200 min. Silver nitrate is preferably used as a water soluble silver salt. So-called silver ripening, as one means for the reduction sensitization is performed by adding the water soluble silver salt. The pAg during the silver ripening is preferably 1 to 6, and more preferably 2 to 4. The temperature, time and pH are within the range described above.

Action of a reducing agent added at an intended time during the course of grain formation can be deactivated by adding oxidizing agents such as hydrogen peroxide or its adducts, peroxo-acid salt, ozone, $I_2$, and thiophene to retard or stop the reduction sensitization. The oxidizing agents can be added at any time of from the start of silver halide grain formation to before adding gold sensitizer (or chemical sensitizer).

In order to allow light sensitive silver halide used in this invention to have spectral sensitivity (or color sensitivity), such as green-sensitivity and red-sensitivity, the light sensitive silver halide emulsion is spectrally sensitized with methine dyes or others. A blue-sensitive emulsion may optionally be subjected to spectral sensitization in the blue region. Usable dyes include, for example, cyanine dyes, merocyanine dyes, complex cyanine dyes, complex merocyanine dyes, holopolar cyanine dyes, hemicyanine dyes, styryl dyes and hemioxonol dyes. Specifically, dyes are exemplarily disclosed in U.S. Pat. No. 4,617,,257; JP-A Nos. 59-180550, 64-13546, 5-45828, and 5-45834. These dyes are used alone or in combination thereof. The combination of sensitizing dyes is often used for the purpose of supersensitization or adjustment of the spectral sensitivity wavelength. Dyes themselves not having spectral-sensitizing action or compounds not absorbing visible light and exhibiting supersensitization, so-called supersensitizers may also be contained, together with sensitizing dyes, in the emulsion (e.g., as described in U.S. Pat. No. 3,615,641 and JP-A No. 63-23145). Such supersensitizers may be added during, or before or after chemical ripening, or before or after nucleation of silver halide grains, as described in U.S. Pat. Nos. 4,183,756 and 4,225,666. These sensitizing dyes and supersensitizers may be added through solution in organic solvents such as methanol or in the form of a dispersion in gelatin or a surfactant solution. The amount to be added is within the range of $1\times10^{-8}$ to $1\times10^{-2}$ mol per mol of silver halide.

In one preferred embodiment of this invention, the tabular silver halide grains contain dislocation lines within the grain, and the dislocation lines are a non-iodide-gap type. The dislocation lines can be introduced by various methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, an iodide-containing fine grain emulsion is added, only an iodide solution is added, or an iodide ion releasing agent is employed, as disclosed in JP-A Nos. 63-2202938, 1-102547, 6-27564 and 6-11781. The foregoing commonly known methods are a method in which iodide ions are introduced during the grain growth to form a gap or misfit of crystal lattices, as described in JP-A NO. 6-27564.

As a result of studies by the inventors of this application, it was proved that in the process of preparing tabular grains having a relatively high aspect ratio, when iodide ions are introduced, forming dislocation lines by the produced iodide-gap, the aspect ratio was not increased and a high aspect ratio grain emulsion was not achieved. Herein forming dislocation lines by the iodide-gap means causing a gap or misfit of crystal lattices by allowing iodide ions to be included in the silver halide crystal, thereby forming dislocation lines. Although an attempt to overcome this problem was made by growing grains at a relatively low pBr, it was proved that problems arose that the variation coefficient of an equivalent circle diameter exceeded 30%, rendering it difficult to obtain a tabular grain emulsion having a relatively high aspect ratio and a high homogeneity of grain size distribution. In the invention, sensitization of a tabular grain emulsion having a high aspect ratio and a high homogeneity in grain size distribution was achieved by introduction of dislocation lines due to an iodide gap, i.e., non-iodide-gap type dislocation lines or by a sensitization means in place of the dislocation lines, such as introduction of a shallow electron trapping center, as described later.

In the invention, dislocation lines, which are introduced into silver halide grains by methods other than the above-described method in which a gap or misfit of crystal lattices is formed by allowing iodide ions to be included in the silver halide crystal are defined as non-iodide-gap type dislocation lines. Whether dislocation lines in tabular grains are produced due to the iodide gap or not can be discriminated by determining the presence or absence of a localization peak of the iodide ion in the dislocation line-forming portion, using the EPMA (Electron Probe Micro Analyzer) method.

In one preferred embodiment of the invention, at least 60% by number (preferably at least 70%, and more preferably at least 80% by number, including 100% by number) of the tabular grains that account for at least 80% of the total grain projected area, contain at least 10 dislocation lines in each edge of the grain. The number of the dislocation lines is preferably at least 30 lines and more preferably at least 50 lines.

To introduce non-iodide-gap type dislocation lines into silver halide, it is necessary to allow ions other than an iodide ion, complexes or compounds to be included in a silver halide lattice to form a misfit of the silver halide lattice. A preferred method thereof is doping a bulky organic compound. Herein, the expression, doping refers to allow ions other than silver and halide ions, atoms or compounds to be included in the silver halide crystal lattice and a doped ion, atom or compound is called a dopant. Preferred examples of the bulky organic compound include a pyrrole, pyrazolo, imidazole, triazole, tetrazole and their derivatives. These organic compounds may be included in the silver halide crystal lattice in the form of a deprotonated anion. Further, preferred examples of the bulky organic compound dopant include a furan, thiophene, pyrane, pyridine, 2,2'-bithiophene, 2,2'-bipyridine, 2,2':6',2"-terpyridine and their derivatives. Exemplary examples of these dopants include the compounds described in JP-A 2000-241924, which are denoted as "L" in Compound Nos. 7 to 9. The foregoing dopants may be included in a form of coordination bonding with metal ions other than a silver ion. The dopant is included preferably in an amount of $1\times10^{-6}$ to $5\times10^{-3}$ mol per mol of the total silver halide. The dopant can be incorporated through solution in a solvent. The dopant is incorporated preferably between 40 and 95% of the total silver amount (and more preferably between 50 and 90%) during the process of silver halide grain formation.

Selenium Sensitizer

In one preferred embodiment of this invention, a silver halide emulsion used in this invention comprises tabular silver halide grains having an average aspect ratio of at least 8, in which the average selenium content of total silver halide grains contained in the emulsion is $3.0\times10^{-8}$ to $5.0\times10^{-6}$ mol per grain. There are employed selenium compounds commonly known as a selenium sensitizer. Usually, adding a labile selenium compound or non-labile selenium compound, an emulsion is ripened at 40° C. or a higher temperature with stirring for a given time. There are used labile selenium compounds described in JP-B No. 44-15748 and 43-13489 and JP-A No. 4-25832 and 4-109240. Specific examples of the labile selenium compound include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides [e.g., bis(3-chloro-2,6-oxybenzoyl) selenide], selenophosphates, phosphineselenides and colloidal metallic selenium. In one preferred embodiment of the invention, selenium compounds are advantageously used. Non-labile selenium compounds described in JP-B No. 46-4553, 52-34491 and 52-34492 are used as a selenium sensitizer. Specific examples of the non-labile selenium compound include selenious acid, potassium selenocyanate, quaternary salts of selenazoles, selenide, dialkylselenide, 2-selenazolidinedione, 2-oxazolidinedione and their derivatives.

Specific examples of a preferred selenium sensitizer usable in this invention are shown below but are not limited to these.

Se-1

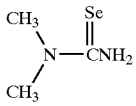

Se-2

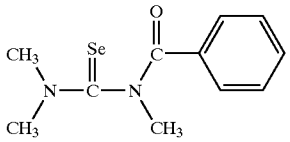

Se-3

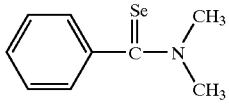

Se-4

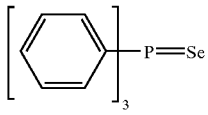

Se-5

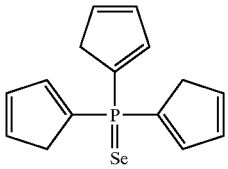

-continued

Se-6

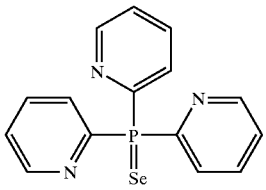

These selenium sensitizers are dissolved in water or an organic solvent such as methanol or ethanol, or a mixture thereof and added at the stage of chemical sensitization (preferably immediately before starting chemical sensitization), in the form described in JP-A 4-140738, 4-140742, 5-11381, 5-11385 and 5-11388, preferably in the form of a solid in water type suspension. The selenium or tellurium sensitizer is used alone or in combination of two or more sensitizers. A labile selenium compound and non-labile selenium compound may be used in combination. Alternatively, at least a selenium sensitizer and at least a tellurium sensitizer may be used in combination. The amount of a selenium or tellurium sensitizer to be added, depending on activity of the sensitizer, the kind or grain size of silver halide, and ripening temperature or time, is preferably not less than $1\times10^{-8}$ mol, and more preferably $1\times10^{7}$ to $1\times10^{-5}$ mol per mol of silver halide. The temperature for chemical sensitization using selenium sensitizers is preferably 45° C. or higher, and more preferably 50 to 80° C. Selenium sensitization in the presence of a silver halide solvent results in further enhanced effects.

Noble metal salts such as gold, platinum, palladium and iridium are preferably used, as a sensitizer, in combination, as described in Research Disclosure (hereinafter, also denoted as RD) vol. 307, item 307105. Specifically, the combined use of a gold sensitizer is preferred. Preferred examples of the gold sensitizer include chloroauric acid, gold thiosulfate, gold thiocyanate and organic gold compounds described in U.S. Pat. No. 2,597,856 and 5,049,485; JP-B No. 44-15748; JP-A No. 1-147537 and 4-70650. Further, in the case of sensitization using a gold complex salt, thiosulfates, thiocyanates or thioethers are preferably used as an auxiliary agent, and the use of a thiocyanate is specifically preferred.

Oxidation-Type Inhibitor/Disulfide Compound

In one preferred embodiment of this invention, the photographic material relating to this invention at least one light-sensitive layer comprising a silver halide emulsion grains, wherein the light-sensitive layer comprises tabular silver halide grains having an average aspect ratio of at least 8 and a compound represented by the following formula (1):

$$R_1—(S)_m—R_2 \qquad \text{formula (1)}$$

wherein $R_1$ and $R_2$ are each an aliphatic group, aromatic group, heterocyclic group, or $R_1$ and $R_2$ combine with each other to form a ring when $R_1$ and $R_2$ are aliphatic groups; and m is an integer of 2 to 6.

In the formula, an aliphatic group represented by $R_1$ and $R_2$ include a straight chain or branched alkyl group having 1 to 30 carbon atoms (and preferably 1 to 20 carbon atoms), alkenyl group, alkynyl group and cycloalkyl group, such as methyl, ethyl, propyl, butyl, hexyl, decyl, dodecyl, isopropyl, t-butyl, 2-ethylhexyl, allyl, 2-butenyl, 7-octenyl, propargyl, 2-butynyl, cyclopropyl, cyclopentyl, cyclohexyl, and cyclododecyl. An aromatic group represented by $R_1$ and $R_2$ include one having 6 to 20 carbon atoms, such as phenyl, naphthyl and anthranyl. A heterocyclic group represented by $R_1$ and $R_2$ may be monocyclic or a condensed ring, including 5- or 6-membered heterocyclic group containing at least one of O, S and N atoms and an amine-oxide group. Examples thereof include pyrrolidine, piperidine, tetrahydrofuran, tetrahydropyran, oxirane, morpholine, thiomorpholine, thiopyrane, tetrahydrothiophene, pyrrole, pyridine, furan, thiophene, imidazole, pyrazolo, oxazole, thiazole, isooxazole, isothiazole, riazole, tetrazole, thiadiazole, oxadiazole, and groups derived from their benzelogs. Rings formed by combining $R_1$ and $R_2$ include 4- to 7-membered rings and 5- to 7-membered rings are preferred. The group represented by $R_1$ and $R_2$ is preferably an aromatic group or a heterocyclic group, and more preferably a heterocyclic group. The aliphatic group, aromatic group or heterocyclic group represented by $R_1$ and $R_2$ may be substituted with a substituent group. Examples of such a substituent group include a halogen atom (e.g., chlorine atom, bromine atom), alkyl group (e.g., methyl ethyl, isopropyl, hydroxyethyl, methoxyethyl, trifluoromethyl, t-butyl), cycloalkyl group (e.g., cyclopentyl, cyclohexyl), aralkyl group (e.g., benzyl, 2-phenethyl), aryl group (e.g., phenyl, naphthyl, p-tolyl, p-chlorophenyl), alkoxy group (e.g., methoxy, ethoxy, isoproxy, butoxy), aryloxy group (e.g., phenoxy, 4-methoxyphenoxy), alkylthio group (e.g., methylthio, ethylthio, butylthio), arylthio group (e.g., phenylthio, p-methylphenylthio), sulfonylamino group (e.g., methanesulfonylamino, benzenesulfonylamino), ureido group (e.g., 3-methylureido, 3,3-dimethylureido, 1,3-dimetylureido), sulfamoylamino group (e.g., dimethylsulfamoylamino, diethylsulfamoylamino), carbamoyl group (e.g., methylcarbamoyl, ethylcarbamoyl, dimethylcarbamoyl), sulfamoyl group (e.g., ethylsufamoyl, dimethylsufamoyl), alkoxycarbonyl group (e.g., methoxycarbonyl, ethoxycarbonyl), aryloxycarbonyl group (e.g., phenoxycarbonyl, p-chlorophenoxycarbonyl), sulfonyl group (e.g., methanesulfonyl, butanesulfonyl, phenylsulfinyl), acyl group (e.g., acetyl, propanoyl, butyloyl), amino group (e.g., methylamino, ethylamino, dimethylamino), hydroxy group, nitro group, nitroso group, aminoxide group (e.g., pyridine-oxide), imido group (e.g., phthalimido), disulfide group (e.g., benzene-disulfide, benzothiazolyl-2-disulfide), and heterocyclic group (pyridyl, benzimidazolyl, benzthiazolyl, benzoxazolyl). Of these are specifically preferred groups having an electron-withdrawing group. R1 and R2 may contain one or more substituent groups described above. These substituent groups may be further substituted; and m is an integer of 2 to 6 and preferably 2 or 3.

Specific examples of the compound represented by formula (1) are shown below bur are not limited to these.

1-1

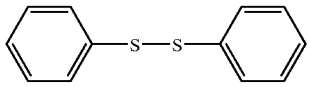

1-2

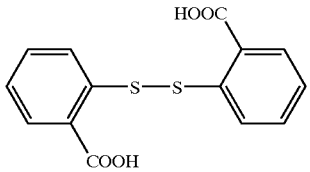

-continued 1-3

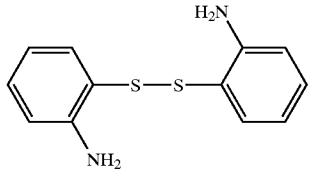

1-4

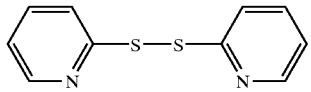

1-5

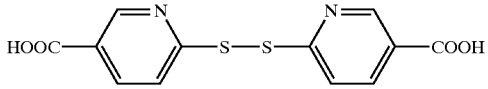

1-6

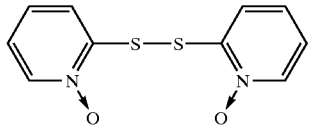

1-7

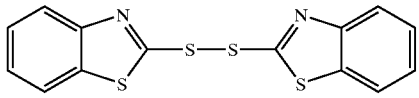

1-8

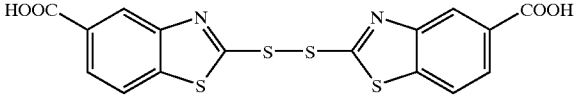

1-9

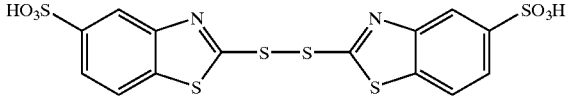

1-10

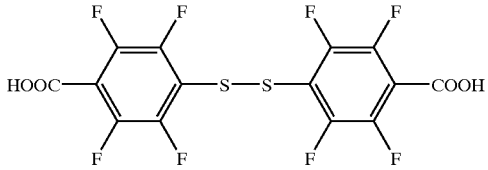

1-11

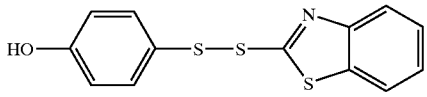

1-12

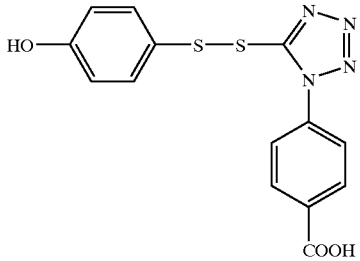

1-13

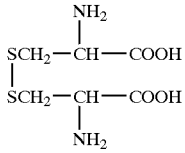

-continued 1-14

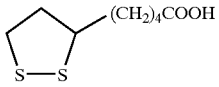

1-15

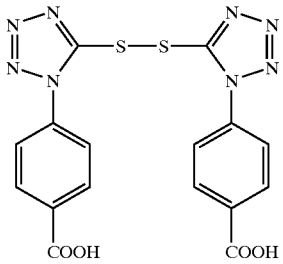

1-16

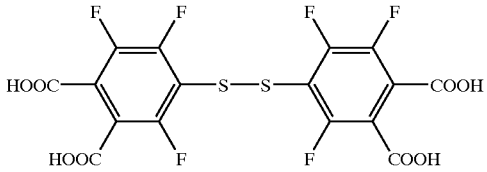

1-17

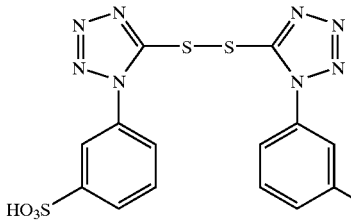

1-18

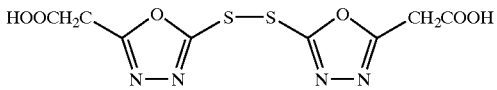

1-19

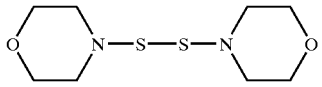

1-20

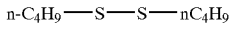

1-21

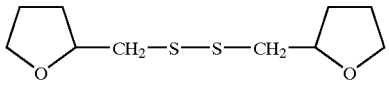

1-22

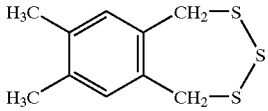

1-23

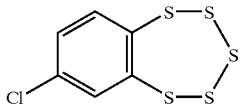

1-24

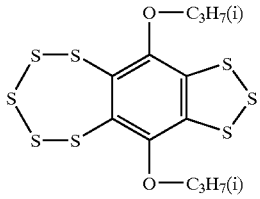

-continued 1-25

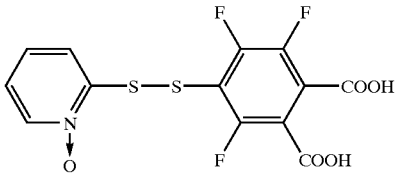

1-26

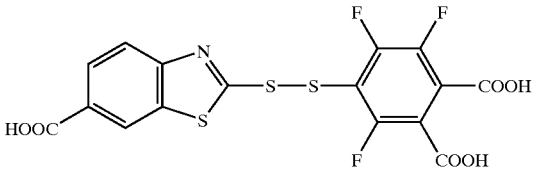

1-27

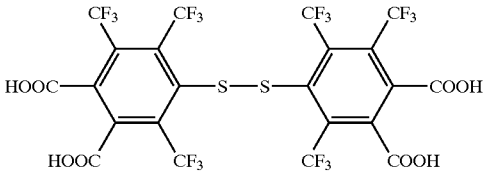

1-28

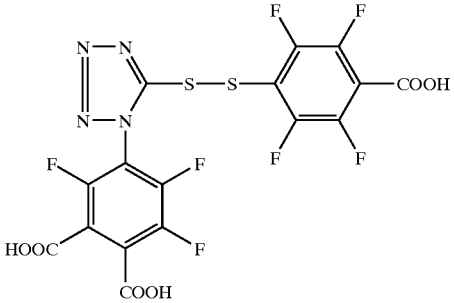

1-29

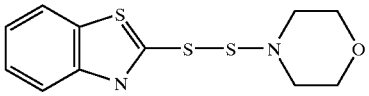

1-30

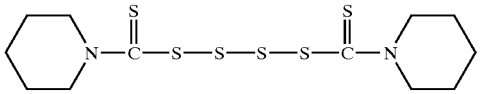

The compounds represented by formula (1) can be synthesized according to methods known in the art.

The compound of formula (1) may be added at any stage during the course of preparing silver halide emulsions or at any stage from after completion of emulsion preparation to immediately before coating, and the compound is preferably added after completion of chemical ripening and before coating. The compound of. formula (1) is incorporated in an amount of $1\times10^{-8}$ to 1 mol, and more preferably $1\times10^{-6}$ to 0.3 mol/mol Ag.

Two-Electron Donor

In one preferred embodiment of the invention, the silver halide photographic material comprises at least one light-sensitive layer containing a silver halide grain emulsion, in which the silver halide emulsion comprises tabular grains having an average aspect ratio of at least 8 and a compound capable of permitting injection of at least two electrons into silver halide via photoexcitation by a single photon. Thus, this compound has a function of permitting injection of at least two electrons into silver halide through photoexcitation caused by absorption of a single photon. In conventional photographic emulsions, a sensitizing dye is excited through excitation by absorption of a single photon, whereby a single electron is injected into the conduction band of silver halide, forming an oxidized sensitizing dye. It is supposed that repeating this process forms a developable, stable center, called a latent image. Even in an emulsion containing no sensitizing dye, similarly, excitation by a single photon forms a single electron in the conduction band and a positive hole is concurrently formed in the valence band. After having injected a single electron into the conduction band of silver halide through excitation by a single photon, the above-described compound exhibits the function of reacting with the oxidized sensitizing dye or the hole in the valence band to inject one more electron into the conduction band of silver halide. In addition to doubling the number of electrons obtained by one photon, the compound contributes to an enhancement in sensitivity of the photographic emulsion by minimizing the loss process due to recombination of the formed electron with the oxidized dye or a positive hole. The function and reaction mechanism of the compound are detailed in Nature, 402, page 865 (1999); and J. Am. Chem. Soc., vol. 122, page 11934 (2000).

The foregoing compound capable of permitting injection of at least two electrons into silver halide via photoexcitation by a single photon preferably is an organic compound capable of forming a cation having a valence of (m+n), i.e., an (m+n)-valent cation, from a cation radical having a valence of n (i.e., an n-valent cation radical) with an intramolecular cyclization reaction, in which n and m each represent an integer of 1 or more. Specifically, n and m preferably are each 1 and an organic compound forming a bivalent cation with an intramolecular cyclization reaction is more preferred.

The following compound, for example, forms a bivalent cation, thereby donating two electrons according to the following reaction scheme:

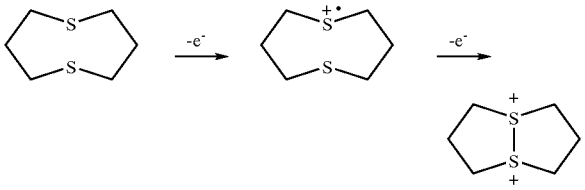

The intramolecular cyclization reaction preferably is a reaction accompanied with bridged ring formation.

The organic compound capable of forming a (m+n)-valent cation from an n-valent cation radical with an intramolecular cyclization reaction is preferably a compound represented by the following formula (2), (3) or (4):

$$A^1—X^1—B^1—X^2—A^2 \qquad \text{formula (2)}$$

wherein $X^1$ and $X^2$ are each independently N atom, P atom, S atom, Se atom or Te atom; $A^1$ and $A^2$ are each independently a substituent; and $B^1$ is a bivalent linkage group;

formula (3)

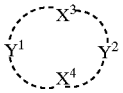

wherein $X^3$ and $X^4$ are each independently N atom, P atom, S atom, Se atom or Te atom; $Y^1$ and $Y^2$ are each an atomic group necessary to form together with $X^3$ or $X^4$ a 6- to 12-membered ring, and in the ring formed by $X^3$, $X^4$, $Y^1$ and $Y^2$, ring-forming atoms other than $X^3$ and $X^4$ are preferably carbon atoms;

$$(Z—)_{k1}—[—(—L—)_{k3}—X]_{k2} \qquad \text{formula (4)}$$

wherein Z is an adsorption group onto silver halide (or group promoting adsorption onto silver halide grains) or light absorbing group; L is a bivalent linkage group; X is a group having a moiety structure of the compound capable of forming a (m+n)-valent cation from an n-valent cation radical with an intramolecular cyclization reaction, group having a moiety structure of formula (1) or a group having a moiety structure of formula (2): k1 is an integer of 1 through 4, k2 is an integer of 1 through 4, and k3 is 0 or 1.

The light absorbing group, represented by "Z" of formula (4) can be synthesized in accordance with methods described in F. M. Hamer "Heterocyclic Compounds-Cyanine Dyes and Related Compounds", (John Wirey & Sons, New York, 1964); D. M. Sturmer, Heterocyclic Compounds-Special Topics in Heterocyclic Chemistry", chapter 18, sect. 14, pages 482–515 (John Wiley & Sons, New York and London, 1977); "Rodd's Chemistry of carbon Compounds" 2nd Ed. vol. IV, part B, 1977, pages 369–422 (Elsevier Science Publishing Co. Inc., New York). The adsorption group onto silver halide, represented by Z of formula (3) can also be synthesized in accordance with methods described in U.S. Pat. No. 5,538,843, page 16, line 37 to page 17, line 29.

A linkage forming reaction of the linkage group represented by $B^1$ of formula (2) or by L of formula (4) can be accomplished employing methods commonly known in organic chemistry, i.e., bond forming reaction such as an amide bond forming reaction and ester bond forming reaction. These synthesis reactions are referred to "SHIN JIKKEN KAGAKU KOHZA No. 14, Synthesis and Reaction of Organic Compounds" vol. I to V (Maruzen, Tokyo, 1977), Y. Ogata "YUKIHANNORON" (MARUZEN, TOKYO, 1962); L. F. Fieser, M. Fieser, Advanced Organic Chemistry (Maruzen, Tokyo, 1962).

The light absorbing group represented by "Z" of formula (4) may be any methine dye, and preferred examples thereof include a cyanine dye, merocyanine dye, rhodacyanine dye, three-nucleus merocyanine dye, holopolar dye, hemicyanine dye and styryl dye.

The adsorption group onto silver halide, represented by "Z" of formula (4) may be anyone and preferably contains at least one of nitrogen, sulfur, phosphorus, selenium and tellurium atoms. The adsorption group onto silver halide may be a silver ligand, which is capable of coordinating with a silver ion on the silver halide grain surface or a cationic surfactant. Examples of the silver ligand include a sulfur acid and selenium or tellurium analogs (which is analogous to the sulfur acid), nitrogen acid, thioester and selenium or tellurium analogs (which is analogous to the thioester), phosphorus, thioamido, selenaamide, telluruamide and carbon acid. The foregoing acid compounds are preferably those exhibiting an acid dissociation constant (pKa) of 5 to 14. More preferably, the silver ligand promotes adsorption of the compound represented by formula (3) onto silver halide. The sulfur acid is preferably a mercaptan or thiol, which can form together with a silver ion a double salt. A thiol having a stable C—S bond is used as an adsorption group onto silver halide, nit as a ion precursor (see, "The Theory of the Photographic Process" page 32–34 (1977). There are used saturated or unsaturated alkyl- or arylthiol and selenium or tellurium analogs, having a structure of R"—SH or R""—SH, in which R" represents an aliphatic group, aromatic group or heterocyclic group (which is a preferably substituted by a group including a halogen, oxygen, sulfur or nitrogen atom); R"" represents an alphatic group, aromatic group or heterocyclic group. R""—SH may be substituted by a sulfonyl group, in which R""—SH represents a thiosulfonic acid group.

Preferred examples of the adsorption group, represented by "Z" of formula 4) are shown below, but are by no means limited to these.

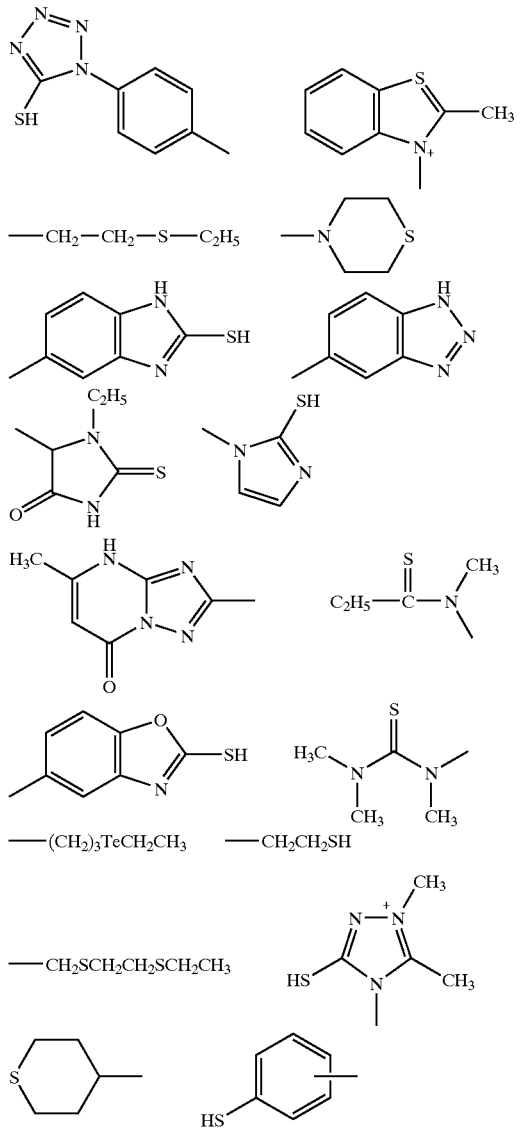

The $B^1$ of formula (2) or the L of formula (4) represents a bivalent linkage group. The linkage group preferably is comprised of an atom or an atomic group including at least one selected from carbon, nitrogen, sulfur and oxygen atoms. The linkage group is preferably a 1 to 20 carbon bivalent linkage group comprised of one selected from an alkylene group (e.g., methylene, ethylene, propylene, butylenes, pentylene), arylene group (e.g., phenylene, naphthylene), alkenylene group (e.g., ethenylene, propenylene), alkynylene (e.g. ethynylene, propynylene), amido group, ester group, sulfoamido group, sulfonic acid ester group, ureido group, sulfonyl group, sulfinyl group, thio-ether group, ether group, carbonyl group, —N(Ra)— (in which Ra represents a hydrogen atom, a substituted or unsubstituted alkyl group or a substituted or unsubstituted aryl group), and bivalent heterocyclic group (e.g., 6-chloro-1,3,5-triazine-2,4-di-yl, pyridine-2,4-di-yl, quinoxaline-2,3-di-yl), or the combination thereof. The linkage group is more preferably one selected from a 1 to 10 carbon bivalent linkage group comprised of one selected from an alkylene group having 1 to 4 carbon atoms (e.g., methylene, ethylene, propylene, butylenes), arylene group having 6 to 10 carbon atoms (e.g., phenylene, naphthylene), alkenylene group having 1 to 4 carbon atoms (e.g., ethenylene, propenylene) and and alkynylene having 1 to 4 carbon atoms (e.g. ethynylene, propynylene) and the combination thereof. Exemplarily, the following linkage groups are preferred:

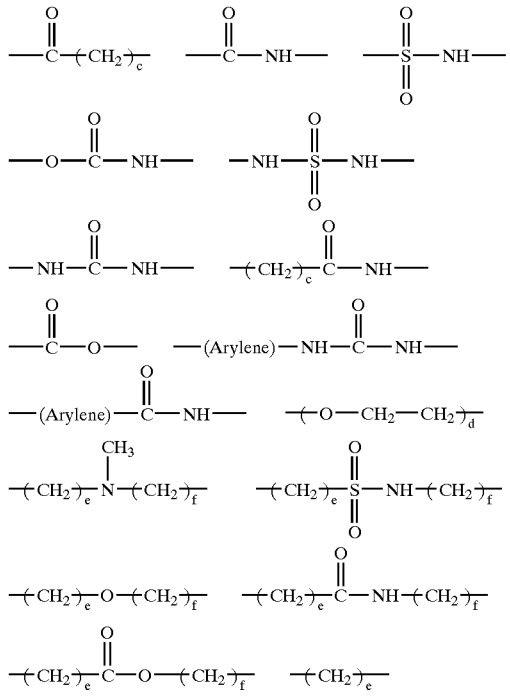

where subscript, "c" is an integer of 1 to 30 (preferably 3 to 10), "d" is an integer of 1 to 10 (preferably 3 to 10); "e" and "f" are each an integer of 1 to 30, provided that the sum of "e" and "f" are not more than 30.

In formula (2), $A^1$ and $A^2$ each independently represent a substituent group. Examples thereof include a halogen atom, a mercapto group,, cyano group, carboxyl group, phosphoric acid group, sulfo group, hydroxy group, carbamoyl group, sulfamoyl group, nitro group,, alkoxy group, aryloxy group, acyl group, acyloxy group, acylamino group, sulfonyl group, sulfinyl group, amino group, substituted amino group, ammonium group, hydrazine group, ureido group, imido group, arylthio group, alkoxycarbonyl group, aryloxycarbonyl group, substituted or unsubstituted alkyl group, cycloalkyl group, unsaturated hydrocarbon group, substituted or unsubstituted aryl group, and heterocyclic group.

The compounds used in the invention, represented by formulas (2), (3) and (4) can be readily synthesized in accordance with methods described in J. Org. Chem. 48, 21, 1983, 3707–3712; J. Heterocycle. Chem. 28, 3, 1991, 573–575; Tetrahedron, 49, 20, 1993, 4355–4364; and Chemlett. 12, 1990, 2217–2220. The compounds represented by formula (1), (2), and (3) may be used alone but are preferably used in combination with spectral sensitizing dyes.

Exemplary examples of the compounds used in the invention, represented by formulas (2), (3) and (4) are shown below but are by no means limited to these.

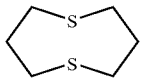
T-1
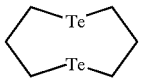
T-2
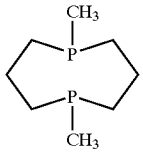
T-3
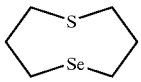
T-4
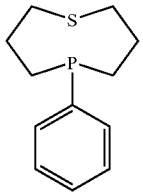
T-5
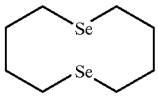
T-6
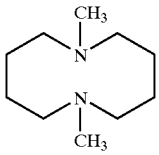
T-7
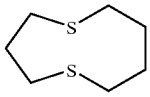
T-8
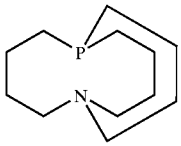
T-9
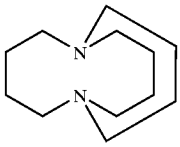
T-10
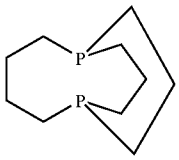
T-11
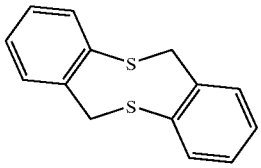
T-12
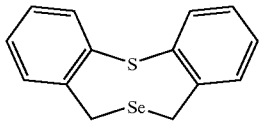
T-13
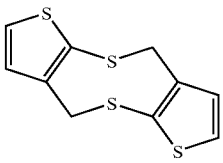
T-14
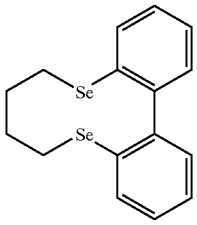
T-15
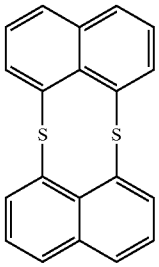
T-16

-continued
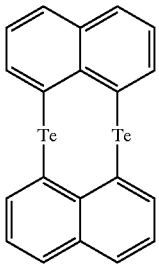
T-17
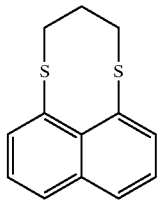
T-18
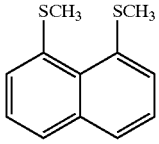
T-19
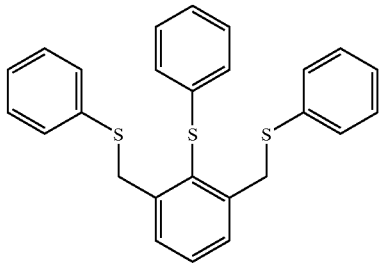
T-20
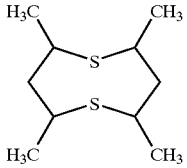
T-21
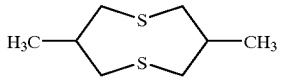
T-22
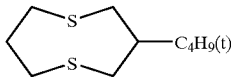
T-23
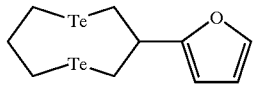
T-24
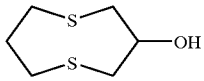
T-25
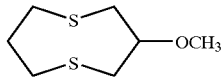
T-26
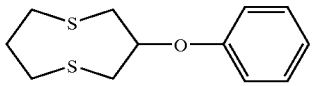
T-27
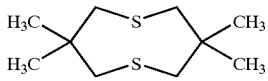
T-28
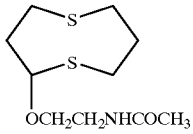
T-29
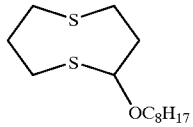
T-30
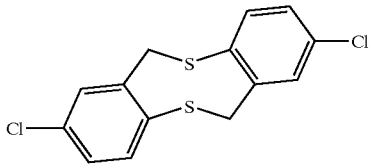
T-31
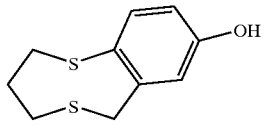
T-32
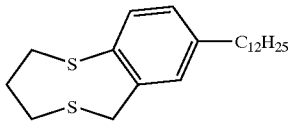
T-33
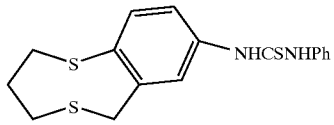
T-34

-continued
T-35
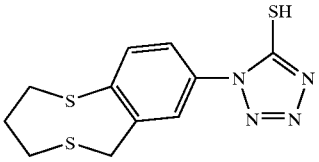
T-36
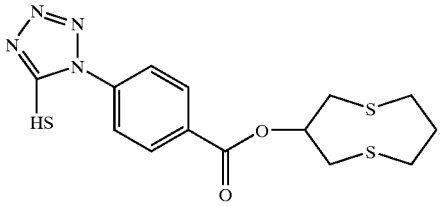
T-37
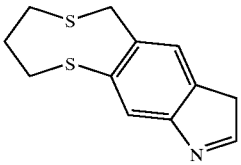
T-38
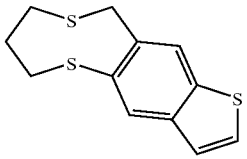
T-39
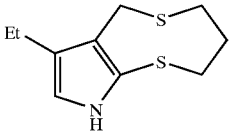
T-40
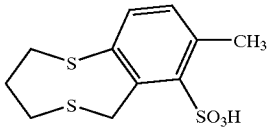
T-41
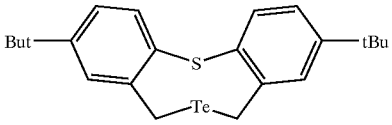
T-42
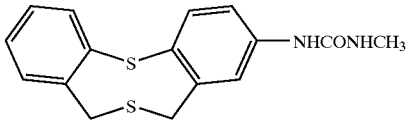
T-43
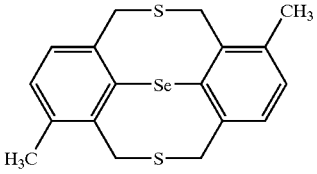
T-44
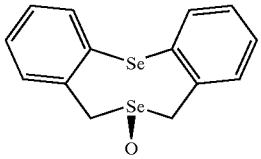
T-45
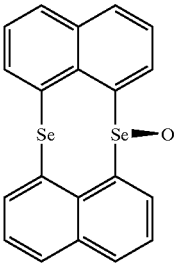
T-46
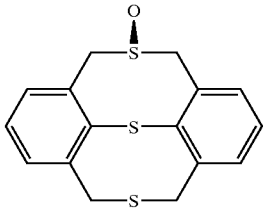
T-47
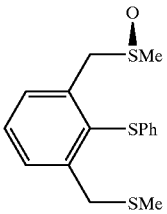
T-48
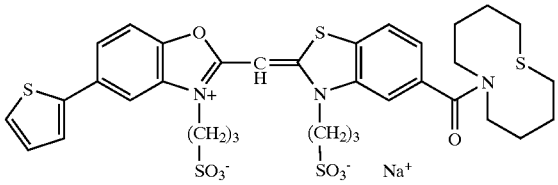
T-49
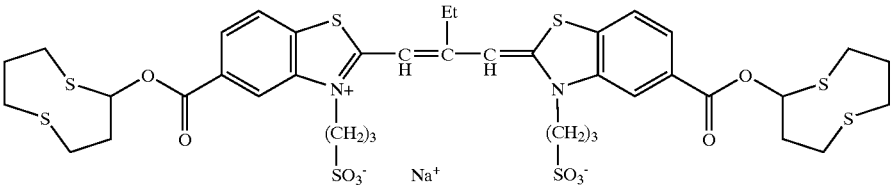

-continued

T-50

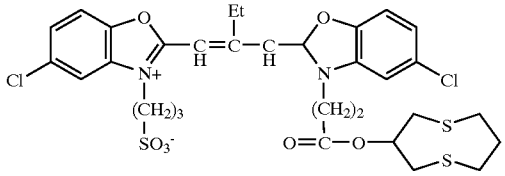

T-51

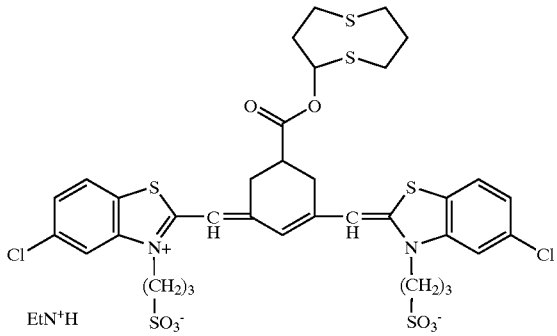

T-52

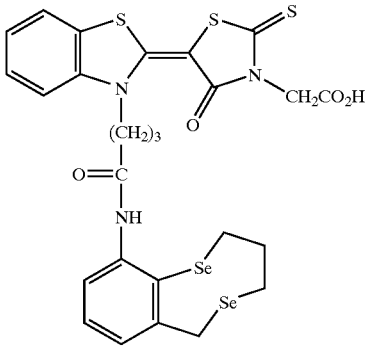

T-53

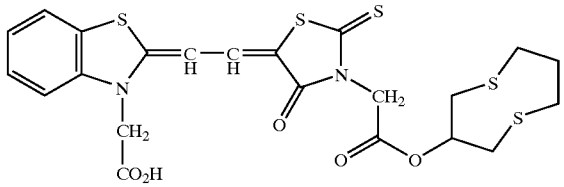

T-54

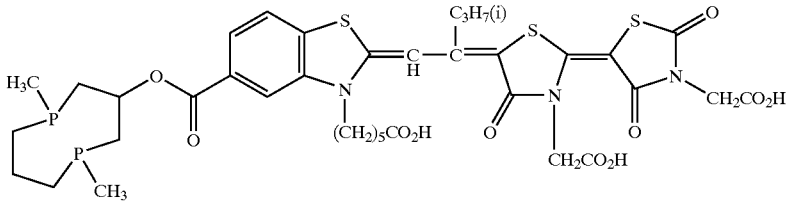

The compounds represented by formulas (2), (3) and (4) can be incorporated into silver halide emulsions or photographic materials, alone or in combination with other addenda. The compounds may be added to a silver halide emulsion at any stage of emulsion making. As described in U.S. Pat. Nos. 2,735,766, 3,628,960, 4,183,756, 4,225,666; JP-A Nos. 58-184142, and 60-196749, for example, the compound may be added during formation of silver halide grains, before, during desalting, or after desalting and before starting chemical ripening, as described in JP-A No. 58-113920, immediately before or during chemical ripening, or after chemical ripening and before emulsion coating. As described in U.S. Pat. No. 4,225,666 and JP-A No. 58-7629, The compound, alone or in combination with a compound different in structure, may be fractionally added, for example, during the stage of grain formation and during the stage of or after completion of chemical ripening, or before or during chemical ripening and after chemical ripening. The compound is added preferably after completion of spectral sensitization and chemical sensitization, and before addition of a stabilizer.

The organic compound capable of forming a (m+n)-valent cation from an n-valent cation radical with an intramolecular cyclization reaction may be incorporated in any amount. In case of the compound having no adsorption group onto silver halide, the amount is preferably $10^{-5}$ to $10^{-1}$ mol per mol of silver halide; and in case of the compound having adsorption group onto silver halide, the amount is preferably $10^{-6}$ to $10^{-2}$ mol per mol of silver halide.

In the color image forming method of this invention, the photographic material is heated at a temperature of 43 to 180° C. A temperature higher than 180° C. exceeds the hear resistance temperature of the photographic material containing organic compounds, producing troubles such as melting of a layer or bleeding of image. The temperature preferably is 50 to 160° C.

The ISO speed defined in this invention is determined in accordance with American National Standard (ANSI) PH2.27 "Determination of ISO Speed of Color Negative Film used in Still Photograph". Silver halide color photographic materials usually differ in image quality, depending on color developing conditions (e.g., chemical composition and pH of the processing solution used, temperature, time, stirring condition, exhaustion state, etc.) and also vary in absolute value of the ISO speed. In this invention, the photographic material and the processing applied thereto are regarded as a set and the ISO speed can be determined from sensitometry in each set (curve comprised of abscissa as the exposure H and ordinate as the density D), in accordance with descriptions of the above-described PH2.27. The higher ISO speed results in enhanced effects of this invention. In this invention, a photographic material exhibiting an ISO speed of 250 or more is preferred and a photographic material exhibiting an ISO speed of 800 or more is specifically preferred.

In one preferred embodiment of this invention, at least 80% of the total grain projected area is accounted for by tabular silver halide grains having an average overall surface iodide content of 5 to 15 mol % and an average surface iodide content of less than 3 mol % (including 0 mol %) in the vicinity of corners of the grain, and the tabular grains each having at least 10 dislocation lines in the fringe portion of the grain. It is contemplated that such a characteristic surface composition of the emulsion grains used in the invention strengthens adsorption of a sensitizing dye onto the major faces of the tabular grains, thereby enhancing light absorption efficiency and prevents dispersion of latent images by allowing chemical sensitizing nucleuses to be localized in the vicinity of the corners, contributing to enhancing sensitivity and improving image quality. It is well known in the art that enhancing the surface iodide content strengthens adsorption of a sensitizing dye.

To precisely determine the distribution of the surface iodide content in the major face of tabular grains, analysis means having high resolution is needed to apply. The most preferred analysis method usable in the invention is TOF-SIMS (Time of Flight-Scattering Ion Mass Spectroscopy). Exemplarily, according to the method described in JP-A 2000-112049, the average surface iodide content of silver halide grains can be determined by the TOF-SIMS. The surface iodide content within the major face of the grain (which is a central portion in the major face and does not include regions in the vicinity of (or near) corners) is measured with respect to at least 200 grains, and a number-average value thereof is defined as the average surface iodide content. In this invention, the average surface iodide content of tabular grains preferably is 5 to 15 mol % and more preferably 7 to,13 mol %.

In a silver halide emulsion of this invention, at least 50% by number of the total silver halide grains preferably is accounted for by tabular grains meeting the following requirement:

$I_1 > I_2$ where $I_1$ is an average surface iodide content of the major faces (or major face portions) and $I_2$ is an average surface iodide content of side faces (or side face portions). Herein, the surface iodide content refers to an iodide content of a silver halide phase in a depth of 50 A from the surface. The average surface iodide content is an average value of iodide contents that are determined at least 5 regular distance intervals of at least 5 on the surface.

The iodide content of the outermost surface layer in the major face portion, or in the side face portion can be determined in accordance with the following procedure. Tabular silver halide grains are taken out of a silver halide emulsion through gelatin degradation with proteinase, enclosed with methacrylic resin and then continuously sliced at a thickness of ca. 500 A, using a diamond cutter. From observation of a slice exhibiting the intersection vertical to two parallel major faces of the tabular grain, a silver halide phase parallel to the major face and to a depth of 50 A from the surface is denoted as the major face portion and among the outermost surface layer, the portion other than the major face portion is denoted as a side face portion. The iodide content of the major face and side face portions is determined through spot analysis by the commonly known EPMA method at a spot diameter of not more than 50 A, and preferably not more than 20 A. Tabular grains meeting the requirement of $I_1 > I_2$ preferably account for at least 60% (more preferably at least 70%) by number of the grains.

In one preferred embodiment of the invention, the photographic material comprising at least three light-sensitive layers, wherein at least one light-sensitive layer of the three light-sensitive layers further comprises plural light-sensitive sub-layers having the same color-sensitivity and differing in speed, and of the plural light-sensitive sub-layers, the sub-layer having the highest speed comprises tabular silver halide grains having an average aspect ratio of at least 8 Preferably at least 10) and the sublayer having the lowest speed comprises silver halide regular crystal grains containing at least 10 (preferably at least 20, and more preferably at least 30) dislocation lines within the grain. In a specific example of the embodiment of the invention, the photographic material comprises at least a red-sensitive layer, at least a green-sensitive layer, and at least a blue-sensitive layer, wherein at least one of the rd-sensitive, green-sensitive and blue-sensitive layers are further comprised of plural layers differing in speed, for example, a high-speed layer, an intermediate-speed layer and a low-speed layer, wherein the high-speed layer comprises tabular silver halide grains having an average aspect ratio of at least 8 and the low-speed layer comprises silver halide regular crystal grains containing at least 10.

The regions in the vicinity (or neighborhood) of corners of the tabular grain is a region including a corner and divided by a plane vertical to the line connecting the center of the major face and the corner of the tabular grain, at a length of 1/10 of the line from the corner. Thus, when a line is drawn connecting the center of the major face and each of the corners, the region near the corner is a region including the corner and divided by a plane vertical to the line at the position of 1/10 of the line length from the corner. In cases where the corner is rounded, the corner is defined as a point nearest to the intersection of two tangential lines to the adjacent corners. In the invention, the iodide content in the region near the corner can be determined by analysis by TOF-SIMS.

Means for controlling a surface iodide content in the vicinity of corners of the tabular grain at less than 3 mol % include, for example, a method in which host grains having major faces having a surface iodide content of 5 to 15 mol % are formed and once grain corners are dissolved, the corners are allowed to grow at a relatively low iodide ion concentration. The grain corners are dissolved preferably in such a manner that ripening is conducted in the presence of ammonia at a pH of more than 8.0 and preferably more than 9.0 or at a pBr of less than 1.2 and preferably less than 1.0.

In one preferred embodiment of this invention, the silver halide emulsion is prepared by a process comprising forming nucleus grains by mixing a silver salt and a halide salt (or nucleation) and growing the nucleus grains (or grain growth), wherein the nucleation is performed at a temperature of less than 30° C., and preferably less than 21° C. Nucleation at a temperature of less than 10° C. causes unfavorable coagulation of gelatin. Ripening and growing of the silver halide emulsion grains is preferably performed at a temperature of 30 to 90° C., and more preferably 40 to 80° C. Ripening is preferably performed at a pH of 7.0 to 11.0, and more preferably 8.5 to 10.0.

In the manufacture of silver halide emulsions relating to this invention, a concentration operation is preferably conducted by means of ultrafiltration at the stage of at least a part of the grain growth process. Specifically, preparation of a silver halide emulsion comprising tabular grains having a relatively high aspect ratio is performed preferably in a diluted environment so that application of the ultrafiltration is preferred to enhance the manufacturing efficiency. When conducting concentration of silver halide emulsion by ultrafiltration in the process of preparation of silver halide emulsion relating to the invention, a manufacturing installation of silver halide emulsions described in JP-A 10-339923 is preferably employed.

The concentration mechanism is connected via pipes to the reaction vessel, in which the reaction mixture solution can be circulated at an intended rate between the reaction vessel and the concentration mechanism by means of a circulation mechanism such as a pump. The facility may further be installed with an apparatus for detecting the volume of a salt containing solution extracted from the reaction mixture solution through the concentration mechanism, having a mechanism capable of controlling the volume at the intended level. There can optionally be provided other function(s).

The concentration by means of ultrafiltration is applied in the form of the following (1) or (2), or their combination:

(1) using the concentration mechanism described above, the volume of a reaction mixture solution is reduced during the process of forming silver halide grains;

(2) using the concentration mechanism described above, an aqueous solution containing soluble material is removed during the process of forming silver halide grains, in an amount equivalent to or less than that of solution added for silver halide grain formation to maintain the reaction mixture solution at a substantially constant level or to restrain an increase of the reaction solution volume.

It is preferred to reduce the reaction solution volume by the foregoing method (1) prior to introducing dislocation lines to enhance the proportion of grains containing dislocation lines.

Further, in one preferred embodiment of the emulsion according to the invention, tabular grains contained in the emulsion each have an epitaxially grown silver halide phase (hereinafter, also denoted as an epitaxial growth phase), which is preferably located in the vicinity of corners of the grains. Epitaxial growth emulsions are described in U.S. Pat. Nos. 4,435,501 and 4,471,050; JP-A Nos. 8-69069, 9-211762 and 9-211763. In the invention, there may be or may not be used a compound capable of causing the epitaxial growth phase to be localized in the vicinity of corners of the grain, i.e., a site director. In cases where no site director is used, the restriction of the growing site can be achieved by lowering the iodide content in the vicinity of corners of the grain, prior to epitaxial growth. In addition to a means for lowering the iodide content in the vicinity of the grain surface, commonly known site directors such as sensitizing dyes and aminoazaindenes may in addition be used. In the epitaxial emulsion used in the invention, it is preferred to limit silver halide epitaxy to less than 30 mol %, and more preferably from 0.3 to 20 mol % of total silver. Silver halide epitaxy of 0.5 to 15 mol % is suitable for sensitization. The epitaxial growth phase preferably contains at least 50 mol % chloride, more preferably at least 70 mol % chloride, and still more preferably at least 90 mol % chloride.

The average diameter (in $\mu$m) of dye-clouds formed after developing, as defined in this invention can be determined by microscopic observation using a high power optical microscope. The dye-clouds are observed from the direction vertical to the support of the developed photographic material. The diameter of a dye-cloud (expressed in $\mu$m) is defined as an equivalent circle diameter of the projected area of the dye-cloud, i.e., the diameter of a circle having an area equivalent to the projected area of the dye-cloud. At least 500 dye-clouds are observed and a mean value of diameters obtained from the observation is defined as an average diameter ($\mu$m). The minimum color density (also denoted as Dmin) in this invention refers to the lowest color density in the low exposure region in sensitometry of the ISO speed determination. The transmission density of the minimum color density plus 0.1 refers to a density higher by 0.1 than the foregoing Dmin. One feature of this invention is that the average diameter of dye-clouds forming this transmission density in the photographic material is not less than 3.0 $\mu$m and not more than 20.0 $\mu$m. The average diameter is preferably 6.0 to 20.0 $\mu$m. Forming dye-clouds of an average diameter more than 20 $\mu$m results in excessively thick layer, leading to serious troubles, such as cracks on the film surface caused in transportation during photographing and processing.

The amount of the dye formed in color development at the site giving a transmission density of the minimum density plus 0.1 is preferably 0.001 to 0.200 mmol/m$^2$. The amount of the formed dye can be determined by various methods. For example, an emulsion layer of the processed photographic material is treated with a proteinase and from the resulting liquid, oil soluble components are extracted with a solvent and after optimally diluting the extracted liquid, the formed dye is quantitatively determined, for example, by means of HPLC (high performance liquid chromatography) using a standard sample which was previously determined with respect to the dye amount. A dye amount of less than 0.001 mmol/m$^2$ requires an expensive specific dye having a high absorption coefficient, while a dye amount of more than 0.200 mmol/m$^2$ results in a lowered dye covering area, in which formed dyes are ineffectively converted into transmission density, producing troubles in contrast design of the high exposure region.

Silver halide emulsions relating to this invention may be subjected to desalting to remove soluble salts at the time of completion of grain growth, or may not be desalted. Desalting can be carried out in the manner, as described in Research Disclosure (hereinafter, also denoted simply as RD) No. 17643.

In this invention, at least two emulsion which were separately prepared may be blended at any proportion. Further, there may be used silver halide described in JP-A No. 2002-55410, paragraph No. 0054–0065 and JP-A No. 6-118593, paragraph No. 0060–0078.

Additives

Hydrophilic protective colloids used in preparation of silver halide photographic materials relating to this invention include not only gelatin used in conventional silver halide emulsions but also gelatin derivatives such as acetylated gelatin and phthalated gelatin, and synthetic or natural hydrophilic polymers such water-soluble cellulose derivatives.

There are optionally employed various techniques and additives known in the art in silver halide photographic materials relating to this invention. In addition to the light sensitive silver halide emulsion layer, for example, auxiliary layers such as a protective layer, a filter layer, an antihalation layer, a cross-over light-cutting layer and a backing layer are provided, in which a chemical sensitizer, a novel sensitizer, a sensitizing dye, a supersensitizer, a coupler, a high boiling solvent, an antifoggant, a stabilizer, a development inhibitor, a bleach-accelerating agent, anti-staining agent, a formalin scavenger, an image tone modifier, a hardening agent, a surfactant, a thickening agent, a plasticizer, a lubricant, a UV absorber, anti-irradiation dye, a filter light absorbing dye, a fungicide, a polymeric latex, a heavy metal, an antistatic agent, and a matting agent are included. These additives are detailed in RD 176, Item/17643 (Dec., 1978); ibid 184, Item/18431 (Aug., 1979), ibid 187, Item/18716 (Nov., 1979); and ibid 308, Item/308119 (Dec., 1989).

Specific compounds described in the foregoing RDs are shown below.

| | RD-17643 | | RD-18716 | RD-308119 | |
|---|---|---|---|---|---|
| Additive | Page | Sect. | Page | Page | Sect. |
| Chemical Sensitizer | 23 | III | 648 Upper right | 996 | III |
| Sensitizing Dye | 23 | IV | 648–649 | 996–998 | IV |
| Desensitizing Dye | 23 | IV | — | 998 | IV |
| Dye | 25–26 | VIII | 649–650 | 1003 | VIII |
| Development Accelerator | 29 | XXI | 648 Upper right | — | — |
| Antifoggant Stabilizer | 24 | IV | 649 Upper right | 1006–1007 | VI |
| Brightener | 24 | V | — | 998 | V |
| Hardener | 26 | X | 651 Left | 1004–1005 | X |
| Surfactant | 26–27 | XI | 650 Right | 1005–1006 | XI |
| Antistatic agent | 27 | XII | 650 Right | 1006–1007 | XIII |
| Plasticizer | 27 | XII | 650 Right | 1006 | XII |
| Lubricant | 27 | XII | — | — | — |
| Matting Agent | 28 | XVI | 650 Right | 1008–1009 | XVI |
| Binder | 26 | XXII | — | 1003–1004 | IX |
| Support | 28 | XVII | — | 1009 | XVII |

Color Developing Agent

In this invention, there may be used a color developing agent, which is oxidized to form an oxidation product upon reduction of silver halide or organic silver salt and capable of forming a dye on coupling with a coupler, or a precursor of a color developing agent (also called a color developing agent precursor or blocked color developing agent), which is capable of forming a color developing agent when subjected to heat, alkali or a nucleophilic agent.

Examples of the color developing agent and color developing agent precursor include compounds (C-1) through (C-16) described in JP-A No. 4-86741, page 7–9; and water-soluble color developing agents and their hydrochloride, sulfate or p-toluenesulfonate of (1) through (26) described in JP-A No. 3-246543, page 6–10. Other Examples include a sulfonamidophenol type developing agent described in JP-A No. 9-15806; hydrazine type developing agents described in JP-A Nos. 5-241282, 8-234388, 8-286340, 9-152700, 9-152701, 9-152702, 9-152803 and 9-152704; hydrazone type developing agents described in JP-A Nos. 7-202002 and 8-234390; and a developing agent described in JP-A No. 2002-55418, paragraph 0103 to 0108.

In this invention, the use of the color developing agent precursor is preferred to enhance storage stability of a color developing agent. Examples thereof include indoaniline type compounds described in U.S. Pat. No. 3,342,597; Schiff base type compounds described in U.S. Pat. No. 3,342,599, RD No. 14,850 and ibid No. 15,159; aldol compounds described in RD NO. 13,924; metal complex salts described in U.S. Pat. No. 3,719,492; and urethane type compounds described in JP-A No. 53-135628. Further, color developing agent precursors releasing p-phenylenediamines, represented by formulas (1) through (6) described in JP-A No. 2002-55418 are also preferred, specifically, compounds represented by formula (2) exhibit superior storage stability and color develop ability. There are also usable compounds described in WO 01/96,954. WO 01/96,954, European Patent Nos. 1,164,417, 1,164,4181,158,358, 1,158,359, 1,160,612, 1,113,316 and 1,113,325; U.S. Patent Nos. 6,319, 640, 6,306,551, 6,312,879, 2001/12886; JP-B No. 8-3614 and 8-3616 (hereinafter, the term, JP-B is referred to as Japanese Patent Publication).

Examples of the color developing agent and a coupler include the combination of p-phenylenediamine type developing agents and phenol or active methylene couplers described in U.S. Pat. No. 3,531,256 and the combination of p-aminophenol developing agents and active methylene couplers described in U.S. Pat. No. 3,761,270. The combination sulfoneamidophenols and four-equivalent couplers exhibited superior raw stock stability when included in photographic material, as described in U.S. Pat. No. 4,021, 240 and JP-A No. 60-128438.

These color developing agents and precursor thereof may be included in photographic material or a processing element (processing sheet or also called a photographic useful compound-providing medium), or contained in solution to be provided onto photographic material. b In this invention, allowing the color developing agent or a precursor thereof to be included photographic material is more preferred. Inclusion in the photographic material enable to design a system superior in environment suitability and rapid accessibility. In cases where included in photographic material, relatively high stability can be achieved even after storage. In this case, it is preferred to use a compound which does not unnecessarily reduce silver salts.

In cases where incorporated in a photographic material or a processing element, a color developing agent or a precursor thereof is preferably incorporated in an amount of 0.05 to 10 mmol, more preferably 0.1 to 5 mmol, and still more preferably 0.2 to 2.5 mmol per $m^2$ of the light-sensitive layer.

Image Tone Modifier

The photographic material relating to this invention preferably contains an image tone modifier. Specifically, allowing an image tone modifier to be concurrently present with organic silver salts or reducing agents is preferred, thereby enhancing effective transport of silver ions. Preferred image tone modifiers used in this invention are described in RD 17029, and specific examples include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides [for example, N-(dimethylaminomethyl)phthalimide]; blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a,5,6a-tatraazapentalene). Preferred image color control agents include phthalazone or phthalazine, which is preferably used in combination with phthalic acids. The content is preferably 0.05 to 0.5 g, and more preferably 0.1 to 0.3 g per $m^2$ of the light-sensitive layer.

Coupler

Next, explanation will be given of couplers. The coupler used in this invention is referred to as a compound capable of forming a dye upon reaction with an oxidation product of the color developing gent described above. Preferred couplers used in this invention include compounds having structures represented by the following formulas (Cp-1) through (Cp-12), as described in JP-A No. 2001-154325. These are generally called active methylene, pyrazolone, pyrazoloazole, phenol and napthol.

Cp-1

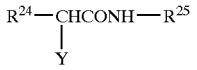

Cp-2

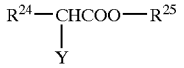

Cp-3

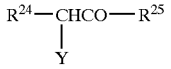

Cp-4

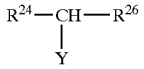

Cp-5

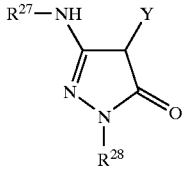

Cp-6

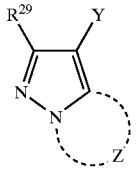

Cp-9

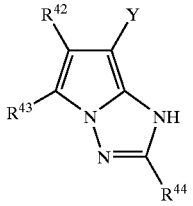

-continued

Cp-10

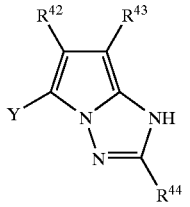

Cp-11

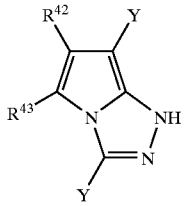

Cp-12

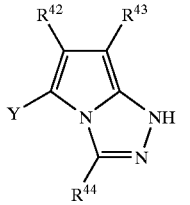

The couplers represented by formulas (Cp-1) through (Cp-4) are called an active methylene type coupler. In the formula (Cp-1) through (Cp-4), $R_{24}$ represents an acyl group, cyano group, nitro group, aryl group, heterocyclic group, alkoxycarbonyl group, aryloxycarbonyl group, carbamoyl group, sulfamoyl group, alkylsulfonyl group, and arylsulfonyl group, each of which may be substituted; $R_{25}$ represents an alkyl group, $R_{25}$ represents an alkyl group, aryl group or heterocyclic group, each of which may be substituted. In the formula (Cp-4), $R_{26}$ represents an aryl group or heterocyclic group, which may be substituted. Examples of substituent for $R_{24}$, $R_{25}$ and $R_{26}$ include an alkyl group, cycloalkyl group, alkenyl group, alkynyl group, aryl group, heterocyclic group, alkoxy group, aryloxy group, cyano group, halogen atom, acylamino group, sulfonamido group, carbamoyl group, sulfamoyl group, alkoxycarbonyl group, aryloxycarbonyl group, alkylamino group, arylamino group, hydroxy group, sulfo group, etc. $R_{24}$ is preferably an acyl group, cyano group, carbamoyl group, or alkoxycarbonyl group.

In the formulas (Cp-1) through (Cp-4), Y represents a hydrogen atom or a group capable of leaving upon coupling reaction with an oxidation product of a color developing agent. Examples of a group acting as an anionic coupling-off group of a two-equivalent coupler include a halogen atom (e.g., chlorine, bromine), alkoxy group (e.g., methoxy, ethoxy), aryloxy group (e.g., phenoxy, 4-cyanophenoxy, 4-alkoxycarbonylphenyl), alkylthio group (e.g., methylthio, ethylthio, butylthio), arylthio group (e.g., phenylthio, tolylthio), alkylcarbamoyl group (e.g., methylcarbamoyl, dimethylcarbamoyl, ethylcarbamoyl, dibutylcarbamoyl, dimethylcarbamoyl, dimethylcarbamoyl, piperidylcarbamoyl, morpholylcarbamoyl), arylcarbamoyl group (e.g., phenylcarbamoyl, methylphenylcarbamoyl, ethylphenylcarbamoyl, benzylphenylcarbamoyl), alkylsulfamoyl (e.g., methylsulfamoyl, dimethylsulfamoyl, ethylsulfamoyl, diethylsulfamoyl, dibutylsulfamoyl, piperidylsulfamoyl, morpholylsulfamoyl), arylsulfamoyl group (e.g., phenylsulfamoyl, methylphenylsulfamoyl, ethylphenylsulfamoyl, benzylphenylsulfamoyl), cyano group, alkylsulfonyl group (e.g., methanesulfonyl, ethanesulfonyl), arylsulfonyl group (e.g., phenylsulfinyl, 4-chlorophenylsulfonylp-toluenesulfonyl), alkylcarbonyloxy group (e.g., acetyloxy, propionyoxy, butyloyloxy), arylcarbonyloxy group (e.g., benzoyl, toluyloxy, anicyloxy), and nitrogen containing heterocyclic group (e.g., imidazolyl, benzotriazolyl).

Examples of the group acting as an anionic coupling-off group of a four-equivalent coupler include a hydrogen atom, formyl group, carbamoyl group, substituted methylene group (e.g., substituent; aryl, sulfamoyl, carbamoyl, alkoxy, imino and hydroxy group), acyl group, and sulfonyl group. In formulas (Cp-1) through (Cp-4), $R_{24}$ and $R_{25}$, or $R_{24}$ and $R_{26}$ may combine with each other to form a ring.

The formula (Cp-5) represents a so-called 5-pyrazoloe type magenta coupler, wherein $R_{27}$represents an alkyl group, aryl group, acyl group, or carbamoyl group; $R_{28}$ represents a phenyl group at least one halogen atom, alkyl group, cyano group, alkoxy group, alkoxycarbonyl group, or acylamino group; Y is the same as defined in the formulas (Cp-1) through (Cp-4).

Of the 5-pyrazoloe type magenta couplers represented by formula (Cp-5) is preferred one having $R_{27}$ of an aryl group or acyl group and $R_{28}$ of a phenyl group substituted by at least one halogen atom. Thus, $R_{27}$ is an aryl group such as phenyl, 2-chlorophenyl, 2-methoxyphenyl, 2-chloro-5-tetradecaneamidophenyl, 2-chloro-5-octadecylsulfoneamidophenyl, and 2-chloro-5-[2-(4-hydroxy-3-t-butylphenoxy)tetradecaneamido]phenyl, or an acyl group such as acetyl, pivaloyl, tetradecanoyl, 2-[2,4-di-t-pentylphenoxy]acetyl, 2-(2,4-di-t-pentylphenoxy) butanoyl, benzoyl and 3-(2,4-di-t-amylphenoxyacetoamido) benzoyl. These groups may be substituted. Examples of a substituent include organic substituent groups containing a carbon atom, oxygen atom. nitrogen atom or sulfur atom, and a halogen atom. $R_{28}$ is preferably a substituted phenyl group such as 2,4,6-trichlorophenyl, 2,5-dichlorophenyl or 2-chlorophenyl.

The formula (Cp-6) represents a pyrazoloazole type coupler, wherein $R_{29}$ represents a hydrogen atom or a substituent group; Z represents an atomic group necessary to form an azole ring containing 2 to 4 nitrogen atoms, which may be substituted by a substituent (including a condensed ring); Y is the same as defined in the foregoing formulas (Cp-1) through (Cp-4).

Of pyrazoloazole type couplers represented by formula (Cp-6), imodizo[1,2-b]pyrazoles desribed in U.S. Pat. No. 4,500,630, pyrazolo[1,5-b]-1,2,4-triazoles described in U.S. Pat. No. 4,540,654, and pyrazolo[5,1-c]-1,2,4-triazoles described in U.S. Pat. No. 3,725,067 are preferred in terms of absorption characteristics of the formed dye; and pyrazolo [1,5-b]-1,2,4-triazoles are preferred in terms of lightfastness. Substituent groups for substituent group $R_{29}$ and the azole ring represented by Y or Z are detailed, for example, in U.S. Pat. No. 4,540,654, col. 2 line 41 to col. 8, line 27. Specifically, a pyrazoloazole coupler in which a branched alkyl group is directly attached to the 2-, 3 or 6 position of the pyrazoloazole group, as described in JP-A 61-65245; a pyrazoloazole coupler containing a sulfoneamido group in the molecule, described in JP-A 61-65245; a pyrazoloazole coupler containing an alkoxyphenylsulfoneamido ballast group, described in JP-A 61-147254; a pyrazoloazole coupler containing an alkoxy or aryloxy group at the 6-position, described in JP-A Nos. 62-209457 and 63-307453; and a pyrazoloazole coupler a carbonamido group in the molecule, described in JPA No. 2-201443 are preferred.

Compounds represented by formulas (Cp-7) and (Cp-8) are called a phenol type coupler and naphthol type coupler. In the formulas (Cp-7) and (Cp-8), $R_{30}$ represents= $NHCOR_{32}$, $—SO_2NR_{32}R_{33}$, $—NHSO_2R_{32}$, $—NHCOR_{32}$, $—NHCONR_{32}R_{33}$, $—NHSO_2NR_{32}R_{33}$ in which $R_{32}$ and $R_{33}$ are each a hydrogen atom or a substituent; $R_{31}$ represents a substituent; 1 is an integer of 0 to 2 and m is an integer of 0 to 4; Y is the same as defined in formulas (Cp-1) through (Cp-4); and $R_{31}$ to $R_{33}$ are the same substituent as defined in $R_{24}$ to $R_{26}$.

Preferred examples of the phenol type coupler represented by formula (Cp-7) include 2-alkylamino-5-alkylphenol type couplers described in U.S. Pat. Nos. 2,369,929, 2,801,171, 2,772,162, 2,895,826, 3,772,002; 2,5-diacylaminophenol type couplers described in U.S. Pat. Nos. 2,772,162, 3,758, 308, 4,126,396, 4,334,011, 4,327,173, West German Patent No. 3,329,729, JP-A No. 59-166956; and 2-phenylureido-5-acylaminophenol described in U.S. Pat. Nos. 3,446,622, 4,333,999, 4,451,559 and 4,427,767. Preferred examples of the naphthol type coupler represented by formula (Cp-8) include 2-carbamoyl-1-naphthol described in U.S. Pat. Nos. 2,474,293, 4,052,2124,146,396, 4,228,233 and 4,296,200; and 2-carbamoyl-5-amido-1-naphthol described in U.S. Pat. No. 4,690.200.

Compounds represented by formulas (Cp-9) through (Cp-12) are called pyrrolotriazole couplers. In the formulas, $R_{42}$, $R_{43}$ and $R_{44}$ represent a hydrogen atom or a substituent; Y is the same as defined in formulas (Cp-1) through (Cp-4). The substituent represented by $R_{42}$, $R_{43}$ and $R_{44}$ is the same as defined in the foregoing $R_{24}$ through $R_{26}$. Preferred examples of the pyrrolotriazole type couplers represented by formulas (Cp-9) through (Cp-12) include those described in European Patent Nos. 488,248A1, 491,197A1 and 545,300, in which at least one of $R_{42}$ and $R_{43}$ is an electron-withdrawing group.

There are also employed condensed cyclic phenol type couplers, imidazole type couplers, pyrrole type couplers, 3-hydroxypyridine type couplers, active methylene type couplers, 5,5-condensed heterocyclic coupler and 5,6-condensed heterocyclic couplers. Examples of the condensed phenol type coupler include those described in U.S. Pat. Nos. 4,327,173, 4,564,586 and 4,904,575; examples of the imidazole type couplers include those described in U.S. Pat. Nos. 4,818,672 and 5,051,347; examples of the pyrrole type couplers include those described in JP-A Nos. 4-188137 and 4-190347; examples of the 3-hydroxypyridine type couplers include those described in JP-A No. 1-315736; examples of the active methylene type couplers include those described in U.S. Pat. Nos. 5,104,783 and 5,162,196; examples of the 5,5-condensed heterocyclic couplers include pyrrolopyrazole type couplers described din U.S. Pat. No. 5,164,289 and pyrroloimidazole type couplers described in JP-A No. 4-174429; examples of the 5,6-condensed heterocyclic couplers include pyrazolopyrimidine type coupler described in U.S. Pat. No. 4,950,585 and pyrrolotriazine type couplers described in JP-A 4-204730.

In addition to the foregoing couplers, there are also usable couplers described in West German Patent Nos. 3,819,051A and 3,823,049; U.S. Pat. Nos. 4,840,883, 5,024,930, 5,051, 347, 4,481,268; European Patent Nos. 304,856A2, 329,036, 354,549A2, 374,781A2, 379,110A2, 386,930A1; JP-A 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-1948474-204532, 4-204731 and 4-204732.

Compounds generally known as a yellow coupler, magenta coupler and cyan coupler are usable in the silver halide photographic material relating to this invention. These compounds are used for color photography, which exhibit a spectral absorption maximum in the blue region (wavelengths of 350 to 500 nm), the green region (wavelengths of 500 to 600 nm) and the red region (wavelengths of 600 to 750 nm), respectively, upon reaction with an oxidation product of a color developing agent. In cases where using hydrazine type or sulfonamide type developing agents, dyes formed on coupling exhibit an absorption maximum different in wavelength from the foregoing. It is therefore necessary to select the kind of couplers in accordance with the kind of a developing agent used. The photographic material relating to this invention is not necessarily designed to have spectral absorption maximums in the blue, green and red regions. The formed dye may have spectral absorption in the UV or infrared region, which may be combined with absorption in the visible region.

Couplers used in this invention may have a polymeric ballast group. There may be usable any one of a four-quivalent coupler and a two-equivalent coupler, and it is preferable to use them properly. For example, it is preferred to use four-equivalent couplers for developing agents represented by formulas (1) through (3) described in JP-A No. 2001-5155, and it is also preferred to use two-equivalent couplers for developing agents represented by formulas (4) and (5) described in JP-A No. 2001-5155. Specific examples including four- and two-equivalent couplers are described in literature or patents, such as "The Theory of the Photographic Process" (4th Ed., T. H. James, Macmillan, 1977) page 291–334 and 354–361; JP-A Nos. 58-12353, 58-149046, 58-149047, 59-11114, 59-124399, 59-174835, 59-231539, 9-231540, 60-2951, 60-14242, 60-23474, 60-66249, 8-1106088-146552, 8-146578 and 9-204031.

The photographic material relating to this invention may contains the following functional couplers. Couplers to correct unwanted absorption of a dye include yellow-colored cyan couplers described in European Patent No. 456,257A1, yellow0colored magenta couplers described the foregoing patent, magenta-colored cyan couplers described in U.S. Pat. No. 4,833,069, colorless masking couplers represented by formula (A) described in WO 92/11575 (specifically, exemplified compounds on pages 36–45). Compounds (including couplers) capable of forming a photographically useful compound moiety upon reaction with an oxidation product of a color developing agent include, for example, development inhibitor releasing compounds such as compounds represented by formulas (I) through (IV) described in European Patent No. 378,236A1, page 11, compounds represented by formula (I) described in European Patent No. 436,938A2, page 7, compounds represented by formula (1) described in JP-A No. 5-307248, compounds represented by formulas (I), (II), and (III) described in European Patent No. 440,195A2, page 5–6 and compounds represented by formula (I) described in JP-A No. 6-59411; a ligand-releasing compound such as compounds represented by LIG-X described in claim 1 of U.S. Pat. No. 4,555,478.

The foregoing couplers used in this invention may be used alone or in combination thereof, or in combination other couplers. It is preferred that the coupler be included in the same layer as a developing agent and a silver halide emulsion, or the same layer as a silver halide emulsion. In cases where included in the same layer as a developing agent and a silver halide emulsion, the amount of the coupler is preferably 0.05 to 20 mol, more preferably 0.1 to 10 mol, and still more preferably 0.2 to 5 mol per mol of a developing agent. The coupler is included preferably in amount of 0.01 to 1 mol, and more preferably 0.02 to 0.6 mol per mol of silver halide.

Hydrophobic additives such as couplers and color developing agents can be incorporated into a predetermined layer of the photographic material according to methods described in U.S. Pat. No. 2.322,027. In this case, high boiling solvents described in U.S. Pat. Nos. 4,555,470, 4,536,466, 4,536,467, 4,587,206, 4555,476 and 4,599,297; and JP-B No. 3-62,256 can be used, optionally in combination with low boiling solvents having a boiling point of 50 to 160° C. These couplers and high boiling solvents may respectively used in combination thereof. The amount of the high boiling solvent is preferably not more than 10 g, more preferably not more than 5 g, and still more preferably 1 to 0.1 g per g of hydrophobic additive. The high boiling solvent is also preferably not more than 1 ml, more preferably not more than 0.5 ml, and still more preferably not more than 0.3 ml per g of binder. There is also applicable a dispersing method using polymers, as described in JP-B No. 51-39,853 and JP-A No. 51-59943.

In this invention, the silver halide photographic material preferably contains a Fischer dispersion type coupler. For example, methods described in JP-A No. 59-60437 and JP-B No. 6-64319 may be applied to disperse the Fischer type coupler in an alkaline aqueous solution. In this case, the coupler, which contains an acid group such as a carboxylic acid or sulfonic acid is introduced into a hydrophilic colloid in the form of an alkaline aqueous solution. There is also applicable incorporation in the form of a fine solid particular dispersion, as described in JP-A No. 62-30,242.

In the case of a coupler being substantially water-insoluble, the coupler can be incorporated in the form of fine particles dispersed in a binder. Various surfactants can be employed to disperse hydrophobic compounds in hydrophilic colloid, for example, as described in JP-A 59-157636, page 37–38, Table 1. There are also usable phosphoric acid ester type surfactants described in JP-A Nos. 7-66267 and 7-228589 and West German Patent No. 1,932,299A.

Hydrazine Derivative

The silver halide color photographic material relating to this invention preferably contains hydrazine derivatives and preferred hydrazine derivatives are represented by the following formula [H]:

formula [H]

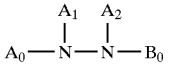

wherein $A_0$ is an aliphatic group, aromatic group, heterocyclic group, each of which may be substituted, or —$G_0$— $D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$is a —CO—, —COCO—, —CS—, —C(=$NG_1D_1$)—, —SO—, —$SO_2$— or —P(O) ($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen, including residues of a pyrrolidine ring, imidazole ring, tetrahydrofuran ring, morpholine-ring, pyridine ring, pyrimidine ring, quinoline ring, thiazole-ring, benzthiazole ring, thiophene ring or furan ring. In —$G_0$—$D_0$ group represented by $A_0$, $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or —O—, —S— or —N($D_1$)—, in which $D_1$ represents a hydrogen atom, or an aliphatic group, aromatic group or heterocyclic group, provided that when a plural number of $D_1$ are present, they may be the same with or different from each other. $D_0$ is a hydrogen atom, an aliphatic group, aromatic group, heterocyclic group, amino group, alkoxy group, aryloxy group, alkylthio group, or arylthio group, and $D_0$ is preferably a hydrogen atom, alkyl group, alkoxy group or amino group. The aromatic group, heterocyclic group and —$G_0$—$D_0$ group may be substituted.

Specifically preferred $A_0$ is an aryl group or —$G_0$—$D_0$ group. $A_0$ contains preferably a non-diffusible group or a group for promoting adsorption to silver halide. A ballast group used in immobile photographic additives such as a coupler, as the non-diffusible group is preferable. The ballast group includes an alkyl group, alkenyl group, alkynyl group, alkoxy group, phenyl group, phenoxy group and alkylphenoxy group, each of which has 8 or more carbon atoms and is photographically inert. The group for promoting adsorption to silver halide include, for example, thiourea group, thiourethane group, mercapto group, thioether group, thione group, heterocyclic group, thioamido-heterocyclic group, mercapto-heterocyclic group, and adsorption-promoting group described in JP-A No. 64-90439.

In Formula (H), $B_0$ is a blocking group, and preferably —$G_0$—$D_0$, wherein $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group (e.g., acetyl, trifluoroacetyl and benzoyl), a sulfonyl group (e.g., methanesulfonyl and toluenesulfonyl) or an oxalyl group (e.g., ethoxalyl).

Specific examples of the compound represented by formula [H] include compounds H-1 through H-30 described in paragraph 0046 through 0051 of JP-A No. 2002-55410, but are by no means limited to these. Other preferred hydrazine derivatives include, for example, compounds H-1 through H-29 described in U.S. Pat. No. 5,545,505 col. 11 to col. 20; and compounds 1 through 12 described in U.S. Pat. No. 5,464,738, col. 9 9-11.

These hydrazine derivatives can be readily synthesized in accordance with commonly known methods. The hydrazine derivatives are incorporated into a light-sensitive layer containing a silver halide emulsion or a layer adjacent thereto. An incorporating amount, depending on grain size and halide composition of silver halide grains, an extent of chemical sensitization and the kind of antifoggant, is preferably $1\times10^{-6}$ to $1\times10^{-1}$ mol., and more preferably $1\times10^{-5}$ to $1\times10^{-2}$ mol per mol of silver halide.

Organic Silver Salt

The silver halide color photographic material relating to this invention preferably contains commonly known organic silver salts to enhance sensitivity or develop ability.

Organic silver salts usable in this invention include silver salts of long chain fatty acids and heterocycle-containing carboxylic acids , e.g., silver behenate, α-(1-phenyltetrazolethio)acetate, as described in JP-A Nos. 53-49241, 49-52626, 52-141222, 53-36224, 53-37626, 53-36224 and 53-37610; and silver salts of imino group containing compounds, as described in JP-B Nos. 44-26582, 45-12700, 45-18416 and 45-22815; JP-A Nos. 52-137321, 58-118638, and 58-118639; U.S. Pat. No. 4,123,274. There are also usable acetylene silver salts described in JP-A No. 61-249044 and complex salts of mercapto-containing compound and silver described in WO 01/96950. Of these are preferred silver salts of benzotriazole and its derivatives) e.g., benzotriazole silver salt, 5-methylbenzotriazole silver salt), silver behenate and silver complex of 1-phenyl-5-mercapto-tetrazole.

The foregoing organic silver salts may be used alone or in combination, which are prepared in an aqueous hydrophilic colloid solution such as an aqueous gelatin solution and desalted to be use as it is. Alternatively, the formed organic salt is separated and mechanically ground to fine particles and dispersed.

The organic silver salt is used in an amount of 0.01 to 10 mol, and preferably 0.05 to 3 mol in combination with 1 mol of light-sensitive silver halide. The total amount of the light-sensitive silver salt and organic silver salt, represented by equivalent converted to silver is 0.05 to 30 g/$m^2$, and preferably 0.1 15 g/$m^2$. The silver halide color photographic material relating to this invention preferably contains organic silver salt grains having a mono-dispersibility of not less than 0.1% and less than 25%. The grain size of an organic silver salt refers to an edge length when the organic silver salt grains are regular crystals such as cubic or octahedral grains. In the case of being not regular crystals, the grain size is expressed in a diameter of a sphere having a volume equivalent to that of the grain, i.e., equivalent sphere diameter. The monodispersibility (or coefficient of variation of grain size) is defined as follows:

Monodispersibility (%)=(standard deviation of grain size)/(mean grain size)×100

Preparation of organic silver salt grains having a monodispersibility of less than 0.1% needs a large amount of manpower and is not realistic. On the contrary, An organic silver salt grains having a monodispersibility of more than 25% results in unfavorable uneven images.

Antifoggant

Antifoggants usable in this invention include, fir example, higher fatty acids describe din U.S. Pat. No. 3,645,739; mercuric salts described in JP-B No. 47-11113; N-halogen compounds described in JP-A NO. 51-47419; mercapto-releasing compounds described in U.S. Pat. No. 3,700,457, JP-A Nos. 51-50725, 2-297548 and 2-282241; arylsulfonic acids described in JP-A No. 49-125016; lithium carbonate described in JP-A No. 51-47419; oxidizing agents described in British patent No. 1,455,271 and JP-A No. 50-101019; sulfonic acids and thiosulfonic acids described in JP-A No. 53-19825; Thiouracils described in JP-A No. 51-3223; sulfur described in JP-A 51-26019; disulfides, and polysulfides described in JP-A Nos. 51-42529, 51-81124 and 55-93149;

rosin and diterpene described in JP-A No. 51-57435; Polymeric acids containing a carboxy group or sulfonic acid group, described in JP-A No. 51-104338; thiazolithione described in U.S. Pat. No. 4,138,265; triazoles described in JP-A Nos. 54-51821 and 55-142331 and U.S. Pat. No. 4,137,079; thiosulfinic acid esters described in JP-A NO. 55-140883; di- or tri-halides describe din JP-A Nos. 59-46641, 59-57233 and 59-57234; thiol compounds described in JP-A No. 59-111636; and hydroquinone derivatives described in JP-A Nos. 60-198540 and 60-227255. Other preferred antifoggants include hydrophilic group containing antifoggant described in JP-A No. 62-78554; polymeric antifoggants described in JP-A No. 62-121452; and ballast group containing antifoggants described in JP-A No. 62-123456. There is also preferred non-dye-forming couplers described in JP-A No. 1-161239. Furthermore, antifoggants such as organic silver salts described above and compounds described in JP-A In this invention are usable various antifoggants and stabilizers, and their precursors. Specific examples thereof include compounds described in the foregoing Research Disclosure, compounds described in U.S. Pat. Nos. 5,089,378, 4,500,627 and 4,614,702, JP-A Nos. 64-13564, page 7–9,57–71 and 81–97, and compounds described in U.S. Pat. Nos. 4,775,610, 4,626,500, and 4,983,494; JP-A Nos. 62-174747, 62-239148, 1-150135, 2-1105572-1789148, RD 17,643 (1978) page 24–25, European Patent Nos. 1,164,419 and 1,164,421, JP-A Nos. 2002-23326, and 2002-31878.

These compounds is used preferably in an amount of $5\times10^{-6}$ to 10 mol, and more preferably $1\times10^{-6}$ to 5 mol per mol of silver.

Layer Arrangement

In the photographic material relating to this invention, various layers such as a protective layer, subbing layer, interlayer, yellow filter layer, and antihalation layer can be provided on or below the light-sensitive layer. There may be provided a backing layer on the opposite side of a support. Specifically, there can be provided a sublayer described in U.S. Pat. No. 5.051,335, an interlayer containing solid pigment, interlayer containing a reducing agent or DIR compound described in JP-A Nos. 1-120553, 5-34884 and 2-64634, interlayer containing a electron transfer agent described in U.S. Pat. Nos. 5,017,454 and 5,139,919, JP-A No. 2-235044, a protective layer containing a reducing agent described JP-A No. 4-249245, and combinations of the foregoing layers.

Various layer arrangements are applicable to the silver halide color photographic material relating to this invention, including a conventional layer order, reverse layer order and unit layer arrangement.

Dyestuff

In the silver halide color photographic material, dyes having different absorption in various wavelength regions are used for antihalation or anti-irradiation. Since fine colloidal silver particles are used in the yellow filter layer or antihalation layer of conventional silver halide color photographic materials, the bleaching process is needed to remove the colloidal silver after completion of development. Photographic material having no necessity for bleaching is desirable for the purpose of enhancing simplicity of the process. Accordingly, it is preferred to replace the colloidal silver by using dyes, specifically ones that are capable of being decolorized, leached out or transferred during process and having little contribution to density after completion of the processing. The dye capable of being decolorized or removed during process means that the content of the dye remaining after completion of the processing is not more than ⅓, and preferably not more than 1/10 of the dye contained in the photographic material before being processed. Dye component(s) may be leached out of the photographic material during process, transferred to a processing element, or changed to a colorless compound upon reaction during process.

These dyes may be incorporated into a silver halide emulsion layer or a light-insensitive layer. To allow sensitivity and sharpness to be compatible with each other, it is preferred for a silver halide emulsion sensitive to a specific wavelength region to incorporate a dye having absorption in the same wavelength region as the silver halide emulsion into the position opposite to a light source. Dyes usable in the photographic material relating to this invention include commonly known dyes, such as a dye soluble in an alkali in a developer solution or a dye capable of being decolorized upon reaction with ingredients of the developer solution, such as a sulfite ion, developing agent or an alkali. Specific examples thereof include dyes described in European Patent No. 549,489A and Exemplary dyes Ex F2 through 6 described in JP-A No. 7-152129. These dyes are used in cases when processing photographic material in a processing solution and preferably used in cases when thermally developing the photographic material using a processing sheet, as described later. In cases when processed in a processing solution, preferred examples of a dye having absorption in the visible region include dyes AI-1 through 11 described in JP-A No. 3-251840 on page 308. Infrared absorbing dye compounds represented by general formulas (I), (II) and (III) described in JP-A No. 1-280750 page 2, left lower column exhibit preferable spectral characteristics without affecting photographic performance and causing stain due to residual dyes. Specific examples of preferred compounds include compounds (1) through (45) described in the same publication at page 3, left lower column to page 5 left lower column.

Dyes can also be fixed in a binder by allowing the dyes to mordant with a mordant. There can be used mordants and dyes known in the photographic art and examples thereof include mordants described in U.S. Pat. No. 4,500,626, col. 58–59, JP-A No. 61-88256, page 32–41, Nos. 62-244043 and 62-244036. Further, using a reducing agent and a compound releasing a diffusible dye upon reaction with a reducing agent, alkali-movable dye is allowed to be released on development and dissolved in a processing solution or transferred to a processing sheet, as described in U.S. Pat. Nos. 4,559,290 and 4,783,369; European patent No. 220,746A and Kokai Giho No. 87-6119; and JP-A No. 8-101487 paragraph No. 0080 to 0081.

There can also be used decoloring leuco dyes. For example, JP-A No. 1-150132 describes a silver halide photographic material containing a leuco dye, which was previously developed with a developer such as organic acid metal salts. Since the leuco due and the developer complex decolorize upon heating or reaction with an alkali agent, such a combination of the leuco dye and developer is preferred to perform thermal development. There can be employed commonly known leuco dyes, as described in Moriga and Yoshida "Senryo to Yakuhin" vol. 9, page 84 (Kaseihin Kogyokai); "Senryo Binran (Dye Handbook)" page 242 (Maruzen, 1970); R. Garner "Reports on the Progress of Appl. Chem." 56, 199 (1971); "Senryo to Yakuhin" vol. 19, page 230 (Kaseihi Kogyokai); "Shikizai" 62, 288 (1989); "Senryo Kogyo" 32, 208. Preferred examples of the developers include acid clay type developers, phenol formaldehyde resin and organic acid metal salts.

Binder

Binders used in constituting layers of the photographic material or processing material relating to this invention preferably are hydrophilic ones, as described in the foregoing RDs or JP-A 64-13546, pages 71–75. Bonders used in the silver salt photothermographic imaging material are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides. Binders used in this invention may be hydrophilic or hydrophobic and transparent hydrophobic binders are used to reduce fogging caused in thermal development, for example, including polyvinyl butyral, cellulose acetate, cellulose acetate-butylate, polyester, polycarbonate, polyacrylic acid, and polyurethane. Of these are preferred polyvinyl butyral, cellulose acetate, cellulose acetate-butylate and polyester. These binders are used alone or in combination thereof. The coating amount is preferably not more than 100 g/m$^2$, and more preferably not more than 20 g/m$^2$.

Hardener

The photographic material or the processing material relating to this invention is preferably hardened with a hardener. In cases where using hydrophilic binders such as gelatin, preferred hardeners include, for example, those described in JP-A Nos. 59-116655, 62-245261, 61-18942, 61-249054, 61-245153, and 4-218044. Specific examples thereof include aldehyde type hardeners (e.g., formaldehyde), azilidine type hardener, epoxy type hardener, vinylsulfone type hardener [e.g., N,N'-ethylene-bis(vinylsulfonyl-acetamido)ethane], N-methylol type hardener (e.g., dimethylol urea), boric acid, metaborate and polymeric hardeners (e.g., compounds described in JP-A No. 62-234157). Of these hardeners, vinylsulfone type hardeners and chlorotriazine type hardeners are preferably used alone or in combination. These hardeners are used in an amount of 0.001 to 1 g, and preferably 0.005 to 0.5 g per g of hydrophilic binder.

Support

Supports used in this invention preferably plastic films of polyolefins such as polyethylene and polypropylene, polycarbonates, cellulose acetate, polyethylene terephthalate, polyethylene naphthalate, and polyvinyl chloride. Polystyrene having a syndiotactic structure are also preferred. These can be obtained by methods described in JP-A Nos. 62-117708, 1-46912 and 1-178505. Other support usable in the photographic material relating to this invention include paper supports such as photographic raw paper, printing paper, baryta paper and resin-coated paper, the foregoing plastic films provided with a reflection layer, and supports described in JP-A No.62-253195 (page 29–31). Supports described in the foregoing RD No. 17643, page 28; No. 18716, page 647 right column to page 648, left column; No. 30710, page 879 are preferably used.

The support described above may be subjected to a thermal treatment at a temperature lower than Tg, thereby reducing roll-set curling. Further, the support may be subjected to a surface treatment to enhance adhesion between the support and a sublayer. Specifically, there are employed a glow discharge treatment, UV irradiation treatment, corona discharge treatment and flame treatment. There are also employed supports described in "Kochigijutsu (Known Techniques) No. 5 (March 22, 1991, published by Azutech Co.) page 44–149. Further, transparent supports such as polyethylene naphthalate dicarboxylate and one having, thereon, transparent magnetic material. Supports described in RD No. 308119, page 1009 and Product Licensing Index vol. 92, page 108, item "Support" are also usable. In cases where the photographic material relating to this invention is used in thermal processing, the support used therein needs to be resistant to the processing temperature.

Magnetic Recording Layer

In this invention, in addition to the foregoing supports, support having a magnetic recording layer can be used to record photographic information, as described in JP-A Nos. 4-124645, 5-40321, 6-35092, and Japanese Patent Application Nos. 5-58221 and 5-106979.

Coating an aqueous or organic solvent type coating composition comprising magnetic material particles dispersed in a binder on a support provides the magnetic recording layer. The magnetic material particles used in this invention include ferromagnetic iron oxide such as $\gamma$-$Fe_2O_3$, Co-coated $\gamma$-$Fe_2O_3$, Co-coated magnetite, Co-containing magnetite, ferromagnetic chromium dioxide, ferromagnetic metals, ferromagnetic alloys, hexagonal Ba-ferrite, Sr-ferrite, Pb-ferrite, and Ca-ferrite. Of these, Co-coated ferromagnetic iron oxides such as Co-coated $\gamma$-$Fe_2O_3$ are preferred. Any shape such as needle-like, rice grain-like, spherical, cubic and planar forms is applicable. The specific surface area is preferably not less than 20 $m_2$/g, and more preferably not less than 30 m$^2$/g in terms of SBET. The saturation magnetization ($\sigma s$) of the ferromagnetic material is preferably $3.0\times10^4$ to $3.0\times10^5$ A/m, and more preferably $4.0\times10^4$ to $2.5\times10^5$ A/m. The ferromagnetic material particles may be surface-treated with alumina or organic material. The ferromagnetic material particles may also be surface-treated with a silane coupling agent or titanium coupling agent, as described in JP-A No. 6-161032. Magnetic material particles may also be used, the surface of which is covered with organic or inorganic material, as described in JP-A 4-259911 and 5-81652.

Binders used for magnetic material particles include thermoplastic resin, thermosetting resin, radiation-hardenable resin, reactive resin, acid-, alkali- or bio-degradable polymers, natural polymers (e.g., cellulose derivatives, saccharide derivatives) and their mixtures, as described in JP-A 4-219569. The foregoing resins exhibit a Tg of −40° C. to 300° C. and having a weight-averaged molecular weight of 2,000 to 1,000,000. Specific examples thereof include vinyl type copolymer, cellulose derivatives such as cellulose diacetate, cellulose triacetate, cellulose acetate-propionate, cellulose acetate-butylate, and cellulose tripropionate, acryl resin and polyvinyl acetal resin. Gelatin is also preferred. Of these, cellulose di(or tri)acetate is specifically preferred. Binders can be hardened with an epoxy type, azilidine type, isocyanate type hardeners. The isocyanate type hardeners include, for example, isocyanates such as trilenediisocyanate, 4,4'-diphenylmethanediisocyanate, hexamethylenediisocyanate, and xylylenediisocyanate; reaction producrs of these isocyanates and polyalcohols (e.g., a reaction product of 3 mol trilenediisocyanate and 1 mol trimethylolpropane) and polyisocyanates produced by condensation of these isocyanates, as described in JP-A NO. 6-59357.

A kneader, pin-type mill and annular mill alone or in combination are used to disperse the foregoing magnetic material in the binder. There are usable dispersing agents described in JP-A 5-088283 or known in the art. The thickness of the magnetic recording layer is 0.1 to 10 μm, preferably 0.2 to 5 μm, and more preferably 0.3 to 3 μm. The weight ratio of magnetic material particles to binder is preferably 0.5:100 to 60:100, and more preferably 1:100 to 30:100. The coating amount of magnetic material particles is 0.005 to 3 $g/m^2$, preferably 0.01 to 2 g/m2, and more preferably 0.02 to 0.5 $g/m^2$. A transmission yellow density of the magnetic recording layer is preferably 0.01 to 0.50, more preferably 0.03 to 0.20, and still more preferably 0.04 to 0.15. The magnetic recording layer is provided overall or a stripe form on the back side of the support, by means of coating or printing. The magnetic recording layer can be coated by an air-doctor knife, blade, air knife, squeezing, dipping, reverse roll, transfer roll, gravure, kissing, casting, spraying, dipping, bar and extrusion. Coating solution described in JP-A No. 5-341436 is also preferred.

The magnetic recording layer may further be provided with various functions for enhancing lubrication curl adjustment, antistatic agent, adhesion prevention agent, and head cleaning agent. There may be separately provided a functional layer to perform the foregoing functions.

Non-spherical inorganic particles exhibiting a Mohs hardness of at least 5 are preferably used as an abrasive material in the magnetic recording layer of this invention. The non-spherical inorganic particles are comprised of oxides such as aluminum oxide, chromium oxide, silicon dioxide and titanium dioxide; carbides such as silicon carbide and titanium carbide; or fine powdery diamond. The abrasive material may be surface-treated with a silane coupling agent or titanium coupling agent. The particles may be incorporated into the magnetic recording layer or an over-coat layer on the magnetic recording layer (such as a protective layer or a lubricant layer). Usable binders include the foregoing binders, and binders used in the magnetic recording layer are preferred. Photographic materials provided with a magnetic recording layer are described in U.S. Pat. Nos. 5,336,589, 5,250,404, 5,229,259, 5,215,874; and European patent No. 466,130.

There will be described polyester supports used in the foregoing photographic material provided with a magnetic recording layer and details including photographic material, processing, cartridge and examples thereof are described in Kokai-Giho No. 94-6023 (March 15, 1994, Hatsumei Kyokai). Polyester usable as a support is comprised of a diol and an aromatic dicarboxylic acid as essential components. Examples of the aromatic dicarboxylic acid include 2,6-, 1,5-, 1,4-, or 2.7-naphthalendicarboxylic acid, terephthalic acid, isophthalic acid and phthalic acid; and examples of the diol include diethylene glycol, triethylene glycol, cyclohexane dimethanol, bisphenol A, and bisphenol. Examples of the polymer include homopolymers such as polyethylene terephthalate, polyethylene naphthalate, and polycyclohexane-dimethanol terephthalate. A polyester containing 50 to 100 mol % of 2,6-dicarboxylic acid preferred and polyethylene 2,6-naphthalate is specifically preferred. The average molecular weight is within the range of 5,000 to 200,000. The Tg of the polyester is 50° C. or higher, and preferably 90° C. or higher.

It is preferred to subject the polyester support to thermal treatment to reduce roll-set curling, at a temperature higher than 40° C. and lower than Tg, more preferably a temperature higher than the Tg minus 20° C. and lower than the Tg. The thermal treatment may be carried out at a constant temperature falling within the foregoing range. Alternatively, the thermal treatment is carried out with cooling. The thermal treatment time is 0.1 to 1500 hrs, and preferably 0.5 to 200 hrs. The thermal treatment of the support may be carried out in the roll form or with transporting the web. Surface modification may be achieved by roughening the surface of the support (e.g., by coating fine conductive inorganic particles such as $SnO_2$ or $SbO_2$). It is desirable to provide knurling to the end portion to heighten the end portion, thereby preventing movement of the kerf in the roll core portion. Such thermal treatments may be conducted at any stage, i.e., after film-making of the support, after the thermal treatment, after coating a back layer (e.g., antistatic agent, lubricant) or after subbing, and preferably after coating antistatic agent. A UV absorber may be kneaded in the polyester. Commercially available dyes or pigments used for polyester, such as Diaresin (available from Mitsubishi Kasei Co., Ltd.) and Kayaset (available from Nippon Kayaku Co., Ltd.) are preferably incorporated to prevent light-pumping.

Processing

In this invention, processing may be conducted in accordance with C41 standard process (produced by Eastman Kodak Co.) or the process similar thereto, comprising color developing, bleaching, fixing and stabilizing, and activator processing is also feasible. In this case, it is preferred that the photographic material has characteristics suitable for any one of plural processes.

In this invention, the activator processing means that a color developing agent or a its precursor is included in the photographic material and/or processing material and processing is performed using a solution not containing a color developing agent. Thus, the processing solution contains no color developing agent, which is contained in conventional color developing solution, so that an alkali or auxiliary developing agent may be contained therein. The activator processing is exemplarily described in the prior art literature, for example, European Patent No. 545,491A1 and 565,165A1. The pH of the activator processing solution is preferably 9 or higher, and more 10 or higher.

Auxiliary Developer

In cases where subjecting the photographic material relating to this invention to the activator processing, auxiliary developing agents are used. The auxiliary developing agent refers to material exhibiting a function of promoting electron transfer of from a color developing agent to silver halide in the process of developing silver halide. The auxiliary developing agent may be incorporated into an auxiliary processing solution or included in the photographic material. Development using aqueous alkaline solution containing an auxiliary developing agent is described in RD No. 17643, page 28–29; RD No. 18716, page 651, left column to right column; and RD 30710, page 880–881. The auxiliary developing agents used in this invention preferably are electron-releasing compounds following the Kendall-Pelz rule, such as those represented by general formulas (ETA-I) and (ETA-II) described in JP-A 2002-23296, paragraph No. 0118 to 0123. Of those, the compound represented by formula (ETA-I) is specifically preferred.

In cases where allowing an auxiliary developing agent to be included in the photographic material, the auxiliary developing agent may be include in the form of a precursor to enhance storage stability of the photographic material. Examples of a precursor of a developing agent include compounds (ETP-1 through (ETP-97) described in JP-A 2000-89425. These compounds may be dissolved in water or solvents such as alcohol, acetone, dimethylformamide and glycols, dispersed in the form of a dispersion of fine solid particles, or dissolved in a high boiling solvent, followed by being dispersed in a hydrophilic binder, and then coated. These auxiliary developing agent precursors may be used in combination thereof or in combination of auxiliary developing agents.

The silver halide color photographic material relating to this invention preferably contains the foregoing auxiliary developing agent as an electron transfer agent. Preferred electron transfer agents include, for example, the above-described compounds of the general formula (ETA-1) or (ETA-2) described in JP-A 2002-23296. Specific examples of these compounds include compounds described in JP-A 2000-19698, paragraph Nos. 0157 to 0159.

Trapping Agent of Oxidation Product of Developing Agent

The silver halide color photographic material relating to this invention preferably contains a compound capable of forming a substantially colorless upon reaction with an oxidation product of a color developing agent. Examples of such as compound include compounds described in JP-A Nos. 01-193855, 01-283559, 01-283558, JP-B No. 4-73722 and Patent No. 2699005. These compounds may be incorporated into an emulsion layer or an interlayer not containing an emulsion.

Thermal Processing

In one preferred embodiment of this invention, the photographic material relating to this invention is thermally developed. Heating the photographic material as it is or heating with a superposition of other processing material performs thermal developing. The processing material is a sheet having on a support a processing layer containing a base and/or base precursor, as described later. The processing layer preferably comprises a hydrophilic binder. After imagewise exposed, the photographic material is heated together with the processing material to perform image formation, while laminating the light-sensitive layer side of the photographic material to the processing layer side of the processing material. It is preferred that after supplying water to the photographic material or the processing material in an amount of 1/10 to 30 times water necessary for the maximum swell of the total layers of the photographic material and processing material, the photographic material and the processing material are laminated and heated to perform color development. The foregoing auxiliary developing agent may optionally be included in the photographic material or the processing material or coated thereon together with water.

Thermally processing photographic materials is commonly known in the photographic art and photographic material and process thereof are detailed, for example, in "Shashin-Kogaku no Kiso" (Fundamentals of Photographic Engineering, 1970, Corona Co.) page 553–555; Nebletts, Handbook of Photography and Reprography, $7^{th}$ Ed. (Van Nostrand and Reinhold Company), page 32–33; U.S. Pat. Nos. 3,152,904, 3,301,678, 3,392,020 and 3,457,075; British Patent Nos. 1,131,108 and 1,167,777; and RD No. 17029 (1978, June) page 9–15. The heating temperature in the thermal development is 50 to 250° C., and preferably 60 to 150° C.

To promote thermal development, a thermal solvent may be incorporated into the photographic material. The thermal solvent refers to a compound capable of being liquefied on heating and promoting image formation. The thermal solvent is preferably white-colored and solid at ordinary temperature, and is also desirable to less volatile. The melting point is preferably 70 to 170° C. Examples thereof include polar organic compounds described in U.S. Pat. Nos. 3,347,675 and 3,667,959. Specific examples include amide derivatives (e.g., benzamide), urea derivatives (e.g., methylurea, ethylene urea), sulfoneamide derivatives (e.g., compounds described in JP-B Nos. 1-40974 and 4-13701), polyol sorbitans, and polyethyelene glycols. Other thermal solvents usable in this invention include compounds described in U.S. Pat. Nos. 3,347,675, 3,438,776, 3,666,477 and 3,667,959; RD No. 17643; JP-A Nos. 51-19525, 53-24829, 53-60223, 58-118640, 58-198038, 59-68730, 59-84236, 59-229556, 60-14241, 60-191251, 60-232547, 61-52643, 62-42153, 62-44737, 62-78554, 62-146645, 62-139545, 63-53548, 63-161446; JP-A Nos. 1-224751, 1-227150, 2-863, 2–120739 and 2-123354. Further, examples of preferred thermal solvents are also compounds TS-1 through TS-21 described in JP-A 2-297548, page 8, upper left to page 9, upper left. The foregoing thermal solvents may be used in combination thereof.

In the photographic material and/or processing material, a base or its precursor is preferably used to promote silver development or dye forming reaction. Base precursors include, for example, a salt of an organic acid capable of decarboxylation on heating and a base and a compound capable of releasing amines through intramolecular nucleophilic substitution, Lossen rearrangement or Beckmann arrangement. Specific examples thereof are described in U.S. Pat. Nos. 4,514,493 and 4,657,848; "Kochigijutsu (Known Techniques) No. 5 (Mar. 22, 1991, published by Azutech Co.) page 55–86. There is also preferably employed a method for generating a base, in which a sparingly water-soluble basic metal compound is combined with a compound capable of forming a complex with the metal ion forming this basic metal compound (also called complexing compound) in water as medium. Such a method for generation a base is described in European Patent No. 210,660 and U.S. Pat. No. 4,740,445. In such a case, the sparingly water-soluble basic metal compound is incorporated to the photographic material and the compound capable of forming a complex with the metal ion forming the basic metal compound (also called complexing compound) is incorporated to the processing material. Such a constitution preferably enhances storage stability of the photographic material.

Processing Material

The processing material used in the thermal development relating to this invention, in addition to incorporating a base and/or its precursor described above, has functions of shielding from air during thermal development, preventing evaporation of material from the photographic material, supplying material used for processing other than the base to the photographic material or removing ingredients which is not needed after development (such as yellow filter dye and antihalation dye) or unwanted components produced during development. There may be incorporated a color developing agent and/or its precursor in the processing material. The processing material may have a function of de-silvering. For example, in cases where the exposed photographic material is superposed on the processing material to solubilize a part or all of silver halide and/or developed silver, a fixing agent, as a solvent for silver halide may be contained in the processing material.

The binder and support used in the processing material may be the same as used in the photographic material. The processing material may be added with a mordant for the purpose of remove dyes described above. There can be employed mordants commonly known in the photographic art. Examples thereof include those described in U.S. Pat. No. 4,500,626 col. 58–59, JP-A No.61-88256, page 32–41, JP-A Nos. 62-244043 and 244036. There may be used a dye-receptive polymer compounds described in U.S. Pat. No. 4,463,079. The foregoing thermal solvents may be contained.

The processing layer of the processing material may contain a base or its precursor. There may be used any one of organic bases and inorganic bases. Examples of the inorganic base include an alkali metal or alkaline earth metal hydroxide (e.g., potassium hydroxide, sodium hydroxide, lithium hydroxide, calcium hydroxide, magnesium hydroxide), phosphate (e.g., secondary and tertiary phosphates such as dipotassium hydrogen phosphate, disodium hydrogen phosphate, and ammonium sodium hydrogen phosphate), carbonate (e.g., potassium carbonate, sodium carbonate, sodium hydrogen carbonate, magnesium carbonate), borate (e.g., potassium borate, sodium borate, sodium metaborate); organic acid salts (potassium acetate, sodium acetate, potassium oxalate, sodium oxalate, potassium tartrate, sodium tartrate, sodium malate, sodium palmitate, sodium stearate); and alkali metal or alkaline earth metal acetylide, as described in JP-A No. 63-25208.

Examples of the organic base include ammonia, aliphatic or aromatic amines, such as primary amines (e.g., methylamine, ethylamine, butylamine, n-hexylamine, cyclohexylamine, 2-ethylhexylamine, allylamine, ethylenediamine, 1,4-diaminobutane, hexamethylenediamine, aniline, anisidine, p-toluidine, (-naphthylamine, m-phenylenediamine, 1,8-diaminonaphthalene, benzylamine, phenethylamine, ethanolamine), primary amines (e.g., dimethylamine, diethylamine, dibutylamine, diallylamine, N-methylaniline, N-methylbenzylamine, N-methylethanolamine, diethanolamine), tertiary amines (e.g., N-methylmorpholine, N-hydroxyethylmorpholine, N-methylpiperidine, N-ethylpiperidine, N-hydroxyethylpiperidine, N,N'-dimethylpiperadine, N,N'-dihyxyethylpiperadine, diazabicyclo[2,2,2]-octane, N,N-dimetylethanolamine, N,N-dimethylpropanolamine, N-methylethanolamine N-methyldipropanolamine, triethanolamine, N,N,N',N'-tetramethylethyelenediamine, N,N,N',N'-tetrahyroxyethylethylenediamine, N-methylpyrrolodine), polyamines (e.g., diethylenetriamine, triethylenetetramine, polyethylemeimine, polyallylamine, polyvinylbenzylamine, poly-(N,N-diethylaminoethyl methacrylate), poly-(N,N-dimethylvinylbenzylamine)), hydroxyamines (e.g., hydroxylamine, N-hydroxy-N-methylaniline), heterocyclic amines (e.g., pyridine, lutidine, imidazole, aminopyridine, N,N-dimethylaminopyridine, indole, quinoline, isoquinoline, poly-4-vinylpyridine, poly-2-vinylpyridine), amidines (e.g., monoamidines such as acetoamidine, imidazotane, 2-methylimidazole, 1,4,5,6-tetrahydropyrimidine, 2-methyl-1,4,5,6-tetrahydropyrimidine, 2-phenyl-1,4,5,6-tetrahydropyrimidine, iminopiperidine, diazabicyclononene, diazabicycloundedecene), bis, tris or tetraamidine guanines (e.g., water-soluble monguanines such as guanine, dimethylguanine, tetramethylguanine)2-aminoimidazoline, 2-amino-1,4,5-tetrahydropyrimidine), as described in JP-A No. 62-170954; water-insoluble mono or bisguanine, bis, tris or tetraguanidine, quaternary ammonium hydroxides (e.g., tetramethylammonium hydroxide, tetraethylammonium hydroxide, tetrabutylammonium hydroxidetrimehylbenzylammonium oxide, triocylmethylammonium oxide, methylpyridinium hydroxid), as described in JP-A No. 63-70845.

In cases when a complex-forming (or complexing) compound for a metal ion of a sparingly water-soluble basic compound is used for a base precursor, there can be used aminocarboxylic acids such as ethylenediaminetetraacetic acid, nitrilotriacetic acid, and diethylenetriaminepentaacetic acid or their salts;aminophosphonic acids and their salts; pyridylcarboxylic acids or their salts such as 2-picolinic acid, pyridine-2,6-dicarboxylic acid and 5-ethyl-2-picolinic acid; and iminodiacetic acids and their salts such as benzylimonodiacetic acid and α-picolyliminodiacetic acid. The complex-forming compound is used preferably in the form of a salt neutralized with an organic base such as guanidine or alkali metal. The base or its precursor is preferably incorporated in the processing material, in an amount of 0.1 to 20 g/m$^2$, and more preferably 0.5 to 10 g/m$^2$.

The base or its precursor may be incorporated in the photographic material. In cases where the sparingly water-soluble basic compound is incorporated in the photographic material, a metal hydroxide or metal oxide is preferably used, and zinc hydroxide and zinc oxide are specifically preferred.

In thermal development using the processing material, it is preferred to use a small amount of water (also denoted as aqueous medium) to promote development, transfer of processing ingredients or diffusion of unwanted material. Specifically, water is indispensable in cases when the sparingly water-soluble basic compound is used in combination with a complexing compound capable of forming a complex with the metal ion of the basic compound. The water may contain an inorganic alkali metal salt, an organic base, a low boiling solvent, a surfactant, an antifoggant, a compound capable of forming a complex with a sparingly water-soluble metal compound, an anti-mold or a fungicide. There may be usable any generally used water. Examples thereof include distilled water, tap water, well water and mineral water. In a thermal processing apparatus using the photographic material and processing material, water may be disposed of or repeatedly used by recycling. In the latter case, water containing ingredients leached out of the material is used. There may be used apparatuses or water described in JP-A Nos. 63-144354, 63-144355, 62-38460 and 3-210555. Water may be provided to the photographic material or processing material alone or to both of them. Water is provided in an amount of 1/10 to 30 (preferably 1/10 to 1) times the amount necessary to allow all layers of the photographic material and processing material other than their backing layers to maximally swell. Methods, for example, described in JP-A No. 62-253159, page 5 and JP-A No. 63-85544 are preferably employed to provide water. A solvent may be included in microcapsules. Alternatively, water may be includes, in a hydrate form, in the photographic material or the processing material, or both of them. The temperature of water to be provided is 30 to 60° C., as described in JP-A No. 63-85544.

Thermal Processing Apparatus

Commonly known heating means are applicable to thermally develop photographic materials relating to this invention. Examples thereof include a system of being brought into contact with a heated heat-block or face-heater, a system of being brought into contact with a heated roller or drum, a system of being brought into contact with an infrared or far-infrared lamp heater, a system of being allowed to pass through an atmosphere maintained at a high temperature and a system of using high frequency heating. Alternatively, a backing layer containing a heat-generating conductive layer, such as a carbon black layer is provided on the back side of the photographic material or processing material, in which Joule's heat produced by energization is employed to perform thermal development. There may also be employed a heating element described in JP-A No. 61-145544. Superposition of the photographic material on the processing material in which the light-sensitive layer faces the processing layer can be conducted in such a manner as described in JP-A No. 62-253159 and No. 61-147244, page 27. The heating temperature is preferably 43 to 100° C.

Commonly known thermal processing apparatuses are applicable to the color image forming method in this invention. Preferred examples thereof include apparatuses described in JP-A Nos. 59-75247, 59-177547, 59-181353, 60-18951, 62-25944, 6-130509, 6-95338, 6-95267, 8-29954and 8-29955. There are also commercially available apparatuses, such as Pictrostatt 100, Pictrostatt 200, Pictrostatt 300, Pictrostatt 330, Pictrostatt 50, Pictrography 3000 and Pictrography 2000 (all of which are available from Fuji Film Co. Ltd.).

Thermal Development, Desilvering and Fixing

In the color image forming method relating to this invention, a development-stopping agent, which is included in the processing element may be allowed to concurrently act with development. The development-stopping agent refers to a compound having the function of lowering the base concentration in the layer to inhibit development, immediately after completion of proper development, upon neutralization of or reaction with the base, or a compound capable of inhibiting development upon interaction with silver or a silver salt. Specific examples thereof include an acid precursor capable of releasing an acid upon heating, an electrophilic compound or one capable of causing substitution reaction with a co-existing base on heating, a nitrogen-containing compound, and a mercapto compound or its precursor. More specifically, these are described in JP-A No. 62-253159, page 31–32. Further, a combination in which a zinc salt of a mercaptocarboxylic acid, as described in JP-A No. 8-56062, is contained and a processing element in which the complexing compound described earlier is also advantageous. Similarly, a print-out preventing agent may be allowed to be included in the processing element and to concurrently display its function with development. Examples of the print-out preventing agent include monohalogen compounds described in JP-B No. 54-164, trihalogen compounds described in JP-A No. 53-46020, compounds containing a halogen attached to an aliphatic carbon atom, as described in JP-A No. 48-45228, and polyhalogen compounds as represented by a tetrabromoxylene, described in JP-B No. 57-8454. A development inhibitor such as 1-phenyl-5mercaptotetrazole is effective, as described in British patent No. 1,005,144. A viologen compound described in JP-A No. 8-184936 is also effective. The print-out preventing agent is preferably used in an amount of $1\times10^{-4}$ to 1 mol/mol Ag, and more preferably $1\times10^{-3}$ to $1\times10^{-1}$ mol/mol Ag.

In the thermal process relating to this invention, developed silver produced in thermal processing of the photographic material can be removed by allowing an oxidizing agent for silver, capable of acting as a bleaching agent for the developed silver to be included and to act simultaneously with or with a time lag for the development reaction. Alternatively, after completion of development to form images, a second material containing an oxidizing agent for silver is laminated with the photographic material to perform removal of developed silver.

Conventionally used silver bleaching agents are usable as a bleaching agent used in the processing material relating to this invention. Such bleaching agents are described in U.S. Pat. Nos. 1,315,464 and 1,946,640, and Photographic Chemistry Vol. 12, chapter 30, (Foundation Press, London, England). These bleaching agents effectively oxidize silver images to solubilize them. Examples of effective silver bleaching agents include an alkali metal dichromate and an alkali metal ferricyanide. Specifically, preferred silver bleaching agents are water-soluble, including, for example, ninhydrin, indanedione, hexaketosiloxane, 2,4-dinitrobenzoic acid, benzoquinone, benzenesulfonic acid and 2,5-dinitrobenzoic acid. There are also included metal complex salts such as a cyclohexyldialkylaminotetraacetic acid iron (III) salt, ethylenediaminetetraacetic acid iron (III) salt, and citric acid iron (III) salt. With regard to a binder, support and other additives used in the second processing material, the same materials as used in the processing material (first processing material) are usable.

The coating amount of the bleaching agent, which is variable depending on silver coverage of the photographic material to be superposed, is usually within the range of 0.01 to 10 mol, preferably 0.1 to 3 mol, and more preferably 0.1 to 2 mol per mol of silver coverage per unit area.

A compound having fixing capability may be contained in the processing material to remove silver halide which has become unnecessary after completion of image formation. Specific examples of such a system include one in which physical development nucleuses and a silver halide solvent are allowed to be included in the processing material, solubilizing silver halide in the photographic material during heating to fix it in the processing layer. The thus solubilized silver halide that has diffused from the photographic material is reduced on the physical development nucleuses to form physical-developed silver and is fixed in the processing layer. There are commonly known physical development nucleuses, including, for example, heavy metals such as zinc, mercury, lead, cadmium, iron, chromium, nickel, tin, cobalt, copper, and ruthenium, noble metals such as palladium, platinum, silver and gold, and colloidal particles of chalcogen compounds such as sulfur selenium and tellurium. These physical development nucleus materials can be obtained in such a manner that corresponding metal ions are reduced by reducing agents such as ascorbic acid, sodium borohydride and hydroquinone to form a metal colloidal dispersion, or a soluble sulfide, selenide, or the metal ions are mixed with telluride solution to form a colloidal dispersion comprised of water-insoluble metal sulfide, metal selenide or metal telluride. The dispersion is preferably formed in a hydrophilic binder such as gelatin. Preparation of colloidal silver particles is described in U.S. Pat. No. 2,688,601. Desalting may optionally be performed to remove excessive soluble salts, as is known in the silver halide emulsion making. The physical development nucleus size is preferably 2 to 200 nm. The physical development nucleuses are preferably contained in the processing layer, in an amount of $1\times10^{-3}$ to 100 mg/m$^2$, and more preferably $1\times10^{-2}$ to 10 mg/m$^2$. The physical development nucleuses are separately prepared and added into a coating solution. Alternatively, for example, silver nitrate and sodium sulfide, or gold chloride and a reducing agent are reacted in a solution containing a hydrophilic binder. Preferred examples of the physical development nucleus include silver, silver sulfide and palladium sulfide.

In cases when fixing silver halide in the foregoing system, it is necessary to allow a reducing agent capable of causing physical development to exist in the layer containing physical development nucleuses. A non-diffusible reducing agent needs to be incorporated into the layer. A diffusible reducing agent, however, may be incorporated in any layer of the photographic material and the processing material. As a reducing agent having such a function are used the auxiliary developing agent described earlier. Alternatively, silver halide may be fixed without using the physical development nucleuses or a reducing agent. Thus, using so-called silver halide solvents, salt displacement is performed with respect to a silver ion to form a light-insensitive silver salt.

In any cases described above, commonly known silver halide solvents are usable, such as compounds generally known as a silver solvent or a fixing agent. Examples thereof include a thiosulfate, sulfite, thiocyanate, thioether compound such as 1,8-di-3,6-dithiaoctane or2,2'-thiodiethanol, 6,9-dioxa3,12-dithiatetradecane-1,14-diol, 5- or 6-membered imido-ring containing compound such as uracil or hydantoin, as described in JP-A No. 8-179458, mercapto compound, thiouracils, nitrogen-containing heterocyclic compounds having a sulfide group, as described in JP-A No. 4-365037, page 11–21, and compounds represented by general formula (1) described in JP-A No. 53-144319. There are usable trimethyltriazolium thiolate or meso-ion thiolate compound, described in Analytica Chemica Acta, vol. 248, page 604–614 (1991). A compound capable of fixing silver halide to perform stabilization thereof, as described in JP-A No. 8-69097 is also usable as a silver halide solvent. Further, a fixing agent soluble at a temperature different from that of development is usable, as described in U.S. Pat. No. 2002/9678. These silver halide solvents may be used in combination thereof. Of the foregoing compounds, a sulfite, and a 5- or 6-membered imido-ring containing compound such as uracils or hydantoins are preferred. Specifically, incorporating the uracils or hydantoins in the form of a potassium salt preferably improves lowering in glossiness after raw stock keeping of the processing material.

The total content of the silver halide solvent in the processing layer is preferably 0.01 to 100 mmol/$m^2$, more preferably 0.1 to 50 mmol/$m^2$, and still more preferably 1 to 30 mmol/$m^2$. The molar ratio to silver coverage of the photographic material preferably is 1/20 to 20, more preferably 1/10 to 10, and still more preferably 1/3 to 3. The silver halide solvent may be added to a coating solution, through solution in a solvent such as water, methanol, ethanol, acetone, dimethylformamide, or methyl propyl glycol or in an aqueous alkali or acid, or in the form of a solid particle dispersion.

The processing material preferably has at least one timing layer. The timing layer aims to retard a bleaching or fixing reaction until substantial completion of the intended reaction between the silver halide and a developing agent, followed by reaction with a coupler. The timing layer may be comprised of gelatin, polyvinyl alcohol, or poly[(vinyl alcohol)-co-(vinyl acetate)]. This layer may be a barrier timing layer, as described in U.S. Pat. Nos. 4,056,394 and 4,061,496.

In the color image forming method relating to this invention, at least two processing materials having separated functions, such as a first processing material to perform color development and a second processing material to perform bleaching and/or fixing can be successively superposed on the photographic material to achieve thermal processing. In this case, it is preferred that the processing material to perform color development does not contain the compound capable of bleaching and/or fixing, as described above. The photographic material is superposed onto the first processing material to perform thermal development, followed by being superposed on the second processing material to perform bleaching so as to cause the light-sensitive layer of the photographic material to face the processing layer of the second processing material. In this case, water is provided to the photographic material or the processing material in an amount of 0.1 to 30 times the amount necessary to swell the total layers of the photographic material and processing material other than the backing layers. Such a state is subjected to heating at a temperature of 40 to 100° C. for a period of 5 to 60 sec. to conduct bleaching and fixing treatments. The amount or kind of water, the method of providing water and method for superposing the photographic material onto the processing material are applicable, similarly to that of the processing material to perform development.

To employ photographic material, after being processed, for the purpose of storage or visual appreciation over a long period of time, it is preferred to subject the photographic material to at least one treatment selected from a process to remove silver halide, such as the foregoing bleaching or fixing, and a process to remove light-insensitive silver compound. Herein, the light-insensitive silver compound refers to developed silver, colloidal silver or organic silver salt. In cases when the photographic material, after being processed, is read by a scanner for conversion to electronic images, the bleaching or fixing process is not necessarily required. However, it is preferred to conduct the fixing process. Further, in cases where the processed color negative film is returned to a customer as a recording medium, as described in U.S. Pat. No. 2002/18944, WO Nos. 01/96943, 01/96945 and 01/96947, images of the thermally developed photographic material are read by a scanner and it is preferred that the images, after being bleached or fixed, be again read by the scanner. This is because remaining silver halide, which has an absorption within the visible wavelength region and becomes a noise source at the time of being read by a scanner, adversely affecting the obtained electronic images. To achieve a simplified process by conducting development alone without fixing, it is preferred to use thin tabular silver halide grains or silver chloride grains. It is also preferred to employ a low silver photographic material having a silver coverage of 0.1 to 4.5 g/$m^2$, as described in U.S. Pat. No. 2002/12887. Further, it is also preferred to employ photographic material containing substantially no colored coupler.

Other Material

In the photographic material or processing material relating to this invention, various surfactants can be used for the purpose of coating aid, improvements in peeling or lubrication, antistatic agent or development acceleration. Specific examples of the surfactants are described in "Kochigijutsu (Known Techniques) No. 5 (Mar. 22, 1991, published by Azutech Co.) page 136–138, and JP-A Nos. 62-173463 and 62-183457. The photographic material may be added with an organic fluoro-compound. Representative examples of the organic fluoro-compound include fluorinated surfactants described in JP-B No. 57-9053, 8–17 columns and JP-A Nos. 61-20944 and 62-135826; oily fluorine containing compounds such as fluorinated oil, and solid fluororesin such as tetrafluoroethylene.

The photographic material and processing material preferably exhibit lubrication. Lubricants are contained in both sides of the light-sensitive layer and backing layer. The expression, preferably exhibiting lubrication means exhibiting a dynamic friction coefficient of 0.01 to 0.25. The dynamic friction coefficient is determined in terms of a value obtained when transported on stainless steel balls of 5 mm diameter at a speed of 60 cm/min (in an atmosphere of 25° C. and 60% RH). Examples of preferred lubricants include a polyorganosiloxane, higher fatty acid amide, and ester of higher fatty acid and higher alcohol. Specific examples of the polyorganosiloxane include polydimethylsiloxane, polydiethylsiloxane, polystyrylmethylsiloxane and polymethylphenylsiloxane. Of these, polymethylsiloxane and a long chain alkyl group containing ester are specifically preferred. The lubricant is preferably incorporated into the outermost layer on the emulsion layer side or the backing layer.

The photographic material or processing material relating to this invention preferably contains an antistatic agent.

Examples of the antistatic agent include a carboxylic acid or carboxylate, a sulfonate-containing polymer, a cationic polymer and ionic surfactant compounds. The preferred antistatic agent is at least one selected from ZnO. $TiO_2$, $SnO_2$, $Al_2O_3$, $In_2O_3$, $SiO_2$, MgO, BaO, $MoO_3$, and $V_2O_5$. Specifically preferred are fine particulate crystalline metal oxide or its composite oxide (of Sb, P, B, In, S, Si, C) exhibiting a volume resistance of not more than $10^7$ Ω·cm, and more preferably not more than $10^5$ Ω·cm and having a particle size of 0.001 to 1.0 μm. The antistatic agent is incorporated in the photographic material, preferably in an amount of 5 to 500 mg/m$^2$, and more preferably 10 to 350 mg/m$^2$. The ratio of such a conductive crystalline oxide or its composite oxide to a binder preferably is within the range of 1:300 to 100:1, and more preferably 1:100 to 100:5.

In the constitution of the photographic material and processing material, it is preferred to allow various polymer latexes to be included for the purpose of improving physical properties of the layer, such as dimensional stability, anti-curling, and prevention of adhesion, cracking, or pressure sensitization or desensitization. Specific examples of a polymer latex usable in this invention include those described in JP-A Nos. 62-245258, 62-136648 and 62-110066. Specifically, incorporation of a polymer latex exhibiting a relatively low glass transition point (for example, not higher than 40° C.) in the mordant layer prevents cracking of the layer. On the other hand, the use of a polymer latex exhibiting a relatively high glass transition point in the back layer results in curl prevention.

The photographic material or the processing material preferably contains a matting agent. The matting agent may be incorporated in any of the emulsion layer side and the back layer side and preferably in the outermost layer of the emulsion layer side. The matting agent may be one soluble in processing solution or an insoluble one, while the combined use thereof is preferred. For example, particulate poly(methyl methacrylate), particulate poly(methyl methacrylate/methacrylic acid=9/1 or 5/5 in molar ratio) and particulate polystyrene are preferred. The particle size of the matting agent preferably is 0.8 to 10 μm. A narrow particle size distribution is preferred, and at least 90% of the total particle number preferably falling within the range of 0.9 to 1.1 times of the mean particle size. Examples thereof include polymethyl methacrylate (0.2 μm), poly(methyl methacrylate/methacrylic acid=9/1 in molar ratio, 0.3 μm), and polystyrene (0.25 μm). Other specific examples thereof are described in JP-A No. 61-88256, at page 29. Further are usable compounds described in JP-A Nos. 63-274944 and 63-274952, such as benzoguanamine resin beads, polycarbonate resin beads and ABS resin beads. There are also usable compounds selected from those referred to in the Research Disclosure described earlier.

Film Form

Next, description will be given of a film cartridge used for packing photographic material. The main material of the film cartridge used in this invention may be metal or synthetic plastic. Examples of preferred plastic material include polystyrene, polyethylene, polypropylene, and polyphenyl ether. The cartridge material may contain various antistatic agents. Preferred antistatic agent include carbon black, metal oxide particles, nonionic, anionic, cationic or betaine type surfactants and polymer particles. The thus antistatic cartridge is described, for example, in JP-A Nos. 1-312537 and 1-312538. The resistance at 25° C. and 25% RH preferably is not more than $10^{12}$ Ω. The plastic cartridge is usually prepared by using plastic mixed with carbon black or pigments, which serves for light-shielding. The cartridge may be a 135-size. Down-sizing the 25 mm diameter of the 135 mm size cartridge to 22 mm or less is effective to perform miniaturization of the camera. The internal volume of the cartridge is to be not more than 30 cm$^3$, and preferably not more than 25 cm$^3$. The weight of the cartridge preferably is 5 to 15 g. There is usable a cartridge, in which film is advanced by rotating a spool. A cartridge is also usable, in which the top of the film which is housed inside of the cartridge is advanced by rotating the spool axis in the direction of advancing the film. Cartridges having such a structure are described in U.S. Pat. Nos. 4,834,306 and 5,226,613.

The photographic material relating to this invention may also be packed in a commercially available lens-fitted film package. For examples the photographic material can be packed in a lens-fitted film package described in Japanese Patent Application No. 10-158427, and JP-A Nos. 11-352564 and 2000-19607.

On the outer portion of the film cartridge or lens-fitted film package, the applicable process is previously denoted, for example, such as "For Use in Thermal Processing" or an indication of the processing fee being previously deposited is specified.

In this invention, waste material or waste liquid produced in the processing stage can be recovered as a resource. Specifically, in the case of obtaining digital image information by reading the processed photographic material using a scanner, efficient resource recovery from the photographic material can be achieved. In this case, almost the total amounts of silver compounds incorporated in the photographic material can be recovered, which is best for environmental friendliness and the reuse of expensive raw materials.

Exposure Method

In cases where the photographic material relating to this invention is used as camera material, it is popular that scenes or people are directly photographed using a camera. The foregoing case of photographic material being packed in a lens-fitted film package is included in this. Further, the photographic material is employed in exposure of reversal film or negative film using a printer or an enlarger; scanning exposure of an original picture through a slit using an exposure apparatus of a copying machine; scanning exposure by allowing a light-emitting diode or various laser (e.g., laser diode, gas laser) to emit via image information and electric signals (as described in JP-A Nos. 2-129625, 5-176144, 5-199372, 6-127021); and direct exposure or exposure through an optical system outputting image information on an image displaying device such as a CRT, liquid crystal display, electroluminescence display or plasma display.

Examples of a light source used for recording images on the photographic material include natural light, tungsten lamp, light-emitting diode, laser light source, CRT light source, and light sources described in U.S. Pat. No. 4,500,626 and JP-A Nos. 2-53378 and 2-54672. There is also feasible imagewise exposure using a wavelength conversion element combining non-linear optical material and a coherent light source such as laser light. The non-linear optical material refers to material capable of displaying non-linearity of an electric field and depolarization produced when a strong light electric field such as laser light is given. Examples thereof include inorganic compounds such as lithium niobate, potassium dihydrogen phosphate (KDP), lithium iodate, and $BaB_2O_4$, urea derivatives, nitroaniline derivatives, nitropyridine-N-oxide derivatives such as 3-methyl-4-nitropyridine-n-oxide (POM), and compounds described in JP-A Nos. 61-53462 and 62-210432. Wavelength conversion elements known in the art include a single crystal light guide type and a fiber type, both of which are useful.

As the image information described above are employed image signals obtained by a video camera or electronic still camera, television signals such as Japanese television signal standard (NTSC), image signals obtained by dividing an original picture into a large number of picture elements and images produced by using a computer, such as CG and CAD.

Scanner Read-In

In this invention, obtained images can be read using a scanner and transformed to electronic image information. The scanner refers to a device in which photographic material is optically scanned to convert the reflection or transmission density to image information. It is typical to scan an intended portion of photographic material by moving the optical portion of the scanner in a direction different from the moving direction of the photographic material. Alternatively, the photographic material may be fixed, while moving only the optical portion of the scanner, or the optical portion may be fixed, while moving only the photographic material. The combinations thereof are also feasible.

To read image information of photographic material, it is preferred to determine the amount of reflection or transmission light by overall exposure or slit scanning exposure of light having wavelengths corresponding to the respective absorptions of at least three dyes. In this case, it is preferred to use diffused light rather than collimated light to remove information due to a matting agent or flaws in the film. It is also preferred to use a semiconductor image sensor (e.g., area-type CCD, CCD line-sensor) in the light receiving section. Image formation, as described in U.S. Pat. Nos. 5,465,155, 5,519,510 and 5,988,896 is also feasible, in which developed silver images or infrared dye images formed in photographic material are detected with infrared light to form images. U.S. Pat. Nos. 2001/31144, 2001/52932 and 2001/43812 disclose imaging by the combination of images read by the respective visible and infrared scanners.

In one preferred embodiment of this invention is employed red light, i.e., visual red light and infrared light of wavelengths of 600 nm or longer.

The thus obtained image data can be visualized using various image display devices. Any image display device is usable, including a color or monochromatic CRT, liquid crystal display, plasma emission display and EL display.

The thus read image signal is outputted to form an image on a recording material. Not only silver halide photographic material but also other material are employed to output images. There are also employed various hard copying devices to output images, including an ink-jet system, sublimation type thermal transfer system, electrophotography system, Cycolor system, thermoautochrome system, a system of exposure onto silver halide color paper and silver halide photothermographic system. Any one of the foregoing can display the effects of this invention.

The main intent of this invention is to incorporate image information obtained by development as digital data and photographing information may be optically outputted onto print material such as photographic color print paper in accordance with the conventional manner.

EXAMPLES

The present invention will be described based on examples but embodiments of the invention are by no means limited to these.

Example 1

Preparation of Tabular Seed Emulsion (T-A)

Tabular seed emulsion T-A was prepared according to the following procedure.

Nucleation Process

A 28.8 lit. aqueous solution containing 162.8 g of oxidized gelatin A (methionine content of 0.3 μmol/g) and 23.6 g of potassium bromide was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01 and X-01 were added by double jet addition in one minute to perform nucleation and then, solution G-01 was further added thereto.

| | |
|---|---|
| S-01 Solution: | 205.7 ml of 1.25 mol/l aqueous silver nitrate solution, |
| X-01 Solution: | 205.7 ml of 1.25 mol/l aqueous potassium bromide solution, |
| G-01 Solution: | 2921 ml of aqueous solution containing 120.5 g of gelatin A and 8.8 ml of a 10% methanol solution of surfactant (A). |
| Surfactant A: | $HO(CH_2CH_2O)m[CH(CH_3)CH_2O]_2O(CH_2CH_2O)nH$ (m + n = 10) |

Ripening Process

After completion of the nucleation process, the temperature was raised to 60° C. in 45 min. and then, the pAg was adjusted to 9.0. Then, the reaction mixture was added with 224.4 ml of an aqueous solution containing 29.2 g of ammonia and 709.3 ml of an aqueous potassium hydroxide solution, and after being maintained for 6 min. 30 sec., the pH was adjusted to 6.1 using aqueous 56% acetic acid solution.

Growth Process

After completion of the ripening process, solutions S-02 and X-02 were added by double jet addition at an accelerated flow rate (five times faster at the end than at the start) over a period of 20 min., while maintaining the pAg at 9.0

| | |
|---|---|
| S-02 Solution: | 2620 ml of 1.25 mol/l aqueous silver nitrate solution, |
| X-01 Solution: | 2620 ml of 1.25 mol/l aqueous potassium bromide solution. |

After completion of addition of respective solutions, the resulting emulsion was desalted by the convention washing method, and alkali-processed inert gelatin B (methinine content of 50.0 μmol/g) was added thereto and dispersed. The thus obtained emulsion was denoted as seed emulsion T-A.

Preparation of Tabular Silver Halide Grain Emulsion Em-1

Subsequently, the foregoing tabular seed emulsion T-A was grown in accordance with the following procedure to prepare tabular grain emulsion Em-1, in which the mixing stirrer, as described in JP-A No. 62-160128 was used, and to remove soluble components from the reaction mixture by means of ultrafiltration was employed an apparatus described in JP-A No. 10-339923. Thus, to an aqueous 1% gelatin solution containing 0.123 mol. equivalent tabular seed emulsion T-A and 0.65 ml of a 10% methanol solution of the foregoing surfactant A, water and gelatin B were added to make 10 lit., then, the following solutions S-11 and X-11 were added by double jet addition at an accelerated flow rate (11 times faster at the end than at the start) over a period of 80 min., while soluble components in the reaction mixture were removed by ultrafiltration to maintain the reaction mixture at a constant volume.

| | |
|---|---|
| S-11 Solution: | 2432 ml of 1.75 mol/1 aqueous silver nitrate solution, |
| X-11 Solution: | 2432 ml of 1.741 mol/l potassium bromide and 0.009 mol/l potassium iodide aqueous solution. |

The reaction mixture was further subjected to ultrafiltration over a period of 30 min. to remove 4.0 lit. of soluble components from the reaction mixture. Thereafter, the following solution S-12 was added thereto at a decreasing flow rate (0.28 time from start to finish) over a period of 17 min., followed by adjusting the pAg to 8.6.

| | |
|---|---|
| S-12 Solution: | 323 ml of 1.75 mol/l aqueous silver nitrate solution |

Subsequently, solutions I-11 and Z-11 were added and after adjusting to a pH of 9.3 and being maintained for 6 min., the pH was adjusted to 5.0 with an aqueous acetic acid solution and the pAg was adjusted to 9.4 with an aqueous potassium bromide solution:

| | |
|---|---|
| I-11 Solution: | aqueous solution containing 64.1 g of sodium p-iodoacetoamidobenzenesulfonate, |
| Z-11 Solution: | aqueous solution containing 22.2 g of sodium sulfite. |

Then, the following solutions S-13 and X-13 were added at an accelerated flow rate (2.3 times faster at the end than at the start) over a period of 15 min, while soluble components in the reaction mixture were removed by ultrafiltration to maintain the reaction mixture at a constant volume.

| | |
|---|---|
| S-13 Solution: | 363 ml of aqueous 1.75 mol/l silver nitrate solution, |
| X-13 Solution: | 509 ml of aqueous 1.663 mol/l potassium bromide and 0.088 mol/l potassium iodide solution. |

Thereafter, the following solution S-14 was added thereto at a decreasing rate (0.28 time from start to finish) over a period of 15 min., followed by adjusting the pAg to 8.4.

| | |
|---|---|
| S-14 Solution: | 242 ml of 1.75 mol/l aqueous silver nitrate solution |

Subsequently, after adding the following solution M-11, the following solutions S-15 and X-15 were added by double jet addition at an accelerated flow rate (1.03 times fast at the end than at the start) over a period of 24 min., followed by adjusting the pAg to 9.4 with an aqueous potassium bromide solution. Then, the following solutions S-16 and X-16 were added by double jet addition at an accelerated flow rate (1.33 times fast at the end than at the start) over a period of 17 min.

| | |
|---|---|
| M-11 solution: | aqueous solution containing 88.2 mg of potassium hexacyanoruthenate |
| S-15 Solution: | 202 ml of aqueous 1.75 mol/l silver nitrate solution, |
| X-15 Solution: | 202 ml of aqueous 1.663 mol/l potassium bromide and 0.088 mol/l potassium iodide solution. |
| S-16 Solution: | 404 ml of aqueous 1.75 mol/l silver nitrate solution, |
| X-16 Solution: | 404 ml of aqueous 1.75 mol/l potassium bromide solution. |

After completion of addition, aqueous solution containing 120 g of chemically modified gelatin (in which the amino group was phenylcarbamoyled at a modification percentage of 95%) was added to perform desalting and washing, and then gelatin was further added and dispersed, followed by adjusting the pH and pAg to 5.8 and 8.9, respectively, at 40° C.

Tabular silver halide grain emulsion Em-1 was thus obtained. Analysis of emulsion Em-1 revealed that 73% of the total grain projection area was accounted for by tabular grains having an average aspect ratio of 12 and an average equivalent circle diameter of 2.67 $\mu$m. A variation coefficient of equivalent circle diameter of total grains was 28.0%. It was further proved that 82% by number of the grains was accounted for by tabular grains having dislocation lines of 30 or more in fringe portions of the grain.

Preparation of Tabular Seed Emulsion (T-B)

Tabular seed emulsion T-B was prepared according to the following procedure.

Nucleation Process

A 28.8 lit. aqueous solution containing 162.8 g of low molecular weight gelatin ( mean molecular weight of 15,000, methionine content of 0.3 $\mu$mol/g) and 23.6 g of potassium bromide was maintained at 15° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S'-01 and X'-01 were added by double jet addition in one minute to perform nucleation and then, solution G'-01 was further added thereto.

| | |
|---|---|
| S'-01 Solution: | 205.7 ml of 1.25 mol/l aqueous silver nitrate solution, |
| X'-01 Solution: | 205.7 ml of 1.25 mol/l aqueous potassium bromide solution, |
| G'-01 Solution: | 2921 ml of aqueous solution containing 120.5 g of alkali-processed inert gelatin A (mean molecular weight of 100,000) and 8.8 ml of a 10% methanol solution of surfactant (A). |

Ripening Process

After completion of the nucleation process, the temperature was raised to 60° C. in 45 min. and then, the pAg was adjusted to 9.2. Then, the reaction mixture was adjusted to a pH of 9.3 by adding a 0.136 M aqueous ammonia solution and an aqueous potassium hydroxide solution, and after being maintained for 6 min., the pH was adjusted to 6.1.

Growth Process

After completion of the ripening process, solutions S'-02 and X'-02 were added by double jet addition at an accelerated flow rate (five times faster at the end than at the start) over a period of 20 min., while maintaining the pAg at 9.2

| | |
|---|---|
| S'-02 Solution: | 2620 ml of 1.25 mol/l aqueous silver nitrate solution, |
| X'-02 Solution: | 2620 ml of 1.25 mol/l aqueous potassium bromide solution. |

After completion of addition of respective solutions, the resulting emulsion was desalted by the convention washing method, and gelatin was added thereto and dispersed. The thus obtained emulsion was denoted as seed emulsion T-b, which was comprised of tabular seed grains having an average aspect ratio of 12.4, an average equivalent circle diameter of 0.67 μm and a variation coefficient of equivalent circle diameter of 15.1%.

Preparation of Tabular Silver Halide Grain Emulsion Em-7

Subsequently, the foregoing tabular seed emulsion 1 was grown in accordance with the following procedure to prepare tabular silver halide grain emulsion Em-7. Thus, to a 10 lit. aqueous 1% gelatin solution containing 0.21 mol. equivalent tabular seed emulsion (B) and 1.0 ml of a 10% methanol solution of surfactant (A), the following solutions S'-11 and X'-11 were added by double jet addition at an accelerated flow rate (10 times faster at the end than at the start) to form silver halide phase A, while being maintained at a temperature of 60° C. and a pAg of 9.4.

| | |
|---|---|
| S'-11 Solution: | 2059 ml of 3.5 mol/l aqueous silver nitrate solution, |
| X'-11 Solution: | 2059 ml of 3.45 mol/l potassium bromide and 0.05 mol/l potassium iodide aqueous solution. |

Subsequently, solutions I'-11 and Z'-11 were added and after adjusting to a pH of 9.3 and being maintained for 6 min., the pH was adjusted to 5.0 with an aqueous acetic acid solution and the pAg was adjusted to 9.7 with an aqueous potassium bromide solution. Then, solutions S'-12 and X'-12 were added at an accelerated flow rate (2.2 times faster at the end than at the start).

| | |
|---|---|
| I'-11 Solution: | aqueous solution containing 57.7 g of sodium p-iodoacetoamidobenzenesulfonate, |
| Z'-11 Solution: | aqueous solution containing 20.0 g of sodium sulfite, |
| S'-12 Solution: | 726 ml of aqueous 3.5 mol/l silver nitrate, |
| X'-12 Solution: | 726 ml of aqueous solution containing 3.15 mol/l potassium bromide and 0.35 mol/l potassium iodide. |

Further, solutions S'-13 and X'-13 were added at an accelerated flow rate (1.4 times faster at the end than at the start).

| | |
|---|---|
| S'-13 Solution: | 509 ml of aqueous 1.25 mol/l silver nitrate solution, |
| X'-13 Solution: | 509 ml of aqueous 1.25 mol/l potassium bromide solution. |

After completion of addition, the resulting emulsion was desalted by the method described in JP-A 5-72658, and after adding gelatin and dispersing, the pH and pAg were adjusted to 5.8 and 8.1 at 40° C., respectively.

Tabular silver halide grain emulsion Em-7 was thus obtained. Analysis of emulsion Em-7 revealed that the emulsion was comprised of tabular grains having an average aspect ratio of 7.2, an average equivalent circle diameter of 2.37 μm, a variation coefficient of equivalent circle diameter of 21.0% and an average surface iodide content of 9.1 mol %. It was further proved from electron microscopic observation that 79% by number of the grains was accounted for by tabular grains having at least 10 dislocation lines in edge portions of the grain.

Preparation of Tabular Silver Halide Grain Emulsion Em-8

The foregoing tabular seed emulsion 1 was subsequently grown in accordance with the following procedure to prepare tabular grain emulsion Em-8. Thus, to a 24 lit. aqueous 1% gelatin (oxidized gelatin having a methionine content of 9 μmol/g) solution containing 0.21 mol. equivalent tabular seed emulsion (B) and 1.0 ml of a 10% methanol solution of surfactant (A), the following solutions S'-11 and X'-11 were added by double jet addition at an accelerated flow rate (10 times faster at the end than at the start), while being maintained at a temperature of 60° C. and a pAg of 9.2.

| | |
|---|---|
| S'-11 Solution: | 2059 ml of 3.5 mol/l aqueous silver nitrate solution, |
| X'-11 Solution: | 2059 ml of 3.45 mol/l potassium bromide and 0.05 mol/l potassium iodide aqueous solution. |

Subsequently, solutions I'-11 and Z'-11 were added by double jet addition at an accelerated flow rate (2.2 times faster at the end than at the start), while being maintained at a pAg of 9.6. Prior to addition of solution S'-12, an aqueous solution containing $1.1\times10^{-2}$ mol of 2-methylimidazole was added.

| | |
|---|---|
| S'-12 Solution: | 726 ml of aqueous 3.5 mol/l silver nitrate, |
| X'-12 Solution: | 726 ml of aqueous solution containing 3.15 mol/l potassium bromide and 0.35 mol/l potassium iodide. |

After adjusting to a pH of 9.2 by a 0.136 M aqueous ammonia solution and an aqueous potassium hydroxide solution, and after being maintained for 10 min., the pH was adjusted to 5.0 with an aqueous acetic acid solution and a solution in an amount equivalent to the aqueous ammonia solution, potassium hydroxide solution and acetic solution was removed by ultrafiltration. Then, solutions S'-13 and X'-13 were added at an accelerated flow rate (1.4 times faster at the end than at the start).

| | |
|---|---|
| S'-13 Solution: | 509 ml of aqueous 1.25 mol/l silver nitrate, |
| X'-13 Solution: | 509 ml of aqueous solution containing 1.25 mol/l potassium bromide |

During addition of solutions S'-11 and X'-11, solutions S'-12 and X'-12, and solutions S'-13 and X'-13, the reaction mixture solution was concentrated by the ultrafiltration, using the apparatus described in JP-A 10-339923.

After completion of addition, the resulting emulsion was desalted by the method described in JP-A 5-72658, and after adding gelatin and dispersing, the pH and pAg were adjusted to 5.8 and 8.1 at 40° C., respectively.

Tabular silver halide grain emulsion Em-8 was thus obtained. Analysis of emulsion Em-8 revealed that the emulsion was comprised of tabular grains having an average aspect ratio of 17.6, an average equivalent circle diameter of 3.28 $\mu$m, a variation coefficient of equivalent circle diameter of 23.8% and an average surface iodide content of 8.9 mol %. It was proved that total grains analyzed (200 grains) all had a iodide content of less than 3 mol % in the vicinity of corners of the grain. It was further proved from electron microscopic observation the 200 grains that 82% by number of the grains was accounted for by tabular grains having at least 10 dislocation lines in edge portions of the grain.

Preparation of Tabular Silver Halide Grain Emulsion Em-9

Tabular silver halide grain emulsion Em-9 was prepared similarly to the foregoing emulsion Em-8, except that the epitaxial growth phase was formed according to the following procedure. Thus, After adding solutions S'-13 and X'-13, solutions S'-14 and X'-14 were added at an accelerated flow rate (1.5 times faster at the end than at the start).

| | |
|---|---|
| S'-14 Solution: | 530 ml of aqueous 1.00 mol/l silver nitrate, |
| X'-14 Solution: | 530 ml of aqueous solution containing 1.00 mol/l potassium bromide |

Tabular silver halide grain emulsion Em-9 was thus obtained. Analysis of emulsion Em-9 revealed that the emulsion was comprised of tabular grains having an average aspect ratio of 20.2, an average equivalent circle diameter of 3.22 $\mu$m, a variation coefficient of equivalent circle diameter of 24.1% and an average surface iodide content of 8.3 mol %. It was proved that total grains analyzed (200 grains) all had a iodide content of less than 3 mol % in the vicinity of corners of the grain. It was confirmed from electron microscopic observation that protruded epitaxial growth phases localized near edges of the tabular grain. It was further proved from electron microscopic observation that 12% by number of the grains was accounted for by tabular grains having at least 10 dislocation lines in edge portions of the grain.

Preparation of Silver Halide Color Photographic Material Preparation of Sample 101

On a 120 $\mu$m thick, subbed polyethyleneterephthalate film support, the following layers having composition as shown below were formed to prepare a multi-layered color photographic material sample 101. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| | |
|---|---|
| **1st Layer: Anti-Halation Layer** | |
| Black colloidal silver | 0.16 |
| UV-1 | 0.30 |
| CM-1 | 0.12 |
| OIL-1 | 0.24 |
| Gelatin | 1.33 |
| **2nd Layer: Interlayer** | |
| Silver iodobromide emulsion i | 0.06 |
| AS-1 | 0.12 |
| OIL-1 | 0.15 |
| Gelatin | 0.67 |
| **3rd Layer: Low-speed Red-Sensitive Layer** | |
| Silver iodobromide emulsion h | 0.39 |
| Silver iodobromide emulsion e | 0.32 |
| SD-1 | $2.22 \times 10^{-4}$ |
| SD-2 | $3.72 \times 10^{-5}$ |
| SD-3 | $1.56 \times 10^{-4}$ |
| SD-4 | $3.41 \times 10^{-4}$ |
| C-1 | 0.77 |
| CC-1 | 0.006 |
| OIL-2 | 0.47 |
| AS-2 | 0.002 |
| Gelatin | 1.79 |
| **4th Layer: Medium-speed Red-sensitive Layer** | |
| Silver iodobromide emulsion b | 0.83 |
| Silver iodobromide emulsion h | 0.36 |
| SD-12 | $1.60 \times 10^{-5}$ |
| SD-13 | $2.40 \times 10^{-4}$ |
| SD-1 | $4.80 \times 10^{-4}$ |
| C-1 | 0.42 |
| CC-1 | 0.072 |
| DI-1 | 0.046 |
| OIL-2 | 0.27 |
| AS-2 | 0.003 |
| Gelatin | 1.45 |
| **5th Layer: High-speed Red-Sensitive Layer** | |
| Silver iodobromide emulsion a | 1.45 |
| Silver iodobromide emulsion e | 0.076 |
| SD-12 | $7.10 \times 10^{-6}$ |
| SD-13 | $1.10 \times 10^{-4}$ |
| SD-1 | $2.10 \times 10^{-4}$ |
| C-2 | 0.10 |
| C-3 | 0.17 |
| CC-1 | 0.013 |
| DI-4 | 0.024 |
| DI-5 | 0.022 |
| OIL-2 | 0.17 |
| AS-2 | 0.004 |
| Gelatin | 1.40 |
| **6th Layer: Interlayer** | |
| Y-1 | 0.095 |
| AS-1 | 0.11 |
| OIL-1 | 0.17 |
| X-2 | 0.005 |
| Gelatin | 1.00 |

-continued

| 7th Layer: Low-speed Green-Sensitive Layer | |
|---|---|
| Silver iodobromide emulsion h | 0.32 |
| Silver iodobromide emulsion e | 0.11 |
| SD-5 | $3.24 \times 10^{-5}$ |
| SD-6 | $5.21 \times 10^{-4}$ |
| SD-7 | $1.25 \times 10^{-4}$ |
| SD-8 | $1.59 \times 10^{-4}$ |
| M-1 | 0.375 |
| CM-1 | 0.042 |
| DI-2 | 0.010 |
| OIL-1 | 0.41 |
| AS-2 | 0.002 |
| AS-3 | 0.11 |
| Gelatin | 1.24 |
| **8th Layer: Medium-speed Green-Sensitive Layer** | |
| Silver iodobromide emulsion b | 0.66 |
| Silver iodobromide emulsion h | 0.11 |
| SD-5 | $2.14 \times 10^{-4}$ |
| SD-6 | $3.44 \times 10^{-4}$ |
| SD-7 | $1.73 \times 10^{-4}$ |
| SD-8 | $1.05 \times 10^{-4}$ |
| M-1 | 0.151 |
| CM-1 | 0.042 |
| CM-2 | 0.044 |
| DI-2 | 0.026 |
| DI-3 | 0.003 |
| OIL-1 | 0.27 |
| AS-3 | 0.046 |
| AS-4 | 0.006 |
| Gelatin | 1.22 |
| **9th Layer: High-speed Green-Sensitive Layer** | |
| Emulsion Em-1 | 1.24 |
| Silver iodobromide emulsion e | 0.066 |
| SD-5 | $2.12 \times 10^{-5}$ |
| SD-6 | $3.42 \times 10^{-4}$ |
| SD-8 | $1.04 \times 10^{-4}$ |
| M-1 | 0.038 |
| M-2 | 0.078 |
| CM-2 | 0.010 |
| DI-3 | 0.003 |
| OIL-1 | 0.22 |
| AS-2 | 0.007 |
| AS-3 | 0.035 |
| Gelatin | 1.38 |
| **10th Layer: Yellow Filter Layer** | |
| Yellow colloidal silver | 0.053 |
| AS-1 | 0.15 |
| OIL-1 | 0.18 |
| **11th Layer: Low-speed Blue-sensitive Layer** | |
| Gelatin | 0.83 |
| Silver iodobromide emulsion g | 0.23 |
| Silver iodobromide emulsion d | 0.11 |
| Silver iodobromide emulsion c | 0.11 |
| SD-9 | $1.14 \times 10^{-4}$ |
| SD-10 | $1.62 \times 10^{-4}$ |
| SD-11 | $4.39 \times 10^{-4}$ |
| Y-1 | 0.90 |
| DI-3 | 0.002 |
| OIL-1 | 0.29 |
| AS-2 | 0.0014 |
| X-1 | 0.10 |
| Gelatin | 1.79 |

-continued

| 12th Layer: High-sped Blue-sensitive Layer | |
|---|---|
| Silver iodobromide emulsion f | 1.34 |
| Silver iodobromide emulsion g | 0.25 |
| SD-9 | $4.11 \times 10^{-5}$ |
| SD-10 | $1.95 \times 10^{-5}$ |
| SD-11 | $1.59 \times 10^{-4}$ |
| Y-1 | 0.33 |
| DI-5 | 0.12 |
| OIL-1 | 0.17 |
| AS-2 | 0.010 |
| X-1 | 0.098 |
| Gelatin | 1.15 |
| **13th Layer: First Protective Layer** | |
| Silver iodobromide emulsion i | 0.20 |
| UV-1 | 0.11 |
| UV-2 | 0.055 |
| X-1 | 0.078 |
| Gelatin | 0.70 |
| **14th Layer: Second protective Layer** | |
| PM-1 | 0.13 |
| PM-2 | 0.018 |
| WAX-1 | 0.021 |
| Gelatin | 0.55 |

Characteristics of silver idobromide emulsions used in sample 101 are shown below, wherein the average grain size refers to an edge length of a cube having the same volume as that of the grain.

| Emulsion | Av. Grain Size (μm) | Av. Iodide Content (mol %) | Diameter/thickness Ratio |
|---|---|---|---|
| a | 1.00 | 3.2 | 7.0 |
| b | 0.70 | 3.3 | 6.5 |
| c | 0.30 | 1.9 | 5.5 |
| d | 0.45 | 4.0 | 6.0 |
| e | 0.27 | 2.0 | Cubic |
| f | 1.20 | 8.0 | 5.0 |
| g | 0.75 | 8.0 | 4.0 |
| h | 0.45 | 4.0 | 6.0 |
| i | 0.03 | 2.0 | 1.0 |

With regard to the foregoing emulsions, except for emulsion i, after adding the foregoing sensitizing dyes to each of the emulsions and ripening the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizer ST-1; two kinds polyvinyl pyrrolidone of weight-average molecular weights of 10,000 and 1.100,000 (AF-1, AF-2); calcium chloride; inhibitors AF-3, AF-4, AF-5, AF-6 and AF-7; hardner H-1; and antiseptic Ase-1.

Chemical structures for each of the compounds used in the foregoing sample are shown below.

Y-1
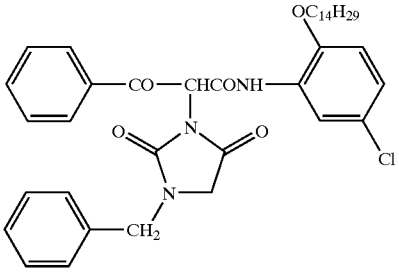
M-1
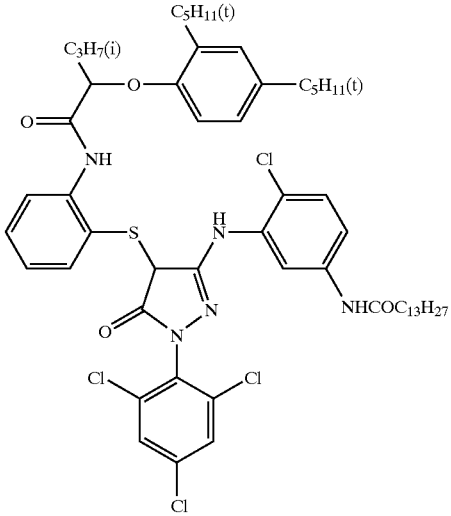
M-2
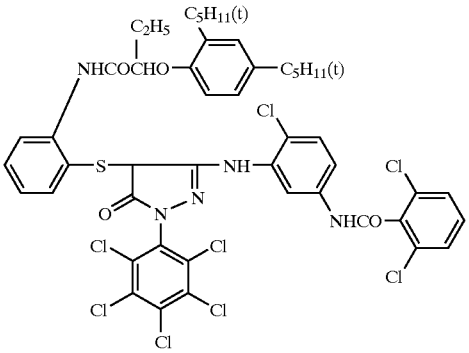
C-1
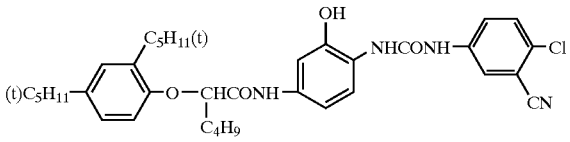
C-2
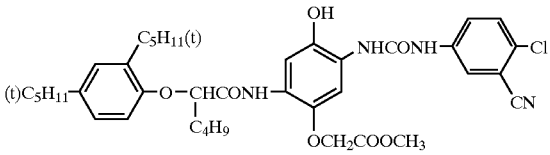
C-3
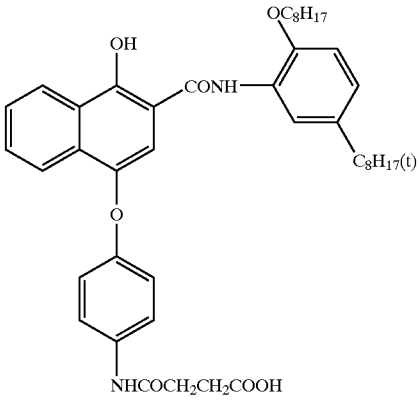

-continued
CC-1
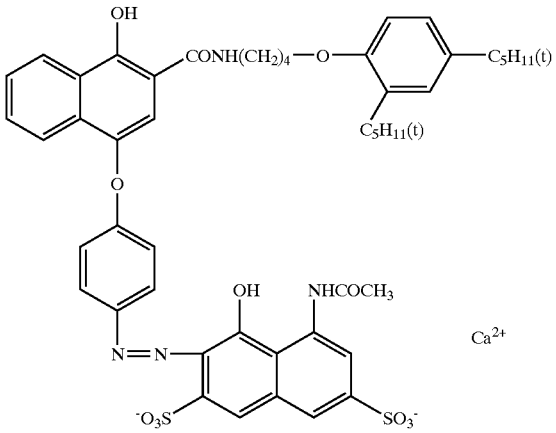
CM-1
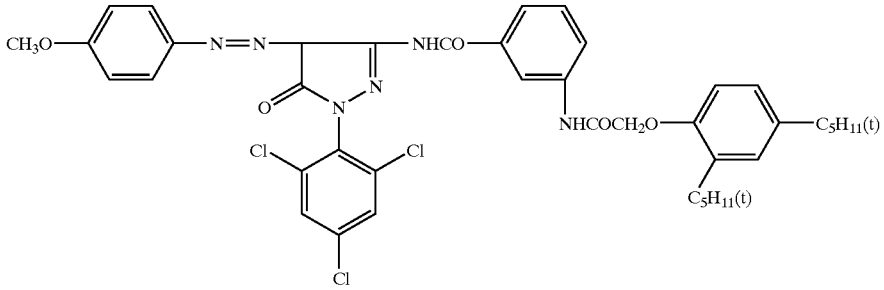
CM-2
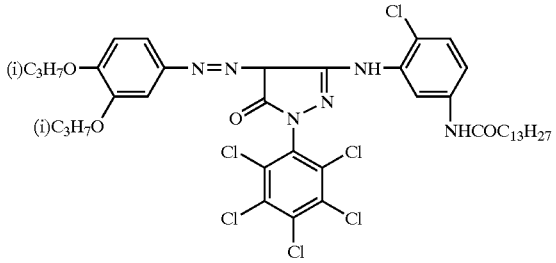
DI-1
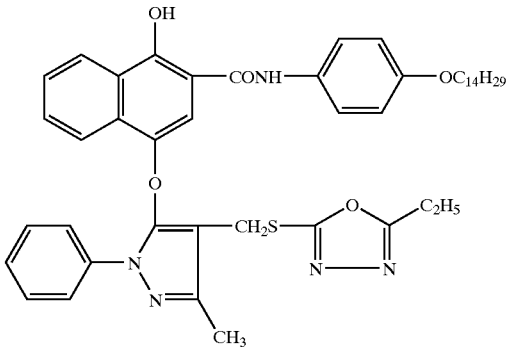
DI-2
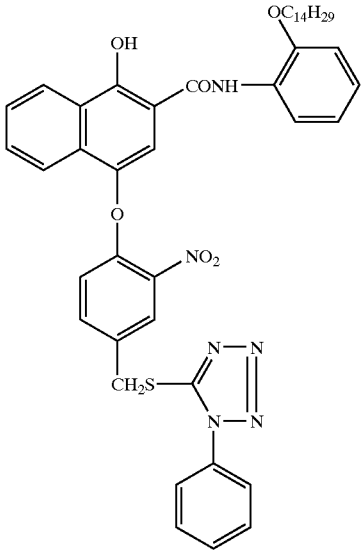
DI-3
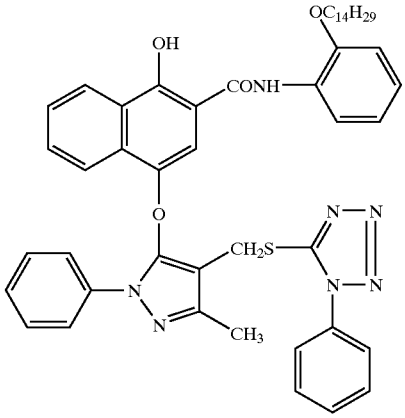

-continued
DI-4
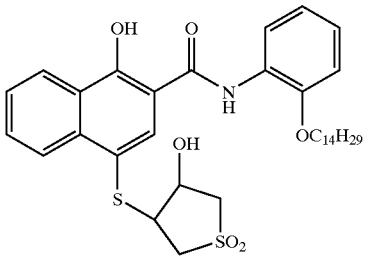
DI-5
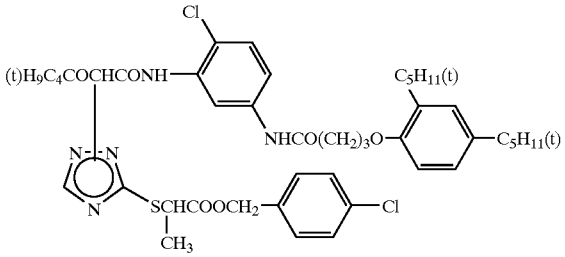
SD-1
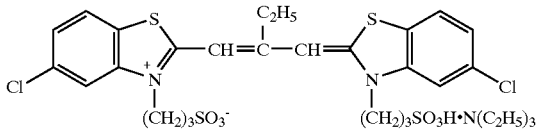
SD-2
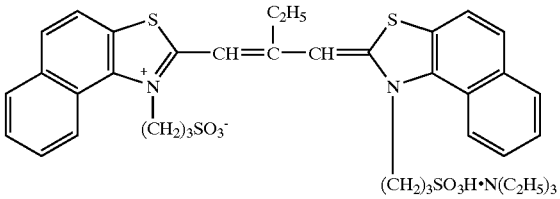
SD-3
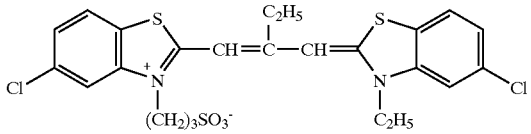
SD-4
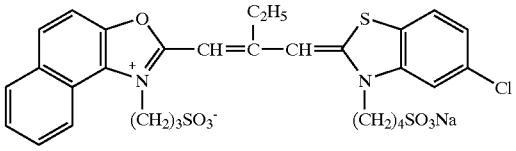
SD-5
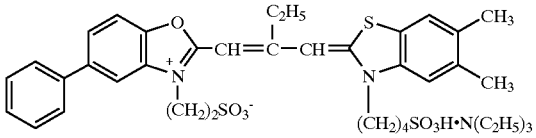
SD-6
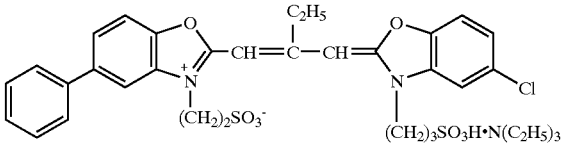
SD-7
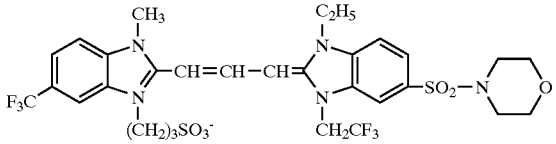
SD-8
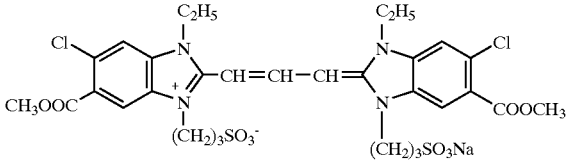
SD-9
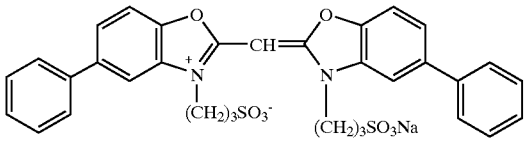
SD-10
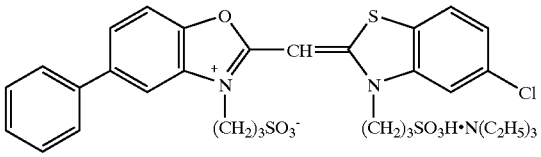
SD-11
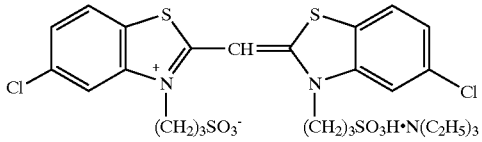
SD-12
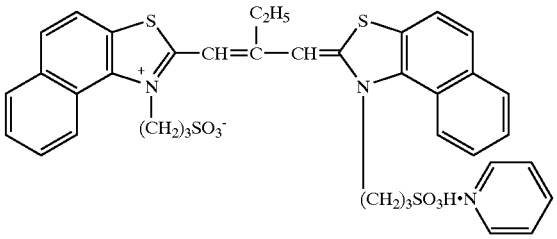

-continued
SD-13
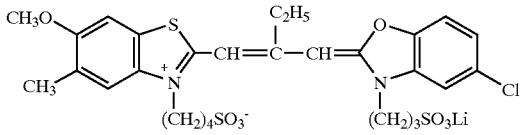
AS-1
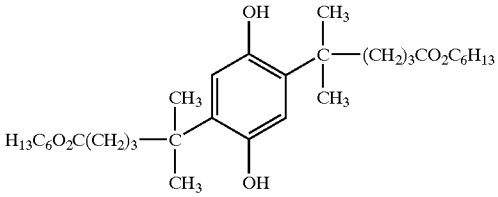
AS-2
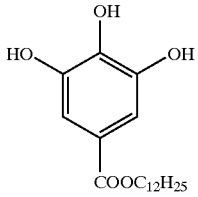
AS-3
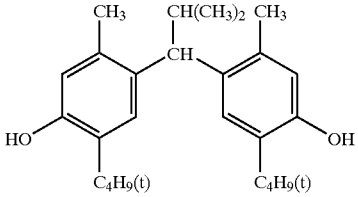
AS-4
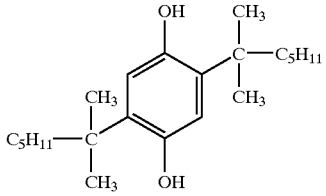
OIL-1
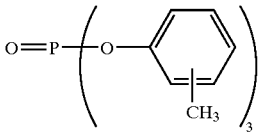
UV-1
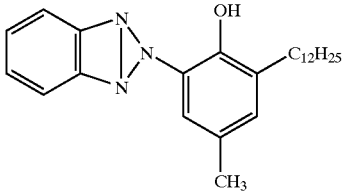
OIL-2
$H_9C_4OOC(CH_2)_8COOC_4H_9$
OIL-3
Liquid paraffin
UV-2
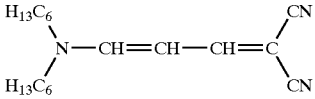
V-1
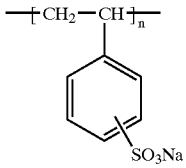
n: Polymerization degree
Ase-1 (mixture)
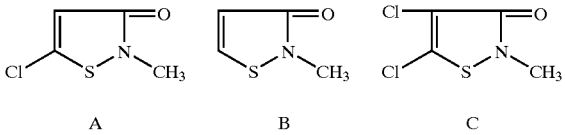
A B C
A: B: C = 50:46:4 (molar ratio)
H-1
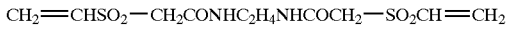
ST-1
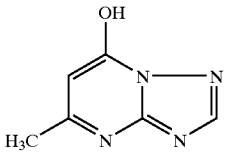
AF-1, 2
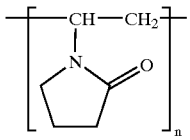
AF-1 Mw ≠ 10,000
AF-2 Mw ≠ 100,000
n: Polymerization degree
AF-3
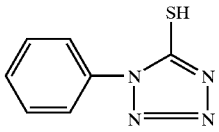

-continued

AF-4

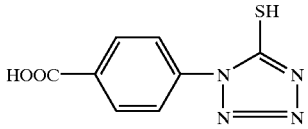

AF-5

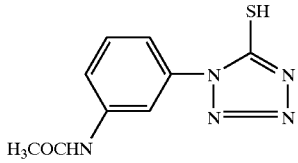

AF-6

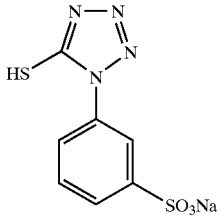

AF-7

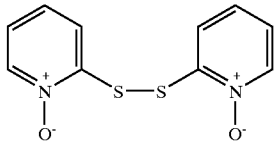

X-1

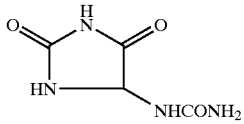

X-2

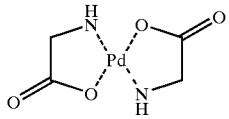

SU-1

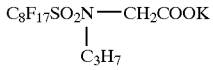

SU-2

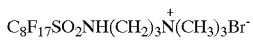

SU-3

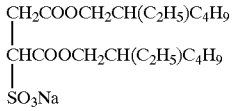

SU-4

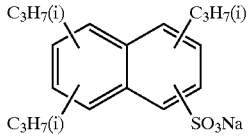

WAX-1

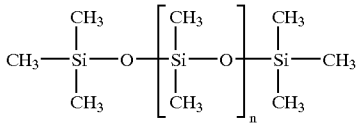

Mw = 3,000

PM-1

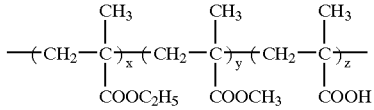

x:y:z = 3:3:4

PM-2

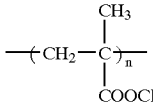

n: Polymerization degree

Preparation of Samples 107 through 109

Samples 107 through 109 were prepared similarly to Sample 101, except that emulsion Em-1 used in the 9th layer was replaced by emulsions Em-7 through Em-9, respectively.

Preparation of Sample 110

Sample 110 was prepared similarly to Sample 109, except that to each of the foregoing silver iodobromide emulsions other than silver iodobromide emulsion i, sensitizing dyes described above were added and ripened, then silver iodobromide emulsion g and emulsion Em-9 were each added with selenium compound Se-4 of $4.3\times10^{-6}$ mol and $5.7\times10^{-6}$ mol per mol of silver halide, respectively, so that an average selenium content was $5.2\times10^{-6}$ mol per mol of total silver halide, and then the emulsions were chemically sensitized at a silver potential of 110 mV by adding sodium thiosulfate, chloroauric acid and potassium thiocyanate.

Preparation of Sample 111

Sample 111 was prepared similarly to Sample 110, except that $5\times10^{-5}$ mol/mol Ag of exemplified disulfide compound 1–6 (oxidation type inhibitor) was added after completion of chemical sensitization.

Preparation of Sample 112

Sample 112 was prepared similarly to Sample 111, except that $2.3\times10^{-5}$ mol/mol Ag of exemplified compound T-25 (two-electron donor) was added to the 9th layer.

Preparation of Sample 113

Sample 113 was prepared similarly to Sample 111, except that $2.3\times10^{-5}$ mol/mol Ag of exemplified compound T-36 (two-electron donor) was added to the 9th layer.

Preparation of Sample 114

Sample 114 was prepared similarly to Sample 111, except that $2.3\times10^{-5}$ mol/mol Ag of exemplified compound T-49 (two-electron donor) was added to the 9th layer.

Sample Evaluation A

Processing A

Immediately after preparation of color photographic material samples, the samples each were exposed through TOSHIBA glass file (Y-48) and an optical wedge, using a light source having a color temperature of 5400° K. and processed in accordance with the following process:

Process:

| Processing step | Time | Temperature | Replenishing rate* |
|---|---|---|---|
| Color developing | 100 sec. | 45 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*Amounts per $m^2$ of photographic material.

A color developer, bleach, fixer and stabilizer each were prepared according to the following formulas.

Color developer solution

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | |
| 4-Amino-3-methyl-N-(β-hydroxyethyl)-aniline sulfate | 4.5 g | 6.3 |
| Diethylenetriaminepentaacetic acid | 3.0 g | 3.0 g |
| Potassium hydroxide | 1.2 g | 2.0 g |

Water was added to make 1 liter in total, and the pH of the developer and replenisher were adjusted to 10.06 and 10.18, respectively, using potassium hydroxide and 20% sulfuric acid.

Bleaching Solution

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher was adjusted to 4.4 and 4.0, respectively, using ammoniacal water or glacial acetic acid.

Fixer Solution (Worker and Replenisher)

| | | |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of fixer and replenisher was adjusted to 6.2 and 6.5, respectively, using ammoniacal water or glacial acetic acid.

Stabilizer Solution (Worker and Replenisher):

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

The thus processed samples were subjected to densitometry using green light to determine sensitivity. The sensitivity and graininess were determined in accordance with the f following procedure.

Sensitivity

Sensitivity (hereinafter, also designated simply as "S") of each sample was represented by a relative value of the reciprocal of exposure giving a density of minimum density (Dmin) plus 0.2, based on the sensitivity of the sample of emulsion Em-A being 100. The greater value indicates a higher sensitivity.

Graininess

Graininess (hereinafter, also designated simply as "G") was evaluated, based on RMS granularity. The RMS granularity was determined in such a manner that a portion having a density of minimum density plus 0.2 was scanned by a microdensitometer at an aperture scanning area of 1800 $\mu m^2$ (a slit width of 10 $\mu$m and a slit length of 180 $\mu$m) using green light and a value of 100 times a standard deviation of density for at least 1000 densitometry samplings was determined. This value was defined as the RMS granularity and represented by a relative value, based on that of sample 102 being 100. The less value indicates superior graininess.

Sample Evaluation B

Samples were evaluated similarly to the foregoing Evaluation A, provided that samples were processed according to Processing B, in place of Processing A. Processing B is the same as Processing A, except that the time and temperature in the color developing step were varied as follows:

| Processing step | Time | Temperature | Replenishing rate |
|---|---|---|---|
| Color developing | 45 sec. | 60 ± 0.3° C. | 780 ml |

Sample Evaluation C

Samples were evaluated similarly to the foregoing Evaluation A, provided that samples were processed according to Processing C, in place of Processing A. Processing C is the same as Processing B, except that the time and temperature in the color developing step were varied as follows and the pH of color developer solution was changed from 10.06 to 11.06:

| Processing step | Time | Temperature | Replenishing rate |
|---|---|---|---|
| Color developing | 20 sec. | 60 ± 0.3° C. | 780 ml |

Results of Evaluations A, B and C are shown in Table 1.

TABLE 1

| Sample No. | Emulsion (9th Layer) | Av. Aspect Ratio | Processing A S | Processing A G | Processing B S | Processing B G | Processing C S | Processing C G | Remark |
|---|---|---|---|---|---|---|---|---|---|
| 101 | Em-1 | 12 | 117 | 95 | 122 | 96 | 128 | 98 | Inv. |
| 107 | Em-7 | 7.5 | 85 | 101 | 89 | 107 | 94 | 118 | Comp. |
| 108 | Em-8 | 17.6 | 115 | 82 | 120 | 84 | 129 | 88 | Inv. |
| 109 | Em-9 | 20.6 | 116 | 80 | 124 | 82 | 128 | 83 | Inv. |
| 110 | Em-9 | 20.6 | 120 | 82 | 128 | 86 | 135 | 90 | Inv. |
| 111 | Em-9 | 20.6 | 118 | 79 | 124 | 80 | 132 | 82 | Inv. |
| 112 | Em-9 | 20.6 | 122 | 78 | 128 | 81 | 136 | 83 | Inv. |
| 113 | Em-9 | 20.6 | 121 | 76 | 127 | 79 | 134 | 81 | Inv. |
| 114 | Em-9 | 20.6 | 124 | 79 | 128 | 80 | 133 | 82 | Inv. |

As can be seen from Table 1, it was proved that inventive samples led to improved results in sensitivity and graininess, when developed at relatively high temperature (Processing B) and such results were achieved even when developed at relatively high temperature and high pH value (Processing C).

Example 2

Photographic samples prepared in Example 1 were each converted in accordance with the 135 size film standard and packed in a cartridge. Using these film samples and a single-lens reflex camera provided with lens of 35 mm focal length and F:2 (F4, product by Nikon Corp.), five scenes including people, flowers, greenish plants, far mountains and blue sky were photographed, setting the ISO speed to be 800. Thereafter, the exposed film samples were subjected to color development according to the method described in Example1, without further subjecting to bleaching, fixing and stabilizing processes to obtain developed samples in which developed silver and silver halide remained. From the thus developed film, R, G and B separation negative images were obtained using a monochromatic CCD camera of 2048×2048 pixels (KX4, available from Eastman Kodak Co.), in which a red separation filter (gelatin filter No. W26, available from Eastman Kodak Co.), a green separation filter (No. W99) or a blue separation filter (No. W98) was arranged between the light source and film. The thus obtained RGB image data were outputted onto Konica color paper type QAA7 of A4-size (210 mm×297 mm) to obtain color prints, using LED printer (available from Konica Corp.). Hereinafter, dpi refers to the number of dots per inch or 2.54 cm.

10 persons with respect to sharpness and granular appearance of images, vividness of greenish plants and apparent depth of mountains subjected the thus obtained color prints to sensory tests. As a result, it was proved that the color prints that were prepared using samples obtained by the process relating to this invention were by no means inferior to images obtained in the conventional photography system.

Example 3

Samples used in Example 2 were developed, and then further subjected to bleaching, fixing and stabilizing processes in accordance with the C41 standard process. The thus processed samples were evaluated similarly to example 3. As a result, it was proved that obtained prints were by no means inferior to images obtained in the conventional photography system.

Example 4

Samples used in Example 2 were developed and read using a CCD camera. Then, developed samples were further subjected to bleaching, fixing and stabilizing processes in accordance with the C41 standard process. Thereafter, similarly to Example 2, the processed samples were read with the CCD camera and from the obtained R, G and B separation negative images, color prints were prepared, which were proved to be by no means inferior to images obtained in the conventional photography system.

Example 5

Samples were processed and evaluated similarly to Example 2, provided that when the processed samples were read with the CCD camera, an image correction treatment was conducted based on infrared light transmitted through the photographic material sample, in accordance with the method described in JP-A No. 6-28468. As a result, it was proved to be by no means inferior or be superior to images obtained in the conventional photography system. Similar results were also obtained when correction was made using infrared reflection light.

Example 6

Processing and evaluation were conducted similarly to Example 1, except that color development was carried out using the processing element described in Examples 1 of JP-A No. 2002-55418. Similarly to Example 1, it was proved that this invention provided a color image forming method achieving enhanced sensitivity and superior storage stability.

Example 7

Preparation of Tabular Seed Emulsion 1-A

Tabular seed emulsion 1-A was prepared according to the following procedure.

Nucleation Process

A 10.47 lit. aqueous solution containing 70.7 g of gelatin A (alkali-processed inert gelatin, mean molecular weight of 100,000,methionine content of 55 $\mu$mol/g) and exhibiting a pBr of 2.0 was maintained at 20° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-11 and X-11 were added by double jet addition in one minute to perform nucleation.

S-11 Solution: 88.75 ml of 1.25 mol/l aqueous silver nitrate solution,

X-01 Solution: 88.75 ml of 1.25 mol/l aqueous potassium bromide solution,

Ripening Process

After completion of the nucleation process, solution G-01 containing the same gelatin as the foregoing gelatin A was added and after adjusted to a pBr of 2.3, the temperature was raised to 70° C. in 45 min. Immediately after starting to raise the temperature, the pBr was continuously varied from 2.3 to 1.9 in 45 min. using 1.75 mol/l aqueous potassium bromide solution. After reached 70° C., the reaction mixture was added with 96.8 ml of an aqueous solution containing 9.68 g of ammonium nitrate and 285 ml of a 10% aqueous potassium hydroxide solution was added and after being maintained for 6 min. 30 sec., the pH was adjusted to 6.1 using aqueous 56% acetic acid solution.

| | |
|---|---|
| G-01 Solution: | 1260 ml of aqueous solution containing 52.0 g of gelatin and 3.78 ml of a 10% methanol solution of surfactant (A) |
| Surfactant A: | $HO(CH_2CH_2O)m[CH(CH_3)CH_2O]_2O(CH_2CH_2O)nH$ (m + n = 10) |

Growth Process

After completion of the ripening process, solutions S-12 and X-12 were added by double jet addition at an accelerated flow rate over a period of 8 min., while maintaining the pH at 6.1 using a 56% aqueous acetic acid solution and the pBr at 1.7 using a 1.75 mol/m aqueous potassium bromide solution.

| | |
|---|---|
| S-12 Solution: | 1130 ml of 1.25 mol/l aqueous silver nitrate solution, |
| X-12 Solution: | 1130 ml of 1.25 mol/l aqueous potassium bromide solution. |

After completion of addition of respective solutions, the resulting emulsion was desalted by the flocculation washing process using a solution of Demol (available from Kao-Atlas Co.) and an aqueous magnesium sulfate solution, and gelatin A was added thereto and dispersed. The thus obtained emulsion was denoted as seed emulsion 1-A.

Preparation of Tabular Seed Emulsion 1-C

Tabular seed emulsion 1-C was prepared similarly to emulsion 1-A, except that gelatin A used in the nucleation and growth stage was replaced by gelatin C (oxidized gelatin, mean molecular weight of 100,000, methionine content of 8 μmol/g).

Preparation of Tabular Seed Emulsion 1-D

Tabular seed emulsion 1-D was prepared similarly to emulsion 1-A, except that gelatin A used in the nucleation and growth stage was replaced by gelatin D (oxidized gelatin, mean molecular weight of 100,000, methionine content of 0 μmol/g).

Preparation of Tabular Seed Emulsion 1-E

Tabular seed emulsion 1-E was prepared similarly to emulsion 1-C, except that the nucleation and ripening stage was varied as below.

Nucleation Process

A 10.47 lit. aqueous solution containing 70.7 g of gelatin C and exhibiting a pBr of 2.0 was maintained at 30° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the above-described solutions, S-11 and X-11 were added by double jet addition in one minute to perform nucleation.

| | |
|---|---|
| S-11 Solution: | 88.75 ml of 1.25 mol/l aqueous silver nitrate solution, |
| X-01 Solution: | 88.75 ml of 1.25 mol/l aqueous potassium bromide solution. |

Ripening Process

After completion of the nucleation process, solution G-01 containing gelatin C was added and after adjusted to a pBr of 2.3, the temperature was raised to 70° C. in 40 min. Immediately after starting to raise the temperature, the pBr was continuously varied from 2.3 to 1.9 in 45 min. using 1.75 mol/l aqueous potassium bromide solution. After reached 70° C., the reaction mixture was added with 96.8 ml of an aqueous solution containing 9.68 g of ammonium nitrate and 285 ml of a 10% aqueous potassium hydroxide solution was added and after being maintained for 6 min. 30 sec., the pH was adjusted to 6.1 using aqueous 56% acetic acid solution.

Preparation of Tabular Silver Halide Grain Emulsion Em-101

Subsequently, the foregoing tabular seed emulsion 1-A was grown in accordance with the following procedure to prepare tabular grain emulsion Em-101, in which the mixing stirrer, as described in JP-A No. 62-160128 was used, and to remove soluble components from the reaction mixture by means of ultrafiltration was employed an apparatus described in JP-A No. 10-339923. Thus, to an aqueous 1% gelatin solution containing 0.411 mol. equivalent tabular seed emulsion 1-A and 0.12 ml of a 10% methanol solution of the foregoing surfactant A, pure water and 285.4 g of gelatin A were added to make 29.9 lit., then, the following solutions S-12 and X-12 were added by double jet addition at an accelerated flow rate over a period of 86 min. with maintaining the pAg at 9.4 using a 1.75 mol/l aqueous potassium bromide solution, while soluble components in the reaction mixture were removed by ultrafiltration to maintain the reaction mixture at a constant volume.

| | |
|---|---|
| S-12 Solution: | 7538 ml of 1.75 mol/l aqueous silver nitrate solution, |
| X-12 Solution: | 7538 ml of 1.741 mol/l potassium bromide and 0.009 mol/l potassium iodide aqueous solution. |

The reaction mixture was further subjected to ultrafiltration over a period of 30 min. to remove 12.0 lit. of soluble components from the reaction mixture. Thereafter, the following solution S-13 was added thereto at a decreasing flow rate over a period of 16 min., followed by adjusting the pAg to 8.6.

| | |
|---|---|
| S-133 Solution: | 727 ml of 1.75 mol/l aqueous silver nitrate solution |

Subsequently, solutions I-11 and Z-11 were added and after adjusting to a pH of 9.3 and being maintained for 6 min., the pH was adjusted to 5.0 with a 56% aqueous acetic acid solution and the pAg was adjusted to 9.4 with a 1.75 mol/l aqueous potassium bromide solution:

| | |
|---|---|
| I-11 Solution: | 1550 ml of aqueous solution containing 192.3 g of sodium p-iodoacetoamidobenzene-sulfonate, |
| Z-11 Solution: | 688 ml of aqueous solution containing 66.7 g of sodium sulfite. |

Then, the following solutions S-14 and X-14 were added at an accelerated flow rate over a period of 16 min with maintaining the pH at 5.0 with a 56% aqueous acetic solution and the pAg at 9.4 with a 1.75 mol/l aqueous potassium bromide solution, while soluble components in the reaction mixture were removed by ultrafiltration to maintain the reaction mixture at a constant volume.

| | |
|---|---|
| S-14 Solution: | 1090 ml of aqueous 1.75 mol/l silver nitrate solution, |
| X-14 Solution: | 1090 ml of aqueous 1.663 mol/l potassium bromide and 0.088 mol/l potassium iodide solution. |

Thereafter, the following solution S-15 was added thereto at a decreasing rate over a period of 15 min., followed by adjusting the pAg to 8.4.

| | |
|---|---|
| S-15 Solution: | 727 ml of 1.75 mol/l aqueous silver nitrate solution |

Subsequently, after adding solution M-11, the following solutions S-16 and X-16 were added by double jet addition at an accelerated flow rate over a period of 24 min. with maintaining the pH at 5.0 with a 56% aqueous acetic acid solution and the pAg at 8.4 with 1.75 mol/l aqueous potassium bromide solution, followed by adjusting the pAg to 9.4 with a 1.75 mol/l aqueous potassium bromide solution. Then, the following solutions S-17 and X-17 were added by double jet addition at an accelerated flow rate over a period of 17 min. During addition, soluble components in the reaction mixture were removed by ultrafiltration to maintain the reaction mixture at a constant volume, while maintaining the pH at 5.0 with a 56% aqueous acetic acid solution and the pAg at 9.4 with 1.75 mol/l aqueous potassium bromide solution.

| | |
|---|---|
| M-11 solution: | 132 ml of aqueous solution containing 234.7 mg of $K_4[Ru(CN)_6]$ |
| S-16 Solution: | 605 ml of aqueous 1.75 mol/l silver nitrate solution |

-continued

| | |
|---|---|
| X-16 Solution: | 605 ml of aqueous solution containing 1.663 mol/l potassium bromide and 0.088 mol/l potassium iodide |
| S-17 Solution: | 1211 ml of aqueous 1.75 mol/l silver nitrate solution, |
| X-17 Solution: | 1211 ml of aqueous 1.75 mol/l potassium bromide solution. |

After completion of addition, aqueous solution containing 360 g of chemically modified gelatin (in which the amino group was phenylcarbamoyled at a modification percentage of 95%) was added to perform desalting and washing, and then gelatin A was further added and dispersed, followed by adjusting the pH and pAg to 5.8 and 8.9, respectively, at 40° C. Tabular silver halide grain emulsion Em-101 was thus obtained.

Preparation of Tabular Grain Emulsions Em-103 to Em-105

Using tabular seed grain emulsions 1-C, 1-D and 1-E, grain growth was subsequently conducted in a manner similar to the tabular grain emulsion 101 to prepare tabular grain emulsions Em-103, 104 and 105, respectively. Amounts of the respective tabular seed grain emulsions 1-C, 1-D and 1-E, and the foregoing solutions S-11 and X-11 were optimally adjusted so that the average volume equivalent grain diameter of the respective emulsions is equal to that of emulsion Em-101.

Analysis of tabular grain emulsions Em-103 to 105 revealed the results as shown in Table 2.

TABLE 2

| Emulsion | Tabular Grain (%)*1 | Tabular Grain (%)*2 | Average Aspect Ratio | C.V. of Grain Size*3 | Spacing between Twin Planes Average (A) | Spacing between Twin Planes C.V.*4 |
|---|---|---|---|---|---|---|
| Em-103 | 100.0 | 0.1 | 12.5 | 10.3 | 74 | 25 |
| Em-104 | 99.8 | 1.5 | 15.4 | 25.0 | 70 | 30 |
| Em-105 | 99.9 | 0.3 | 12.2 | 19.4 | 73 | 32 |

*1Percentage of tabular grains having an aspect ratio of at least 8, (111) major faces and two parallel twin planes, based on the total grain projected area
*2Percentage by number of grains having zero or one twin plane, or at least two non-parallel twin planes, based on total grains
*3Coefficient of variation of grain diameter
*4Coefficient of variation of spacing between twin planes As can be seen from Table 2, it is shown that emulsions Em-103, 104 and 105 each had a lower proportion of unwanted heteromorphic grains (grains having zero or one twin plane or at least two non-parallel twin planes), exhibiting improved coefficient of variation of grain size and higher aspect ratio.

Preparation of Tabular Grain Emulsion Em-107

Preparation of Tabular Seed Grain Emulsion 1-F

Tabular seed grain emulsion 1-F was prepared similarly to the tabular seed emulsion 1-A described above, provided that the ripening process and the growth process were performed as below.

Ripening Process

After completion of the nucleation process, the temperature was raised to 75° C. in 73 min. Immediately after starting to raise the temperature, the pAg was adjusted to 8.6. At 45 min after raining the temperature, the reaction mixture was added with 96.8 ml of an aqueous solution containing 9.68 g of ammonium nitrate and 285 ml of a 10% aqueous potassium hydroxide solution was added and after being maintained for 6 min. 30 sec., the pH was adjusted to 7.6 using aqueous 56% acetic acid solution.

Growth Process

After completion of the ripening process, the following solutions S-02 and X-02 were added by double jet addition at an accelerated flow rate over a period of 8 min., while maintaining the pH at 6.1 using a 56% aqueous acetic acid solution and the pAg at 8.6 using a 1.75 mol/m aqueous potassium bromide solution.

| | |
|---|---|
| S-02 Solution: | 1130 ml of 1.25 mol/1 aqueous silver nitrate solution, |
| X-02 Solution: | 1130 ml of 1.25 mol/l aqueous potassium bromide solution. |

After completion of addition of respective solutions, the resulting emulsion was desalted by the flocculation washing process using a solution of Demol (available from Kao-Atlas Co.) and an aqueous magnesium sulfate solution, and alkali-processed inert gelatin E was added thereto and dispersed. The thus obtained emulsion was denoted as seed emulsion 1-F.

Preparation of Tabular Grain Emulsion Em-107

Tabular grain emulsion Em-107 was prepared similarly to tabular grain emulsion Em-101, except that seed emulsion was replaced by the foregoing seed emulsion 1-F, and solutions I-11 and Z-11 were replaced by the following solutions I-31 and Z-31, respectively.

| | |
|---|---|
| I-31 Solution: | 806 ml of aqueous solution containing 100.0 g of sodium p-iodoacetoamidobenzene-sulfonate, |
| Z-31 Solution: | 358 ml of aqueous solution containing 34.7 g of sodium sulfite. |

Tabular grain emulsion Em-107 was thus obtained. As a result of analysis of the emulsion EM-107, it was proved that at least 95% of the total grain projected area was accounted for by tabular silver halide grains, and 95% by number of the total grains was accounted for by tabular grains having an average aspect ratio of 11, an average equivalent circle diameter of 2.4 μm, a variation coefficient of equivalent circle diameter of total grains was 32%, an average grain thickness of 0.22 μm, an average spacing between twin planes of 70 A and two twin planes parallel to the major faces. It was further proved that of the tabular grains contained in the emulsion Em-107, those having dislocation lines accounted for 72% by number, those having dislocation lines in the fringe portions and within the major faces accounted for 33% by number, those having at least 10 dislocation lines in fringe portions accounted for 55% by number and those having at least 30 dislocation lines in the fringe portions accounted for 35% by number.

The tabular grain emulsion Em-107 was comprised of silver halide grains having an average iodide content of 2.3 mol % and an average surface iodide content of 5.9 mol %. A coefficient of variation of spacing between twin planes was 30%, a coefficient of variation of grain thickness was 33%, 34% of the total tabular grain surface was accounted for by (100) face, and at least 90% by number of the tabular grains was accounted for by hexagonal tabular grains. It was further proved that the proportion of heteromorphic grains was 4.1% by number and that of heteromorphic tabular grains was 3.2% by number. Grains meeting $I_1>I_2$ was 58% by number, in which $I_1$ and $I_2$ represented an average iodide contents of the major face and the side-face, respectively.

Preparation of Tabular Grain Emulsion Em-108

Tabular grain emulsion Em-108 was prepared similarly to the foregoing tabular grain emulsion Em-101, except that the pAg was controlled to 9.6 while the foregoing solutions S-11 and X-11 were added. As a result of analysis of the emulsion EM-108, it was proved that at least 95% of the total grain projected area was accounted for by tabular silver halide grains, and 95% by number of the total grains was accounted for by tabular grains having an average aspect ratio of 15, an average equivalent circle diameter of 2.6 μm, a variation coefficient of equivalent circle diameter of total grains was 37%, an average grain thickness of 0.19 μm, an average spacing between twin planes of 74 A and two twin planes parallel to the major faces.

It was further proved that of the tabular grains contained in the emulsion Em-108, those having dislocation lines accounted for 74% by number, those having dislocation lines in the fringe portions and within the major faces accounted for 38% by number, those having at least 10 dislocation lines in fringe portions accounted for 52% by number and those having at least 30 dislocation lines accounted for 32% by number.

The tabular grain emulsion Em-108 was comprised of silver halide grains having an average iodide content of 2.3 mol % and an average surface iodide content of 6.5 mol %. A coefficient of variation of spacing between twin planes was 31%, a coefficient of variation of grain thickness was 32%, 30% of the total tabular grain surface was accounted for by (100) face, and at least 90% by number of the tabular grains was accounted for by hexagonal tabular grains. It was further proved that the proportion of heteromorphic grains was 1.0% by number and that of heteromorphic tabular grains was 0.8% by number. Grains meeting $I_1>I_2$ was 76% by number, in which $I_1$ and $I_2$ represented an average iodide contents of the major face and the side-face, respectively.

Preparation of Silver Halide Color Photographic Material

Preparation of Sample 701

Similarly to Example 1, on a 120 μm thick subbed polyethyleneterephthalate film support, the following layers having composition as shown below were formed to prepare a multi-layered color photographic material sample 701.

| | |
|---|---|
| 1st Layer: Anti-Halation Layer | |
| Black colloidal silver | 0.16 |
| UV-1 | 0.30 |
| F-1 | 0.012 |
| CM-1 | 0.12 |
| OIL-1 | 0.25 |
| Gelatin | 1.40 |
| 2nd Layer: Interlayer | |
| AS-1 | 0.12 |
| OIL-1 | 0.15 |
| Gelatin | 0.67 |

-continued

| | |
|---|---|
| 3rd Layer: Low-speed Red-Sensitive Layer | |
| Silver iodobromide emulsion A | 0.24 |
| Silver iodobromide emulsion B | 0.24 |
| Silver iodobromide emulsion C | 0.32 |
| SD-1 | $4.8 \times 10^{-4}$ |
| SD-2 | $7.1 \times 10^{-4}$ |
| SD-3 | $7.6 \times 10^{-5}$ |
| SD-4 | $2.0 \times 10^{-4}$ |
| C-1 | 0.18 |
| C-2 | 0.62 |
| CC-1 | 0.007 |
| OIL-2 | 0.48 |
| Gelatin | 1.88 |
| 4th Layer: Medium-speed Red-sensitive Layer | |
| Silver iodobromide emulsion D | 0.75 |
| Silver iodobromide emulsion A | 0.40 |
| SD-1 | $4.5 \times 10^{-4}$ |
| SD-2 | $5.9 \times 10^{-5}$ |
| SD-4 | $2.8 \times 10^{-4}$ |
| C-1 | 0.40 |
| CC-1 | 0.07 |
| DI-1 | 0.053 |
| OIL-2 | 0.26 |
| Gelatin | 1.36 |
| 5th Layer: High-speed Red-Sensitive Layer | |
| Silver iodobromide emulsion E | 1.56 |
| Silver iodobromide emulsion D | 0.17 |
| SD-1 | $2.1 \times 10^{-4}$ |
| SD-2 | $1.0 \times 10^{-4}$ |
| SD-4 | $2.8 \times 10^{-5}$ |
| SD-13 | $2.8 \times 10^{-4}$ |
| SD-9 | $1.5 \times 10^{-5}$ |
| C-1 | 0.12 |
| C-3 | 0.17 |
| CC-1 | 0.016 |
| DI-4 | 0.01 |
| DI-5 | 0.046 |
| OIL-2 | 0.18 |
| OIL-3 | 0.19 |
| Gelatin | 1.59 |
| 6th Layer: Interlayer | |
| Y-1 | 0.11 |
| AS-1 | 0.18 |
| OIL-1 | 0.26 |
| AF-6 | 0.001 |
| Gelatin | 1.00 |
| 7th Layer: Low-speed Green-Sensitive Layer | |
| Silver iodobromide emulsion F | 0.20 |
| Silver iodobromide emulsion C | 0.20 |
| SD-5 | $3.2 \times 10^{-5}$ |
| SD-6 | $5.0 \times 10^{-4}$ |
| SD-7 | $9.2 \times 10^{-5}$ |
| SD-8 | $1.6 \times 10^{-4}$ |
| M-1 | 0.33 |
| CM-1 | 0.052 |
| DI-2 | 0.013 |
| AS-2 | 0.001 |
| OIL-1 | 0.35 |
| Gelatin | 1.13 |
| 8th Layer: Medium-speed Green-Sensitive Layer | |
| Silver iodobromide emulsion D | 0.52 |
| Silver iodobromide emulsion F | 0.22 |
| SD-5 | $3.0 \times 10^{-5}$ |
| SD-6 | $4.2 \times 10^{-4}$ |
| SD-7 | $1.8 \times 10^{-4}$ |
| SD-8 | $1.6 \times 10^{-4}$ |
| M-1 | 0.14 |
| CM-1 | 0.043 |
| CM-2 | 0.044 |
| DI-3 | 0.0044 |
| DI-2 | 0.027 |
| AS-4 | 0.0059 |
| AS-3 | 0.015 |

-continued

| | |
|---|---|
| AS-5 | 0.043 |
| OIL-1 | 0.27 |
| Gelatin | 1.04 |
| 9th Layer: High-speed Green-Sensitive Layer | |
| Tabular grain emulsion Em-101 | 1.57 |
| SD-5 | $1.1 \times 10^{4}$ |
| SD-6 | $5.1 \times 10^{-4}$ |
| SD-8 | $9.3 \times 10^{-5}$ |
| SD-9 | $1.5 \times 10^{-5}$ |
| M-1 | 0.052 |
| M-2 | 0.099 |
| CM-2 | 0.011 |
| DI-3 | 0.0034 |
| AS-2 | 0.0069 |
| AS-5 | 0.045 |
| AS-3 | 0.023 |
| OIL-1 | 0.28 |
| OIL-3 | 0.20 |
| Gelatin | 1.54 |
| 10th Layer: Yellow Filter Layer | |
| F-2 | 0.048 |
| F-3 | 0.04 |
| AS-1 | 0.15 |
| OIL-1 | 0.18 |
| Gelatin | 0.67 |
| 11th Layer: Low-speed Blue-sensitive Layer | |
| Silver iodobromide emulsion H | 0.19 |
| Silver iodobromide emulsion I | 0.24 |
| Silver iodobromide emulsion J | 0.11 |
| SD-12 | $3.4 \times 10^{-4}$ |
| SD-11 | $1.1 \times 10^{-4}$ |
| SD-10 | $2.1 \times 10^{-4}$ |
| SD-9 | $3.0 \times 10^{-5}$ |
| Y-1 | 1.09 |
| DI-6 | 0.021 |
| AS-2 | 0.0016 |
| OIL-1 | 0.33 |
| X-1 | 0.11 |
| Gelatin | 2.06 |
| 12th Layer: High-sped Blue-sensitive Layer | |
| Silver iodobromide emulsion K | 1.33 |
| Silver iodobromide emulsion I | 0.17 |
| Silver iodobromide emulsion L | 0.17 |
| SD-12 | $2.2 \times 10^{-4}$ |
| SD-10 | $3.6 \times 10^{-5}$ |
| SD-9 | $3.0 \times 10^{-5}$ |
| Y-1 | 0.30 |
| DI-5 | 0.11 |
| X-3 | 0.0022 |
| OIL-1 | 0.17 |
| X-1 | 0.11 |
| Calcium chloride | 0.0026 |
| OIL-3 | 0.07 |
| Gelatin | 1.30 |
| 13th Layer: First Protective Layer | |
| Silver iodobromide emulsion M | 0.30 |
| UV-1 | 0.11 |
| UV-2 | 0.056 |
| OIL-3 | 0.03 |
| X-1 | 0.078 |
| AF-6 | 0.006 |
| Gelatin | 0.80 |
| 14th Layer: Second protective Layer | |
| PM-1 | 0.13 |
| PM-2 | 0.018 |
| WAX-1 | 0.021 |
| Gelatin | 0.55 |

Characteristics of silver iodobromide emulsions A through L are shown below.

TABLE 3

| Emulsion | AgX Grain*1 | Av. Grain Diameter (μm/CV) (%)*2 | Av. Grain Thickness (μm)/CV (%)*3 | Av. Aspect Ratio/CV*4 | Av. Iodide Content (mol %) | Av. Surface Iodide Content (mol %) |
|---|---|---|---|---|---|---|
| A | core/shell, Tabular | 0.96/19.0 | 0.17/18.7 | 5.8/26.6 | 3.7 | 7.1 |
| B | core/shell, cubic | 0.47/6.0 | 0.42/4.2 | 1.1/6.0 | 4.0 | 7.4 |
| C | core/shell, cubic | 0.30/8.4 | 0.27/5.0 | 1.1/7.0 | 2.0 | 3.6 |
| D | core/shell, Tabular | 1.83/25.9 | 0.20/22.3 | 10.0/30.8 | 3.8 | 6.6 |
| E | core/shell, Tabular | 3.34/36.0 | 0.20/22.2 | 17.7/40.0 | 2.2 | 5.5 |
| F | core/shell, Tabular | 0.96/19.0 | 0.17/18.7 | 5.8/26.6 | 3.7 | 7.1 |
| H | core/shell, Tabular | 1.31/14.7 | 0.39/22.0 | 3.5/22.6 | 7.9 | 8.6 |
| I | core/shell, Tabular | 0.96/19.0 | 0.17/18.7 | 5.8/26.6 | 3.7 | 7.5 |
| J | core/shell, cubic | 0.30/8.4 | 0.27/5.0 | 1.1/7.0 | 2.0 | 2.9 |
| K | core/shell, Tabular | 1.81/14.0 | 1.10/15.0 | 1.7/19.6 | 6.7 | 4.5 |
| M | homogeneous, tetradecahedral fine grain | 0.044/15.0 | 0.04/12.0 | 1.1/12.0 | 2.0 | 4.5 |
| L | homogeneous, Tabular | 0.45/37.0 | 0.10/50.0 | 5.0/39.0 | 2.0 | 4.8 |

*1characteristics of silver halide grains

*2average equivalent circle grain diameter (μm)/coefficient of variation of grain diameter (%)

*3average grain thickness (μm)/coefficient of variation of grain thickness (%)

*4average aspect ratio/coefficient of variation of aspect ratio

Each of emulsions described in Table 3, except for emulsion M was added with sensitizing dyes described above and chemically sensitized so as to achieve an optimum relationship between sensitivity and fog. Of emulsions described in Table 3, emulsions H through K were each subjected to reduction sensitization. Emulsions A through F were each comprised of silver halide grains occluding metal ions or a metal complex within the grain. Emulsions A through K were comprised of silver halide grains containing dislocation lines with the grain; in emulsions A, D through I and K, at least 50% by number of the grains was accounted for by grains containing at least 30 dislocation lines in fringe portions of the grain and at least 80% by number was accounted for by grains having two twin planes parallel to the major faces.

Compounds used in the foregoing samples are those used in Example 1, except for compounds shown below.

DI-6

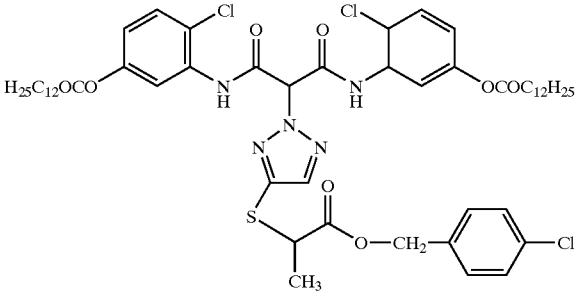

-continued

F-1

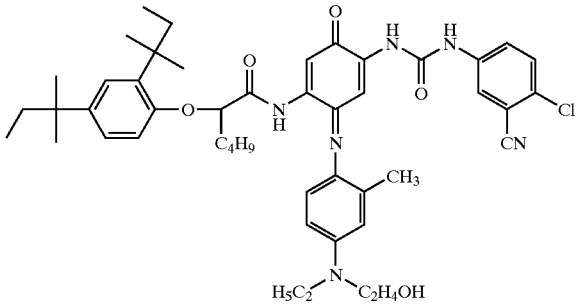

F-2

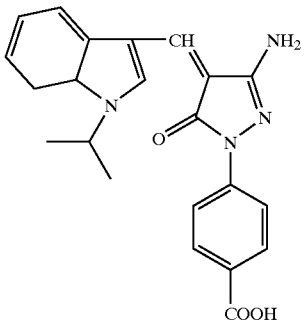

-continued

F-3

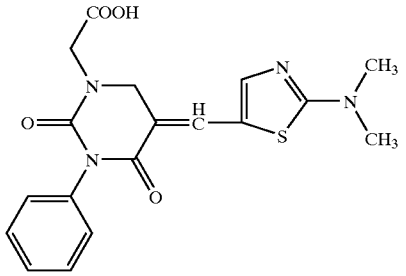

X-3

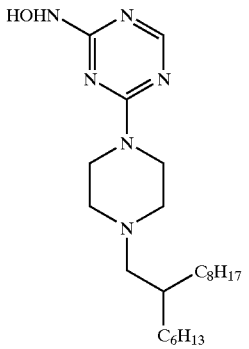

Preparation of Samples 703, 704, 705, 707 and 708

Photographic material samples 703, 704, 705, 707 and 708 were prepared similarly to Sample 701, except that emulsion Em-101 used in the 9th layer was replaced by emulsions Em-103, 104, 105, 107 and 108, respectively.

Preparation of Sample 709

Sample 109 was prepared similarly to Sample 101, except that silver iodobromide emulsion F used in the 7th layer was replaced by emulsion Em-9 described in Examples of JP-A No. 2000-241922. In the emulsion Em-9, 80% by number of total silver halide grains was accounted for by regular crystal grains having at least 10 dislocation lines.

Evaluation

Similarly to Example 1, samples were exposed and processes according to Processing A and evaluated with respect to sensitivity and graininess.

Sample was further evaluated with respect to storage stability according to the following procedure. Thus, prior to exposure, samples were aged in an atmosphere of 55° C. and 65% RH for two weeks and then processed similarly. The difference in minimum density ($D_{min}$) between aged and unaged samples was determined as an increase of fogging value (ΔFog). The less value indicates the better storage stability.

Processing D

Samples were evaluated similarly to the foregoing evaluation, provided that samples were processed according to the following Processing D, in place of Processing A. Processing D is the same as Processing A, except that the time and temperature in the color developing step were varied as follows and the pH of color developer solution was changed from 10.06 to 11.06:

| Processing step | Time | Temperature | Replenishing rate |
|---|---|---|---|
| Color developing | 25 sec. | 60 ± 0.3° C. | 780 ml |

The thus obtained results are shown in Table 4.

TABLE 4

| Sample | | Processing A | | | Processing D | | | |
|---|---|---|---|---|---|---|---|---|
| No. | Emulsion | S | G | ΔFog | S | G | ΔFog | Remark |
| 701 | Em-101 | 100 | 100 | 0.15 | 102 | 123 | 0.19 | Comp. |
| 703 | Em-103 | 120 | 90 | 0.02 | 128 | 92 | 0.02 | Inv. |
| 704 | Em-104 | 117 | 92 | 0.03 | 126 | 96 | 0.03 | Inv. |
| 705 | Em-105 | 118 | 88 | 0.04 | 132 | 95 | 0.05 | Inv. |
| 707 | Em-107 | 112 | 90 | 0.04 | 120 | 96 | 0.04 | Inv. |
| 708 | Em-108 | 115 | 88 | 0.02 | 122 | 94 | 0.03 | Inv. |
| 709 | Em-103 | 123 | 84 | 0.01 | 135 | 88 | 0.01 | Inv. |

As can be seen from Table 4, it was proved that photographic material samples containing emulsion Em-103 to Em-109 exhibited marked superior results when developed at a high temperature (Processing A) and such results were achieved even when developed at a higher temperature and a higher pH value (Processing D).

What is claimed is:

1. A method of forming a color image comprising:

(a) imagewise exposing a silver halide color photographic material comprising a support having thereon at least three light-sensitive layers, (b) subjecting the exposed photographic material to color development at a developing temperature of 43 to 180° C. to form a color image, and (c) converting information of the formed color image to digital image information through an image sensor, wherein at least one light-sensitive layer of the three light-sensitive layers comprises a silver halide emulsion comprising silver halide grains including tabular grains, said tabular grains accounting for at least 50% of total grain projected area and having an average aspect ratio of at least 8, and said silver halide grains having an average selenium content of $3.0\times10^{-8}$ to $5.0\times10^{-6}$ mol per grain.

2. The method of claim 1, wherein in step (c), reflection light from the photographic material is used.

3. The method of claim 1, wherein in step (C), infrared light is used.

4. The method of claim 1, wherein step (c) is performed without removing a silver halide or a light-insensitive silver compound contained in the photographic material.

5. The method of claim 1, wherein prior to step (c), the method further comprises the steps of:

(b') subjected the photographic material which has been subjected to the color development to at least one selected from the group of bleach, fixation and stabilization to obtain a color image.

6. The method of claim 1, wherein said tabular grains contain dislocation lines in a fringe portion of the tabular grains and the emulsion is prepared by a process of forming nucleus grains in the presence of a gelatin having a methionine content of less than 30 μmol/g and growing the nucleus grains to form the silver halide grains.

7. The method of claim 1, wherein said tabular grains contain non-iodide-gap type dislocation lines.

8. The method of claim 1, wherein said light-sensitive layer comprises a compound represented by the following formula (1)

$$R_1—(S)_m—R_2 \quad \text{formula (1)}$$

wherein $R_1$ and $R_2$ are each an aliphatic group, an aromatic group, a heterocyclic group, or $R_1$ and $R_2$ combine with each other to form a ring; and m is an integer of 2 to 6.

9. The method of claim 1, wherein said light-sensitive layer comprises a compound capable of permitting injection of at least two electrons into silver halide via photoexcitation by a single photon.

10. The method of claim 1, wherein the developing temperature is 50 to 160° C.

11. The method of claim 1, wherein the photographic material has an ISO speed of not less than 800.

12. The method of claim 1 wherein said tabular grains have an average overall surface iodide content of 5 to 15 mol % and an average surface iodide content of less than 3 mol % in the vicinity of corners of the grains, and said tabular grains each having at least 10 dislocation lines in a fringe portion of the tabular grains.

13. The method of claim 6, wherein the nucleus grains is formed at a temperature of less than 30° C. and the emulsion is subjected to ultrafiltration, while growing the nucleus grains to form the silver halide grains.

14. The method of claim 1, wherein said tabular grains have a silver phase epitaxially grown in the vicinity of corners of the tabular grains.

15. The method of claim 1, wherein said tabular grains each have (111) major faces and an aspect ratio of at least 8, and the emulsion comprising heteromorphic grains of less than 3% by number of the silver halide grains.

16. The method of claim 15, wherein said tabular grains have at least two twin planes and a spacing between at least two twin planes being 1 to 100 A and a coefficient of variation of spacing between at least two twin planes being not more than 35%.

17. The method of claim 1, wherein said tabular grains have an aspect ratio of at least 8 and at least 50% by number of the tabular grains meeting the following requirement:

$$I_1 > I_2$$

wherein $I_1$ is an average surface iodide content of major faces and $I_2$ is an average surface iodide content of side faces; and the emulsion comprising heteromorphic grains of 0.01 to 5% by number of the silver halide grains.

18. The method of claim 1, wherein said light-sensitive layer comprised plural light-sensitive layers having the same color-sensitivity and differing in speed, and a light-sensitive layer a highest speed comprises tabular silver halide grains having an aspect ratio of at least 8 and a light-sensitive layer having a lowest speed comprises silver halide regular crystal grains containing at least 10 dislocation lines.

* * * * *